US008670686B2

(12) United States Patent
Ito

(10) Patent No.: US 8,670,686 B2
(45) Date of Patent: Mar. 11, 2014

(54) IMAGE FORMING APPARATUS HAVING REGISTRATION DESIGNATION FOR OPTIONAL APPARATUS

(75) Inventor: Mitsuhiro Ito, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 393 days.

(21) Appl. No.: 12/791,215

(22) Filed: Jun. 1, 2010

(65) Prior Publication Data

US 2010/0316407 A1 Dec. 16, 2010

(30) Foreign Application Priority Data

Jun. 12, 2009 (JP) ..... 2009-140984

(51) Int. Cl.
*G03G 15/00* (2006.01)
*G03G 21/00* (2006.01)

(52) U.S. Cl.
USPC ..... 399/75; 399/38

(58) Field of Classification Search
USPC ..... 399/38, 75, 90
See application file for complete search history.

(56) References Cited

U.S. PATENT DOCUMENTS 5,449,162 A 9/1995 Saito et al.
6,169,567 B1 * 1/2001 Hashimoto et al. ..... 399/38 X
6,516,167 B2 * 2/2003 Takamura ..... 399/75
6,885,834 B2 4/2005 Ito et al.
7,796,909 B2 * 9/2010 Nishimura ..... 399/75
8,023,126 B2 * 9/2011 Semma et al. ..... 358/1.14
2006/0104688 A1 * 5/2006 Motoyama et al. ..... 399/396
2007/0120313 A1 * 5/2007 Wada ..... 271/9.02

FOREIGN PATENT DOCUMENTS

JP 11-313091 A 11/1999
JP 2001-195217 A 7/2001
JP 2003-040469 * 2/2003
JP 2003-040469 A 2/2003
JP 2006-133996 5/2006
JP 2006-225108 8/2006
JP 2007-253486 A 10/2007

* cited by examiner

*Primary Examiner* — Sandra Brase
(74) *Attorney, Agent, or Firm* — Fitzpatrick, Cella, Harper & Scinto

(57) ABSTRACT

The main body of the image forming system includes an image forming apparatus; an optional apparatus; and a communication unit configured to perform communication between the main body of the image forming apparatus and the optional apparatus. The optional apparatus includes one optional control unit for controlling multiple optional functions, and the main body of the image forming apparatus includes a registration designation unit configured to designate registration of an ID number to the one optional control unit of the optional apparatus by the communication unit to designate registration of an ID number to the one optional control unit of the optional apparatus. The one optional control unit assigns an ID number to each of the multiple optional functions according to the designation from the main body of the image forming apparatus.

14 Claims, 32 Drawing Sheets

| FIG. 6A |
| --- |
| FIG. 6B |

| FIG. 8A |
| --- |
| FIG. 8B |

| FIG. 13A |
| --- |
| FIG. 13B |

IMAGE FORMING APPARATUS HAVING REGISTRATION DESIGNATION FOR OPTIONAL APPARATUS

BACKGROUND OF THE INVENTION

1. Field of the Invention

The present invention relates to a technology for controlling communication between a main body of an image forming apparatus (an image forming apparatus main body) for forming an image by an electrophotographic process such as a copier or a printer and an optional apparatus attached to the image forming apparatus main body.

2. Description of the Related Art

Up to now, multiple optional apparatuses attachable to an image forming apparatus main body are connected to an image forming apparatus. While communicating with the optional apparatuses (slaves), the image forming apparatus main body (master) controls the optional apparatuses to execute a cooperative operation of conveyance for sheet feeding and sheet discharging, or the like.

For example, Japanese Patent Application Laid-Open No. 2006-133996 and Japanese Patent Application Laid-Open No. 2006-225108 disclose the image forming apparatus main body that performs communication with multiple cascade-connected optional apparatuses. One identification number (also called "ID number") is assigned to one optional apparatus connected to the image forming apparatus main body. Meanwhile, the optional apparatus permits a communication connection to another optional apparatus cascade-connected thereto.

By repeating assigning another identification number to another optional apparatus to which a communication connection is newly established, the image forming apparatus main body assigns separate identification numbers to all the optional apparatuses. In order to communicate with one specific optional apparatus, the image forming apparatus main body transmits communication data including an identification number thereof. Of the optional apparatuses that have received the identification number, only one optional apparatus having the corresponding identification number processes communication.

There is increasing demand that the optional apparatuses as described above have such flexibility after their release that a new optional apparatus desired by a user can be developed and connected to the image forming apparatus main body. In addition, less expensive optional apparatuses have been desired.

For example, it is assumed that optional sheet feeding apparatuses are connected to the image forming apparatus main body in such a manner that, at the time of their release, up to four optional sheet feeding apparatuses each having one sheet feeding function (one sheet feeding cassette) are stacked one upon another. It is possible that, after the above-mentioned release, optional sheet feeding apparatuses are added in such a manner that up to two optional sheet feeding apparatuses each having two sheet feeding functions (such an integral type as to have two cassettes with the reduced number of component parts and with the reduced costs because of sharing one control portion (unit) including a CPU on a slave side) are stacked one upon another (to have up to four sheet feeding functions in total).

The above-mentioned case of adding such a new optional sheet feeding apparatus as to have multiple sheet feeding mechanisms and one control device including a CPU as a slave leads to the following problem. That is, in the case where one optional apparatus has multiple sheet feeding functions, if the ID number is assigned to each optional apparatus, each sheet feeding function cannot be separately designated only by the ID number. As a result, there is a problem that each sheet feeding function cannot be controlled in a satisfactory manner.

Meanwhile, an upgrade has been carried out for adding communication specifications and conveyance control specifications corresponding to the new optional apparatus to the control portion of the image forming apparatus main body. As a result, if the upgrade is not carried out for the control device of the image forming apparatus main body, there occurs a problem that a newly purchased optional apparatus will not work after being attached thereto. In addition, at the time of product development before the release, all kinds of optional apparatus configuration that are to be requested by the users in the future cannot be expected, and hence the image forming apparatus main body cannot be caused to prestore information on all kinds of optional apparatus configuration, communication specifications thereof, or conveyance control specifications thereof.

SUMMARY OF THE INVENTION

The present invention has been made in view of the above-mentioned problems.

A purpose of the present invention is to provide a less expensive optional apparatus than a conventional one while maintaining usability thereof. In order to achieve the above-mentioned object, the present invention has the following configuration.

Another purpose of the invention is to provide an image forming system including an image forming system, including a main body of an image forming apparatus, an optional apparatus including one optional control unit configured to control a plurality of optional functions, and communication unit configured to performs communication between the main body of the image forming apparatus and the optional apparatus, wherein the main body of the image forming apparatus comprises registration designation unit configured to designate registration of an ID number to the one optional control unit of the optional apparatus by the communication unit, and wherein the one optional control unit of the optional apparatus assigns an ID number to each of the plurality of optional functions according to the designation performed by the registration designation unit.

Further features of the present invention will become apparent from the following description of exemplary embodiments with reference to the attached drawings.

BRIEF DESCRIPTION OF THE DRAWINGS

FIGS. 3B-1 and 3B-2 are second communication timing charts according to the first embodiment and the second embodiment of the present invention.

FIGS. 3C-1 and 3C-2 are third communication timing charts according to the first embodiment and the second embodiment of the present invention.

FIGS. 3D-1 and 3D-2 are fourth communication timing charts according to the first embodiment and the second embodiment of the present invention.

FIGS. 11A-1 and 11A-2 are communication timing charts according to the third embodiment of the present invention.

FIGS. 11B-1 and 11B-2 are another communication timing charts according to the third embodiment.

DESCRIPTION OF THE EMBODIMENTS (First Embodiment)

(Sectional View of Image Forming Apparatus)

Figure 1A:
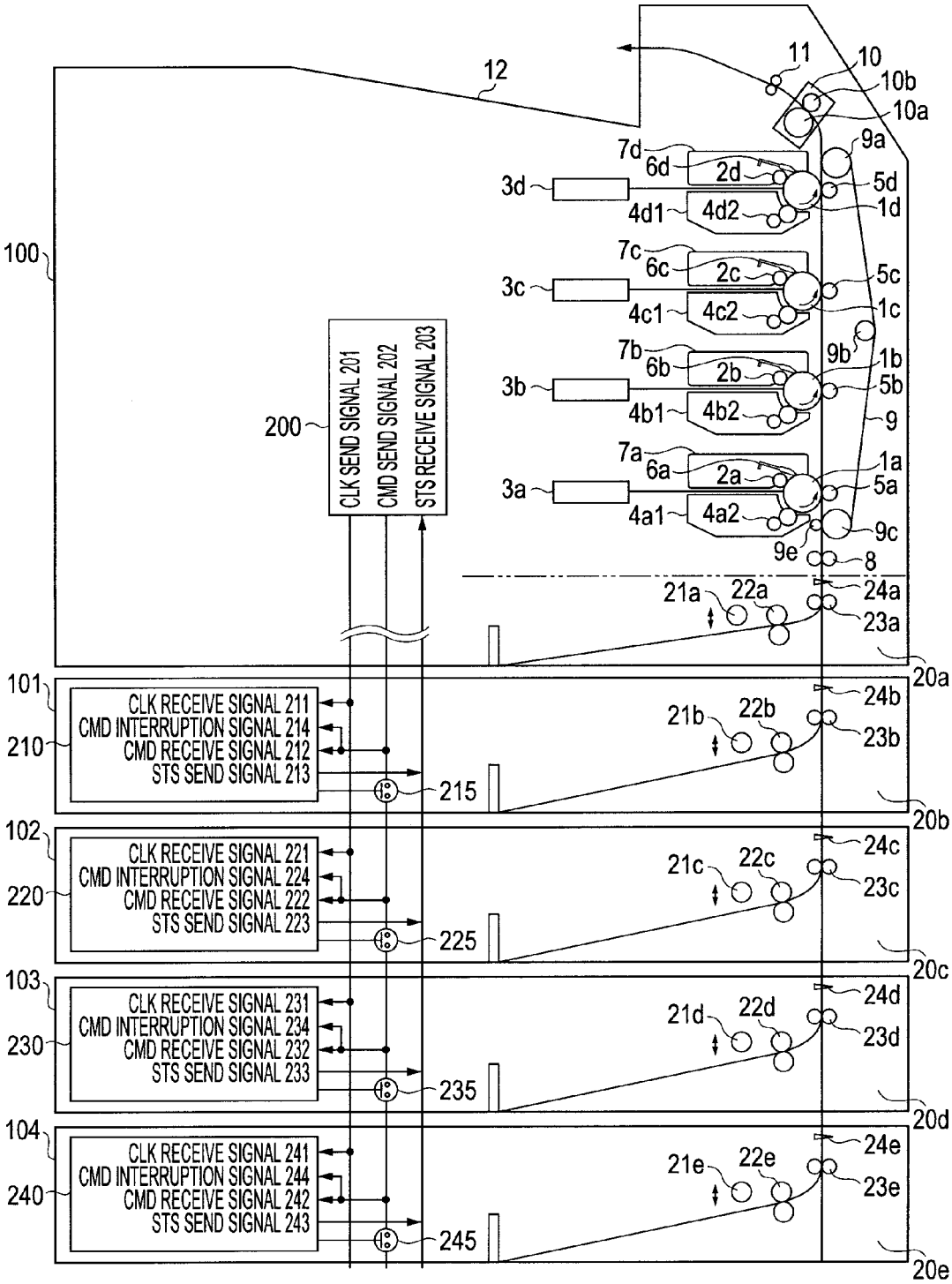
FIG. 1A is a sectional view and a communication interface diagram that illustrate an image forming apparatus (a main body of the image forming apparatus and optional apparatuses) according to a first embodiment and a second embodiment of the present invention.
Figure 1B:
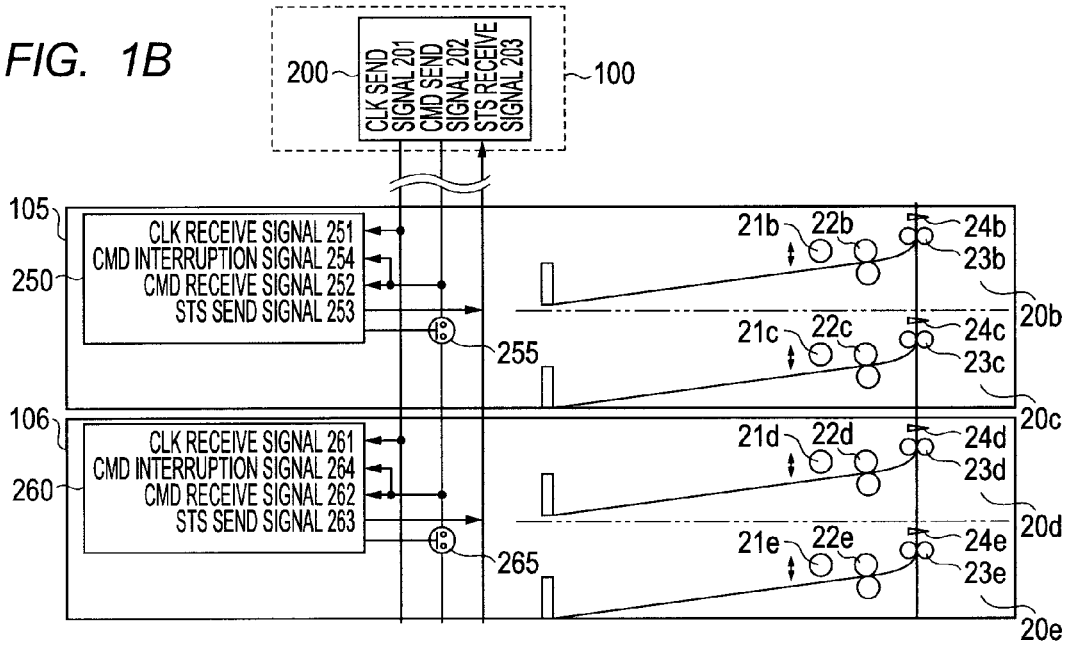
FIGS. 1B, 1C and 1D are sectional views and communication interface diagrams that illustrate other optional apparatuses according to the first embodiment and the second embodiment of the present invention.
Figure 1C:
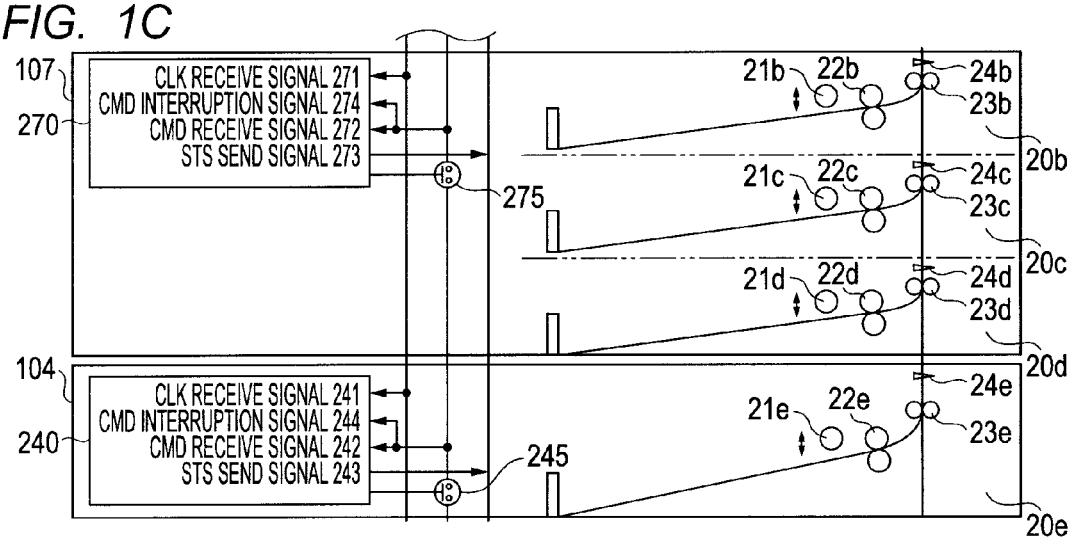
Figure 1D:
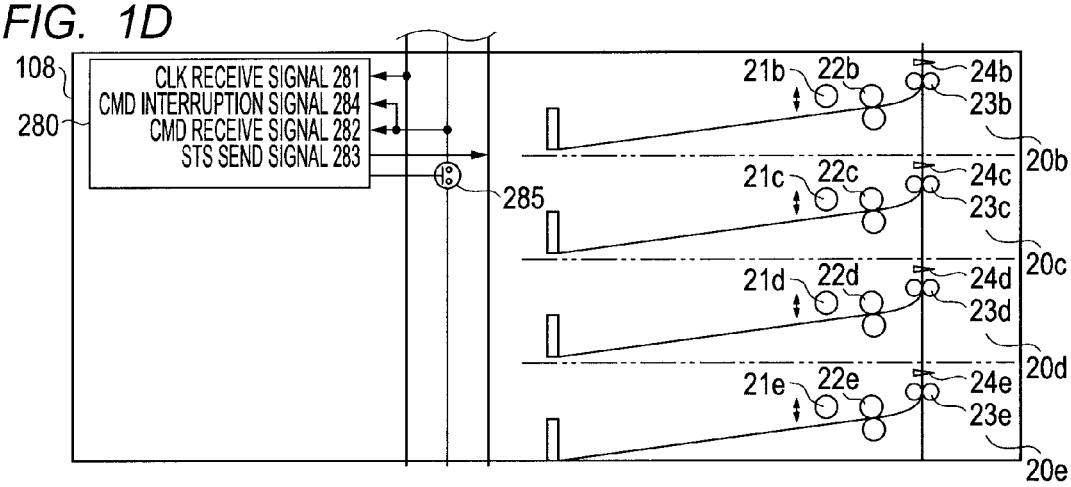
Figure 2A:
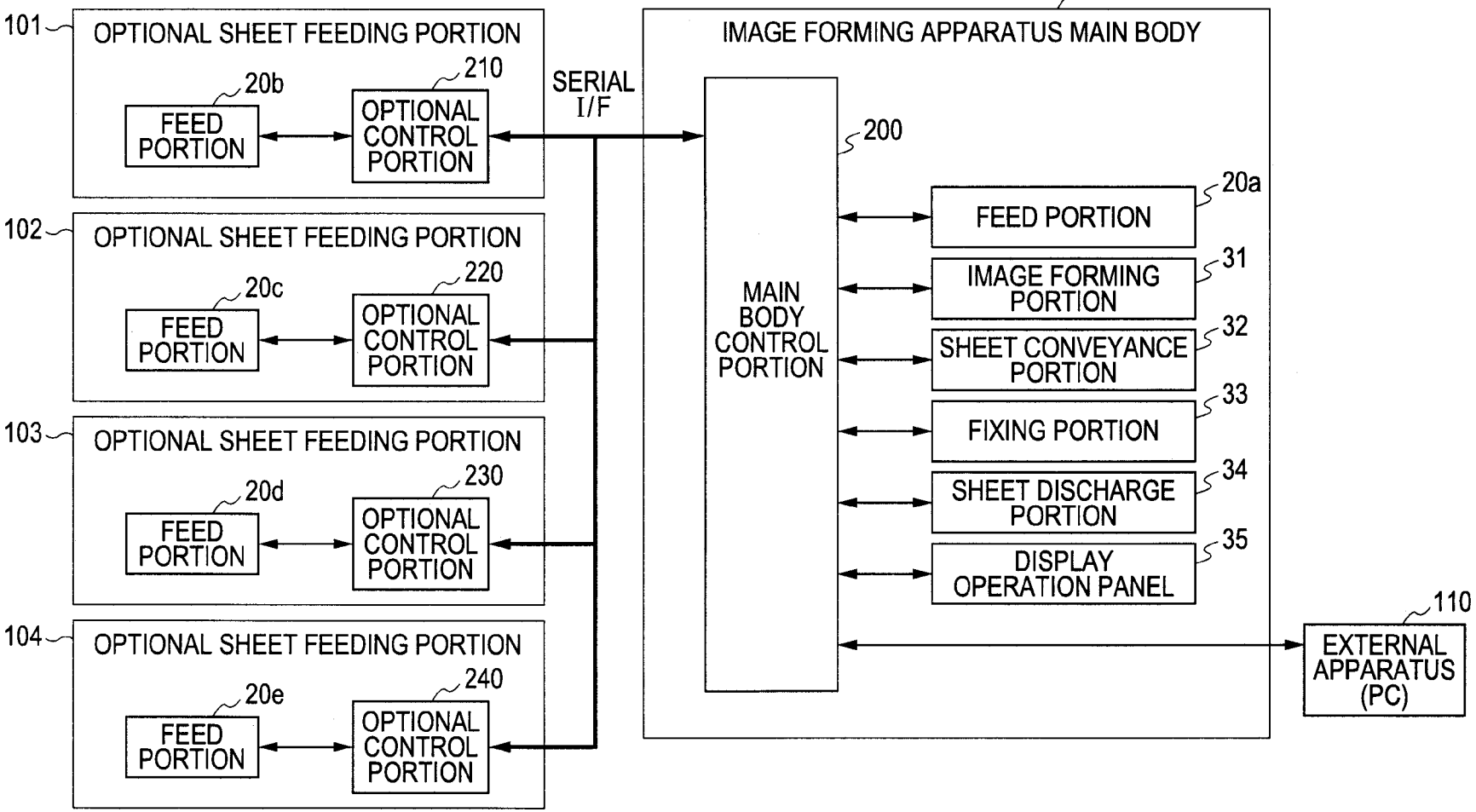
FIGS. 2A and 2B are block diagrams illustrating a functional configuration according to the first embodiment and the second embodiment of the present invention.
Figure 2B:
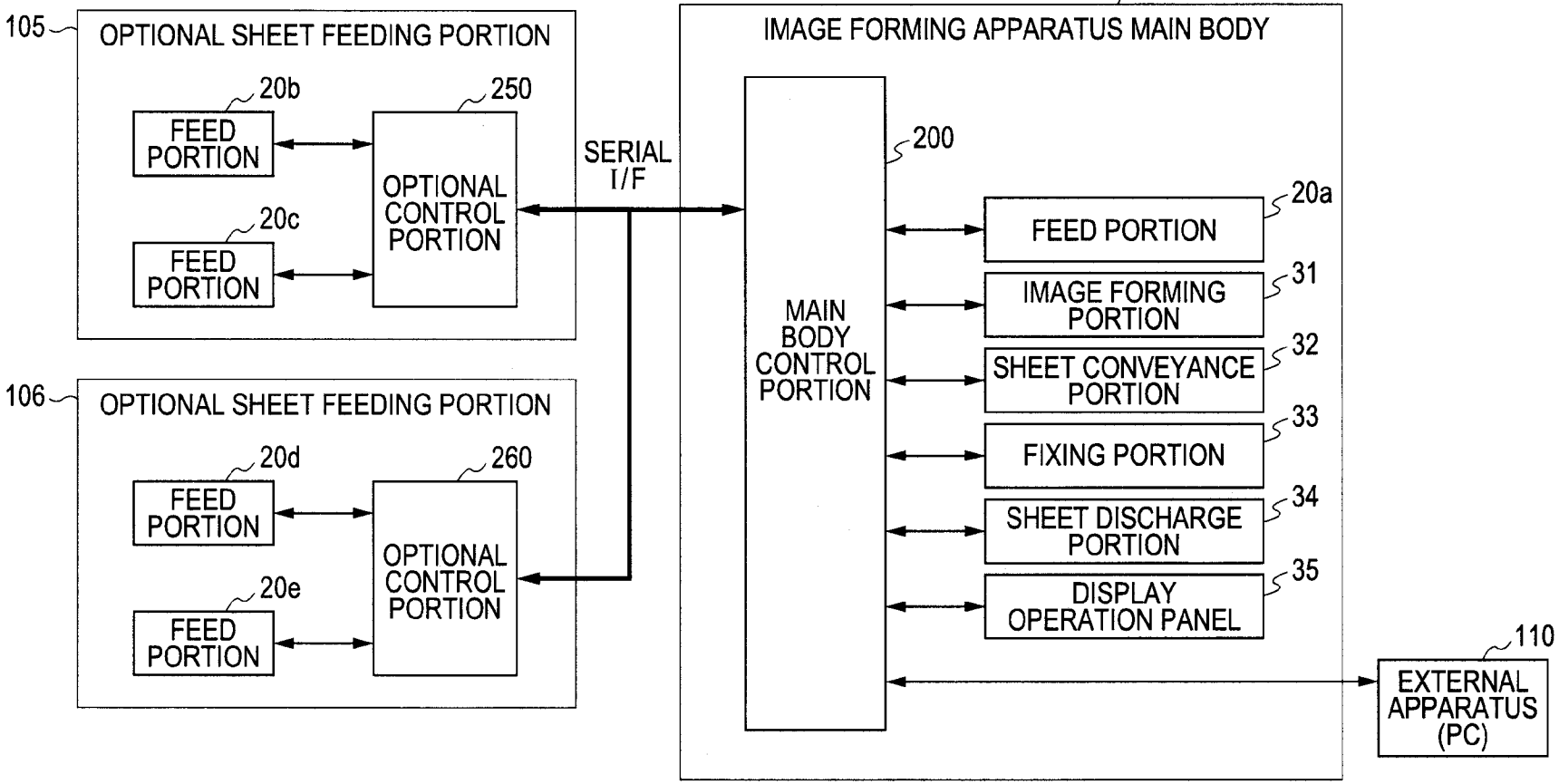
Figure 2C:
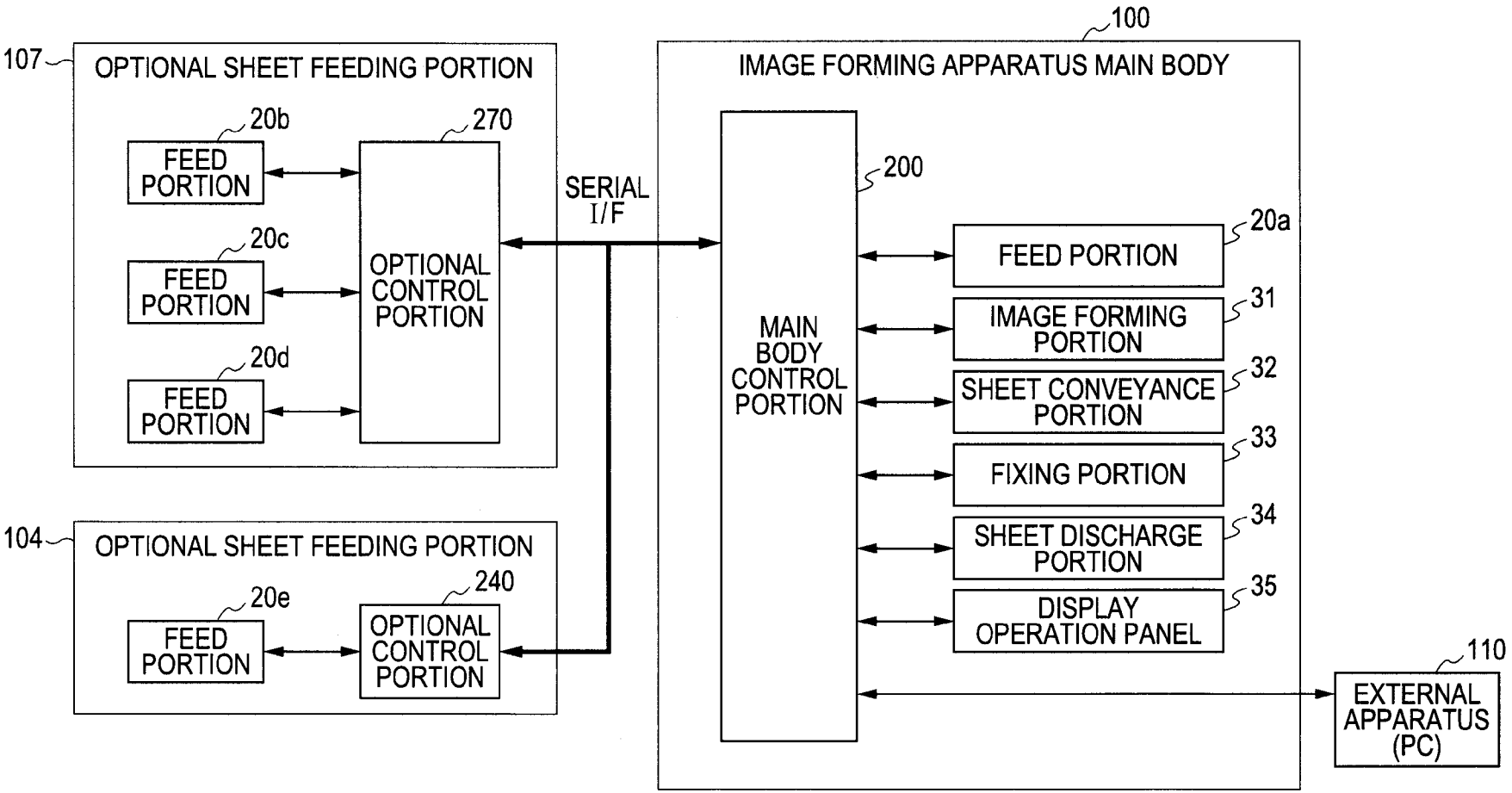
FIGS. 2C and 2D are block diagrams illustrating another functional configuration according to the first embodiment and the second embodiment of the present invention.
Figure 2D:
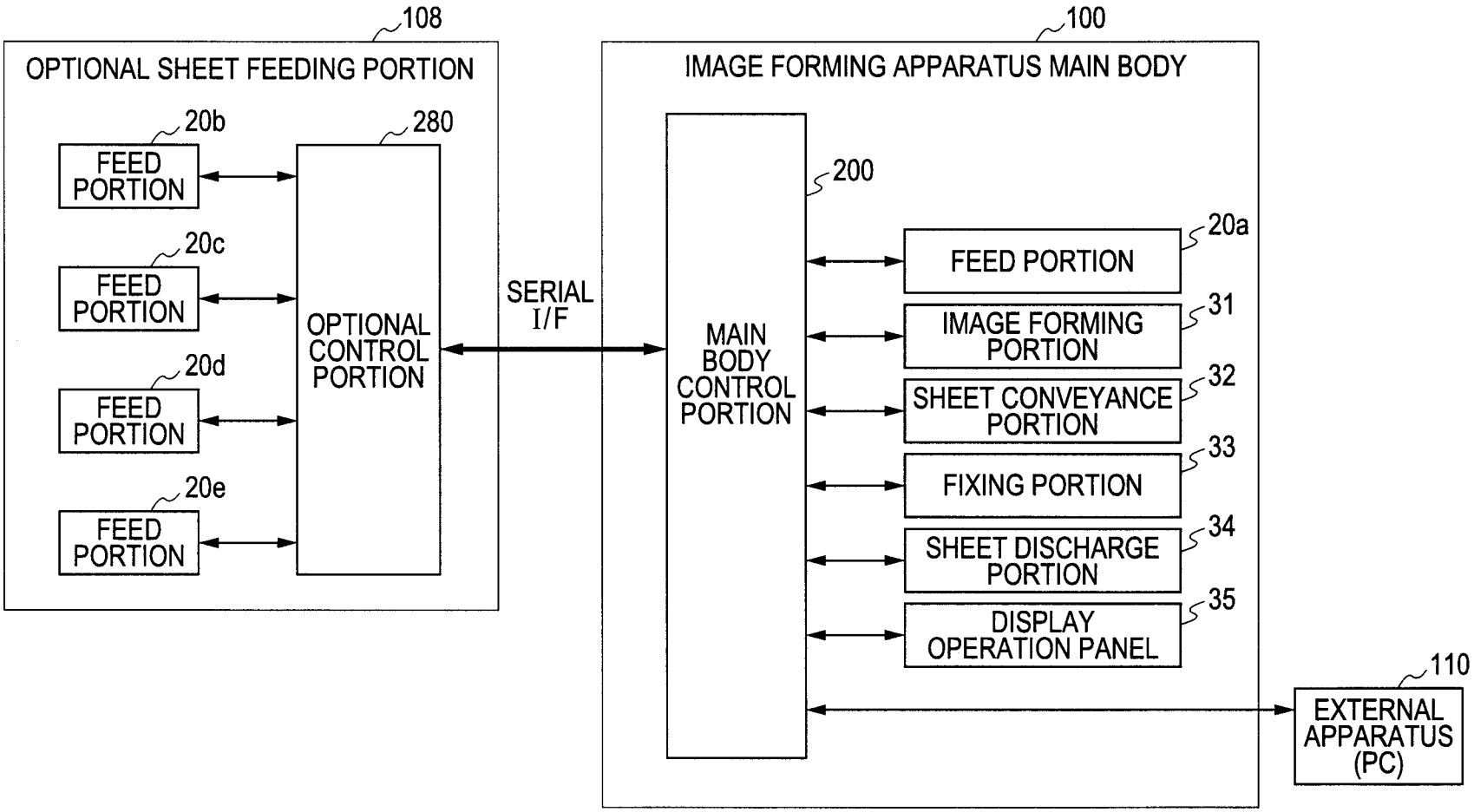

FIGS. 1A to 1D are sectional views that illustrate a configuration of an image forming apparatus to which a first embodiment of the present invention is applied and diagrams that illustrate communication interfaces between an image forming apparatus main body and sheet feeding apparatuses. A color laser printer is set as the image forming apparatus main body, and allows add-on optional sheet feeding apparatuses to be attached thereto. The image forming apparatus main body and optional apparatuses configure the image forming apparatus. FIG. 1A is an example in which optional sheet feeding apparatuses 101, 102, 103, and 104 of a one-layer type having one sheet feeding function are attached by being stacked one upon another. FIG. 1B is an example in which optional sheet feeding apparatuses 105 and 106 of a two-layer type having two sheet feeding functions are attached by being stacked one upon another. FIG. 1C is an example in which an optional sheet feeding apparatus 107 of a three-layer type having three sheet feeding functions and the optional sheet feeding apparatus 104 of the one-layer type are attached by being stacked one upon another. FIG. 1D is an example in which optional sheet feeding apparatuses 108 of a four-layer type having four sheet feeding functions are attached.

First, description is made of overall configurations illustrated in FIGS. 1A to 1D. An image forming apparatus main body 100 includes photosensitive drums 1*a* to 1*d* serving as four image bearing members.

Disposed around each of the photosensitive drums 1*a* to 1*d* along a rotational direction thereof in order are charge means 2*a* to 2*d* for uniformly charging a surface of the photosensitive drum and exposure means 3*a* to 3*d* for forming an electo latent image on the photosensitive drum by applying a laser beam based on image information. Further, they are disposed, developing means 4*a*1 to 4*d*1 and 4*a*2 to 4*d*2 for visualizing an image by causing toner to adhere to the photosensitive drum, transfer members 5*a* to 5*d* for transferring the toner image onto a sheet, and cleaning means 6*a* to 6*d* for removing residual toner on the drum surface. The above-mentioned means and members configure image forming means. Here, the photosensitive drums 1*a* to 1*d*, the charge means 2*a* to 2*d*, the developing means 4*a*1 to 4*d*1 and 4*a*2 to 4*d*2, and the cleaning means 6*a* to 6*d* are integrated into process cartridges 7*a* to 7*d*, respectively. A sheet fed from each of feed portions 20*a* to 20*e* (referred to also as "main body feed portion 20*a* and optional feed portions 20*b* to 20*e*") is conveyed to the image forming means by conveyance means 9 (referred to also as "transfer/conveyor belt 9") formed of a conveyor belt. Toner images of respective colors are sequentially transferred onto the sheet, thereby forming a multicolor image. After that, fixing means 10 heats the sheet to fix the multicolor image, and a pair of discharge rollers 11 discharges the sheet to a discharge tray 12.

Next, description is made of the main body feed portion 20*a* and optional feed portions 20*b* to 20*e*. When sheets are fed from the main body feed portion 20*a* of the image forming apparatus main body, the sheets are separately fed one by one by a cassette pickup roller 21*a* and separation/conveyance rollers 22*a*, and conveyed by conveyance rollers 23*a*. The sheet sensed as a recording sheet by a conveyance sensor 24*a* is conveyed to the conveyance means 9 by registration rollers 8.

The optional sheet feeding apparatuses 101 to 108 include several (at least one) of the optional feed portions 20*b* to 20*e*. The optional sheet feeding apparatuses 101 to 104 of the one-layer type has one feed portion serving as the sheet feeding function. The optional sheet feeding apparatuses 105 and 106 of the two-layer type has two feed portions serving as the sheet feeding functions. The optional sheet feeding apparatus 107 of the three-layer type has three feed portions serving as the sheet feeding functions. The optional sheet feeding apparatus 108 of the four-layer type has four feed portions serving as the sheet feeding functions. When sheets are fed from those optional sheet feeding apparatuses to form an image, the sheets are separately fed one by one by cassette pickup rollers 21*b* to 21*e* and separation/conveyance rollers 22*b* to 22*e* within the optional sheet feeding apparatus. Then, the sheets are conveyed by optional conveyance rollers 23*b* to 23*e*. The sheet sensed as a recording sheet by conveyance sensor 24*b* to 24*e* is conveyed to the conveyance means 9 by the conveyance rollers 23*a* and the registration rollers 8. Although not illustrated, each of the optional sheet feeding apparatuses 101 to 108 also includes a sheet presence/absence sensor for sensing whether or not a recording sheet is stored in the corresponding feed portion.

Hereinafter, an image forming portion 31 of FIGS. 2A to 2D is described. The photosensitive drums 1*a* to 1*d* serving as the image bearing members are each formed by coating an outer peripheral surface of an aluminum cylinder with an organic photo-conductive member layer (OPC). The photosensitive drums 1*a* to 1*d* each have two end portion supported by flanges so as to be free to rotate. By transmitting a driving force to one of the end portions from a driving motor (not shown), the photosensitive drums 1*a* to 1*d* are each driven to rotate counterclockwise with respect to the figures. The charge means 2*a* to 2*d* are each a conductive roller formed to have a roller shape. Each of the charge means 2*a* to 2*d* is abutted against the surface of the corresponding one of the photosensitive drums 1*a* to 1*d* and uniformly charges the surface of the corresponding one of the photosensitive drums 1*a* to 1*d* by applying a charging bias voltage by a power supply (not shown). The exposure means 3*a* to 3*d* each include a polygon mirror. The polygon mirror is irradiated with image light corresponding to the image signal emitted from a laser diode (not shown). The developing means 4*a*1 to 4*d*1 and 4*a*2 to 4*d*2 include: toner containers 4*a*1 to 4*d*1 containing toner of black, cyan, magenta, and yellow colors, respectively; and developing rollers 4*a*2 to 4*d*2 which are adjacent to the surfaces of corresponding photosensitive members. The developing rollers 4*a*2 to 4*d*2 are driven to rotate by driving portions (not shown), and develop images by applying developing bias voltages from developing bias power supplies (not shown).

Further, the transfer members 5*a* to 5*d* are disposed in abutment with an inner surface of the transfer/conveyor belt 9 described later so as to face the four photosensitive drums 1*a* to 1*d*, respectively. The transfer members 5*a* to 5*d* are connected to a transfer bias power supply (not shown). The transfer members 5*a* to 5*d* apply positive charges to a sheet from the transfer/conveyor belt 9. The charges cause negatively charged toner images of the respective colors on the photosensitive drums 1*a* to 1*d* to be sequentially transferred onto the sheet in contact with the photosensitive drums 1*a* to 1*d*, thereby forming a multicolor image.

Hereinafter, a sheet conveyance portion 32 of FIGS. 2A to 2D is described. A sheet fed from each of the feed portions 20*a* to 20*e* is conveyed to an image forming area via the registration rollers 8 and the conveyance means 9. The transfer/conveyor belt serving as a recording medium carrier that forms the conveyance means 9 is stretched and supported by a driving roller 9*a* and driven rollers 9*b* and 9*c*, and is disposed so as to face all the photosensitive drums 1*a* to 1*d*. The transfer/conveyor belt 9 is circulated by the driving roller 9*a* so as to cause a sheet to electrostatically adhere to an outer peripheral surface thereof facing the photosensitive drums 1*a* to 1*d* and bring the sheet into contact with the photosensitive drums 1*a* to 1*d*. The transfer/conveyor belt 9 thus conveys the sheet to a transfer position, in which the toner images on the photosensitive drums 1*a* to 1*d* are transferred onto the sheet. An adhesion roller 9*e* is disposed most upstream of the transfer/conveyor belt 9 to nip the sheet together with the transfer/conveyor belt 9 and cause the sheet to adhere to the transfer/conveyor belt 9. When the sheet is conveyed, a voltage is applied to the adhesion roller 9*e* to generate an electric field between the adhesion roller 9*e* and the driven roller 9*c* that face each other. This causes dielectric polarization between the transfer/conveyor belt and the sheet, thereby generating an electrostatic adhesion force therebetween.

Hereinafter, a fixing portion 33 of FIGS. 2A to 2D is described. The fixing means 10 fixes the toner image by applying heat and pressure to the image formed on the sheet. The fixing means 10 includes a fixing belt 10*a* and an elastic pressure roller 10*b*. The elastic pressure roller 10*b* is in abutment with the fixing belt 10*a*, and forms a fixing nip portion having a predetermined width together with a belt guide member at a predetermined pressure. After the temperature of the fixing nip portion has risen to a predetermined value and while the fixing nip portion maintains the predetermined temperature, the sheet that has been conveyed from the image forming portion and bears an unfixed toner image is introduced into the fixing nip portion between the fixing belt 10*a* and the elastic pressure roller 10*b* with its image surface facing up, that is, facing a fixing belt surface. At the fixing nip portion, the image surface comes into tight contact with an outer surface of the fixing belt 10*a*. The sheet is nipped at the fixing nip portion and conveyed along with the fixing belt 10*a*. While the sheet is nipped at the fixing nip portion and conveyed along with the fixing belt 10*a*, the sheet is heated by the fixing belt 10*a* to thereby heat and fix the unfixed toner image onto the sheet.

Hereinafter, a discharge portion 34 of FIGS. 2A to 2D is described. The sheets conveyed from the fixing means 10 are discharged onto the discharge tray 12 and stacked thereon.

Communication interfaces between the image forming apparatus main body and the optional sheet feeding apparatuses are described later after block diagrams of FIGS. 2A to 2D are described first.

FIGS. 2A to 2D are block diagrams illustrating functional configurations of the image forming apparatus according to the first embodiment of the present invention. FIGS. 2A, 2B, 2C, and 2D correspond to FIGS. 1A, 1B, 1C, and 1D, respectively. The image forming apparatus main body 100 includes a main body control portion 200 that is formed of, specifically, a microcomputer. The main body control portion 200 receives print image data transmitted from an external apparatus 110 such as a PC via an interface, and transmits a state of the image forming apparatus thereto.

The main body control portion 200 performs feed control of a recording sheet on the feed portion 20*a* to feed the recording sheet, and controls the image forming portion 31 in terms of an electrophotographic process including laser driving and high-voltage driving to form an image. The main body control portion 200 performs conveyance control on the conveyance portion 32 to convey the recording sheet to the image forming portion. The main body control portion 200 controls the fixing portion 33 in terms of the fixing temperature to heat and fix the toner image on the recording sheet. The main body control portion 200 controls the discharge portion 34 in terms of discharge/conveyance of the recording sheet to discharge the printed recording sheet.

The image forming apparatus main body 100 further includes a display operation panel 35 connected to the main body control portion 200. The display operation panel 35 receives an operation from a user, and displays a message to the user. The optional sheet feeding apparatuses 101 to 108 include optional control portions 210, 220, 230, 240, 250, 260, 270, and 280, respectively, which are each formed of, specifically, a microcomputer. While communicating with the main body control portion 200 via a serial interface, the optional control portion performs the feed control of a recording sheet on each of the above-mentioned feed portions 20*b* to 20*e* to feed the recording sheet, and transfers the recording sheet to the image forming apparatus main body.

Returning to FIGS. 1A to 1D, description is made of the communication interfaces between the image forming apparatus main body and the optional sheet feeding apparatuses.

In FIG. 1A, the optional sheet feeding apparatuses 101 to 104 include the optional control portions 210, 220, 230, and 240 and switches 215, 225, 235, and 245, respectively. The main body control portion 200 of the image forming apparatus main body 100 is cascade (series)-connected to the optional control portions 210, 220, 230, and 240 of the optional sheet feeding apparatuses. Interface signals are as follows. As clock signals (hereinafter, referred to as "CLK signals") for establishing synchronization of communication, a CLK send signal 201 output by the main body control portion 200 is connected to CLK receive signals 211, 221, 231, and 241 received by the optional control portions 210, 220, 230, and 240, respectively. Further, as command signals (hereinafter, referred to also as "CMD signals") transmitted (as response) from the image forming apparatus main body to the optional sheet feeding apparatuses, a CMD send signal 202 output by the main body control portion 200 is connected to CMD receive signals 212, 222, 232, and 242 received by the optional control portions 210, 220, 230, and 240, respectively. Further, as status signals (hereinafter, referred to as "STS signals") transmitted from the optional sheet feeding apparatuses to the image forming apparatus main body, a STS receive signal 203 received by the main body control portion 200 is connected to STS send signals 213, 223, 233, and 243 output by the optional control portions 210, 220, 230, and 240, respectively. The CMD receive signals 212, 222, 232, and 242 are split in the optional sheet feeding apparatuses, and input to interruption ports of the optional control portions 210, 220, 230, and 240 as command interruption signals (hereinafter, referred to as "CMD interruption signals") 214, 224, 234, and 244, respectively. Such a setting is performed as to generate an interruption when the command interruption signal changes to a Low level. The switches 215, 225, 235, and 245 can switch connection states (connected and disconnected states) of the CMD signals of the cascade-connected optional control portions 210, 220, 230, and 240, respectively.

In FIG. 1B, the optional sheet feeding apparatuses 105 to 106 include the optional control portions 250 and 260, and switches 255 and 256, respectively. The main body control portion 200 of the image forming apparatus main body 100 is cascade-connected to the optional control portions 250 and 260 of the optional sheet feeding apparatuses. Interface signals are as follows. As CLK signals, the CLK send signal 201 output by the main body control portion 200 is connected to CLK receive signals 251 and 261 received by the optional control portions 250 and 260, respectively. Further, as CMD signals, the CMD send signal 202 output by the main body control portion 200 is connected to CMD receive signals 252 and 262 received by the optional control portions 250 and 260, respectively. Further, as STS signals, the STS receive signal 203 received by the main body control portion 200 is connected to STS send signals 253 and 263 output by the optional control portions 250 and 260, respectively.

The CMD receive signals 252 and 262 are split in the optional sheet feeding apparatuses, and input to interruption ports of the optional control portions 250 and 260 as CMD interruption signals 254 and 264, respectively. Such a setting is performed as to generate an interruption when the command interruption signal changes to a Low level. Further, the switches 255 and 256 can switch connection states (connected and disconnected states) of the CMD signals of the cascade-connected optional control portions 250 and 260, respectively.

In FIG. 1C, the optional sheet feeding apparatuses 107 and 104 include the optional control portions 270 and 240 and switches 275 and 245, respectively. The main body control portion 200 of the image forming apparatus main body 100 is cascade-connected to the optional control portions 270 and 240 of the optional sheet feeding apparatuses. Interface signals are as follows. As CLK signals, the CLK send signal 201 output by the main body control portion 200 is connected to CLK receive signals 271 and 241 received by the optional control portions 270 and 240, respectively. Further, as CMD signals, the CMD send signal 202 output by the main body control portion 200 is connected to CMD receive signals 272 and 242 received by the optional control portions 270 and 240, respectively. Further, as STS signals, the STS receive signal 203 received by the main body control portion 200 is connected to STS send signals 273 and 243 output by the optional control portions 270 and 240, respectively. The CMD receive signals 272 and 242 are split in the optional sheet feeding apparatuses, and input to interruption ports of the optional control portions 270 and 240 as CMD interruption signals 274 and 244, respectively. Such a setting is performed as to generate an interruption when the command interruption signal changes to a Low level. Further, the switches 275 and 245 can switch connection states (connected and disconnected states) of the CMD signals of the cascade-connected optional control portions 270 and 240, respectively.

In FIG. 1D, the optional sheet feeding apparatus 108 includes the optional control portion 280 and the switch 285. The main body control portion 200 of the image forming apparatus main body 100 is connected to the optional control portions 280 of the optional sheet feeding apparatus. Interface signals are as follows. As CLK signals, the CLK send signal 201 output by the main body control portion 200 is connected to a CLK receive signals 281 received by the optional control portions 280. Further, as CMD signals, the CMD send signal 202 output by the main body control portion 200 is connected to a CMD receive signals 282 received by the optional control portions 280. Further, as STS signals, an STS receive signal 203 received by the main body control portion 200 is connected to an STS send signal 283 output by the optional control portions 280.

The CMD receive signal 282 is split in the optional sheet feeding apparatus, and input to a interruption port of the optional control portion 280 as a CMD interruption signal 284. Such a setting is performed as to generate an interruption when the command interruption signal changes to a Low level. The switch 285 can switch connection states (connected and disconnected states) of a CMD signal of another cascade-connected optional apparatus.

First, while turning on/off the switches, the CMD signals of the cascade-connected optional sheet feeding apparatuses are sequentially connected, and individual ID numbers specific for sheet feeding functions are added to the sheet feeding functions (feed portions) of the respective optional sheet feeding apparatuses. An ID number registration method is described later in detail with reference to the flowchart.

In the present invention, ID numbers are registered on a sheet feeding function (feed portion) basis. Therefore, no matter which optional sheet feeding apparatus is connected in FIGS. 1A to 1D, ID numbers are assigned on a sheet feeding function basis as illustrated in Table 1. The main body control portion 200 of the image forming apparatus main body 100 can perform sheet feeding/conveyance control while communicating with the optional control portion based on the ID numbers assigned on a sheet feeding function (feed portion) basis irrespective of the types (one- to four-layer types and various combinations thereof) of the optional sheet feeding apparatus.

TABLE 1

| | ID = 0 (Broad cast) | ID = 1 | ID = 2 | ID = 3 | ID = 4 | ID = 5 | ID = 6 (Group cast) | ID = 7 (Group cast) |
|---|---|---|---|---|---|---|---|---|
| Optional sheet feeding function 1(20a)(Id number 1) | Object | Object | | | | | Object | Object |
| Optional sheet feeding function 2(20b)(Id number 2) | Object | | Object | | | | Object | Object |
| Optional sheet feeding function 3(20c)(Id number 3) | Object | | | Object | | | | Object |
| Optional sheet feeding function 4(20d)(Id number 4) | Object | | | | Object | | | |

The object of the case, ID number=1 is only a sheet feeding function 1, the object of the case, ID number=2, which is only a sheet feeding function 2, the object of the case, ID number=3, which is only a sheet feeding function 3, and the object of the case, ID number=4, which is only a sheet feeding function 4 are specific function communications. The case of ID number=0 is a broadcast for all sheet feeding functions. The case of ID number=6 is a groupcast for the sheet feeding function 1 and the sheet feeding function 2. And, the case of ID number=7 is a broadcast whose object is for the sheet feeding function 1, the sheet feeding function 2, and the sheet feeding function 3. In the present invention, the ID numbers are assigned on an optional function basis. Therefore, even when multiple sheet feeding functions exist within the optional sheet feeding apparatus, synchronous control is enabled between partial sheet feeding functions within an apparatus and partial sheet feeding functions within another apparatus.

In a case where a sheet is fed and conveyed from the sheet feeding function 4 located in the lowest layer, the sheet is conveyed to the image forming apparatus main body via all the sheet feeding functions 1 to 4. Therefore, in order to prevent pulling or thrusting from occurring over the sheet feeding functions, the broadcast of ID=0 is used so as to enable synchronous control of the sheet feeding functions 1 to 4 in terms of motor driving stopping. Further, in a case where a sheet is fed and conveyed from the sheet feeding function 3, the groupcast of ID=7 is used so as to enable synchronous control of the sheet feeding functions 1 to 3. In a case where a sheet is fed and conveyed from the sheet feeding function 2, the groupcast of ID=6 is used so as to enable synchronous control of the sheet feeding functions 1 and 2. For example, in a case where a sheet is to be fed from the sheet feeding function 3 (feed portion 20*d*), it is possible to synchronously drive the feed portions 20*b* (ID number=1) and 20*c* (ID number=2) of the optional sheet feeding apparatus 105 and the feed portions 20*d* (ID number=3) of the optional sheet feeding apparatus 106.

Note that ID number=5 is used for the following case. That is, assuming that another optional apparatus is attached in the lowermost position in FIGS. 1A to 1D and 2A to 2D, an exchange is performed for ID registration of a fifth sheet feeding function, and the ID is registered for the fifth sheet feeding function, based on which an excess error is judged. This example presupposes that each of the optional sheet feeding apparatuses operates with the power supply from the image forming apparatus main body, and that the image forming apparatus main body has a power capacity that guarantees the operations of up to four sheet feeding functions while the power capacity becomes short in the operations of five or more sheet feeding functions.

FIGS. 3A-1 to 3D-2 are communication timing charts for the image forming apparatus illustrating the first embodiment of the present invention. FIGS. 3A-1 to 3D-2 correspond to FIGS. 1A and 2A, 1B and 2B, 1C and 2C, and 1D and 2D, respectively.

Figures 1, 3A:
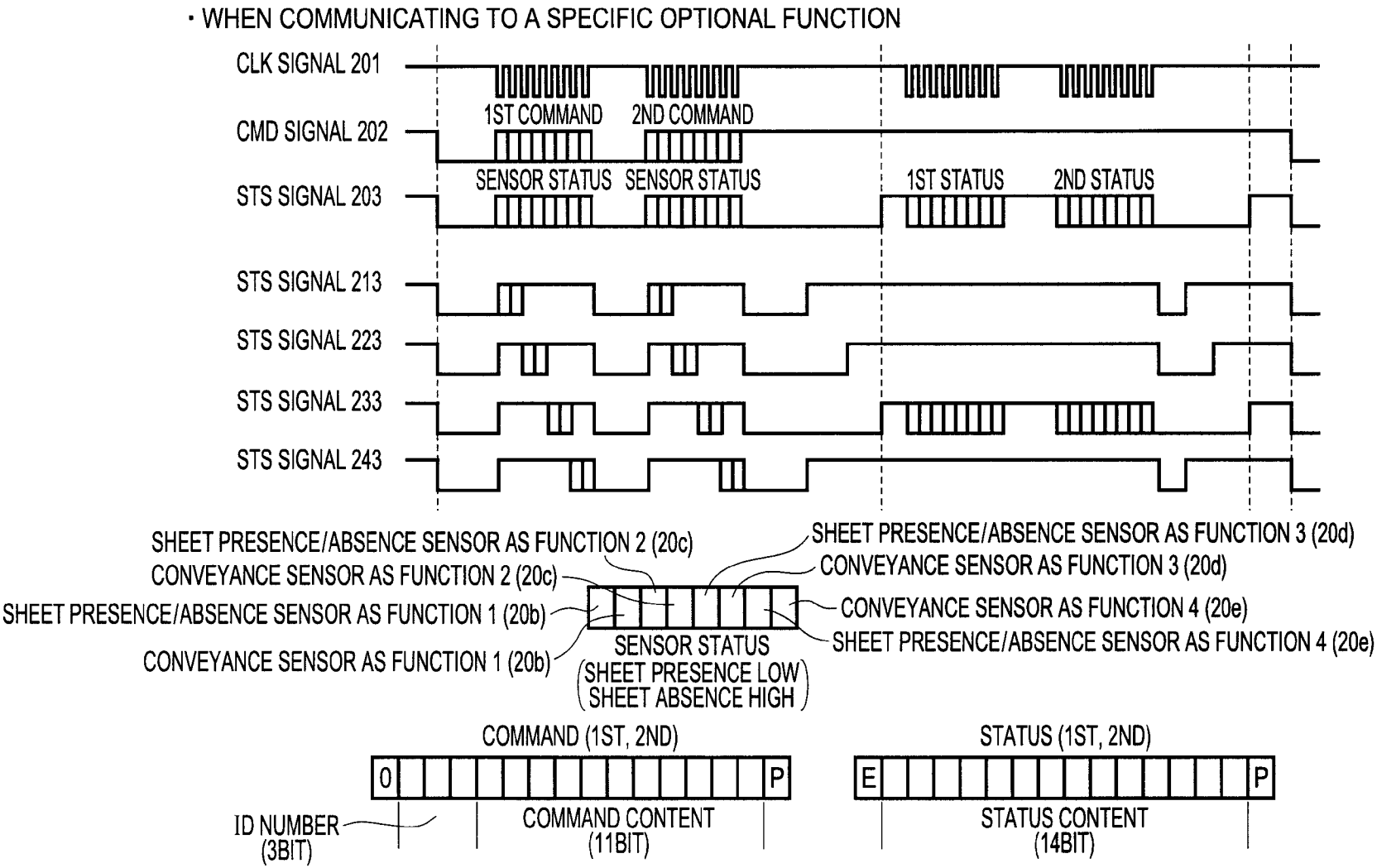
FIGS. 3A-1 and 3A-2 are first communication timing charts according to the first embodiment and the second embodiment of the present invention.
Figures 2, 3A:
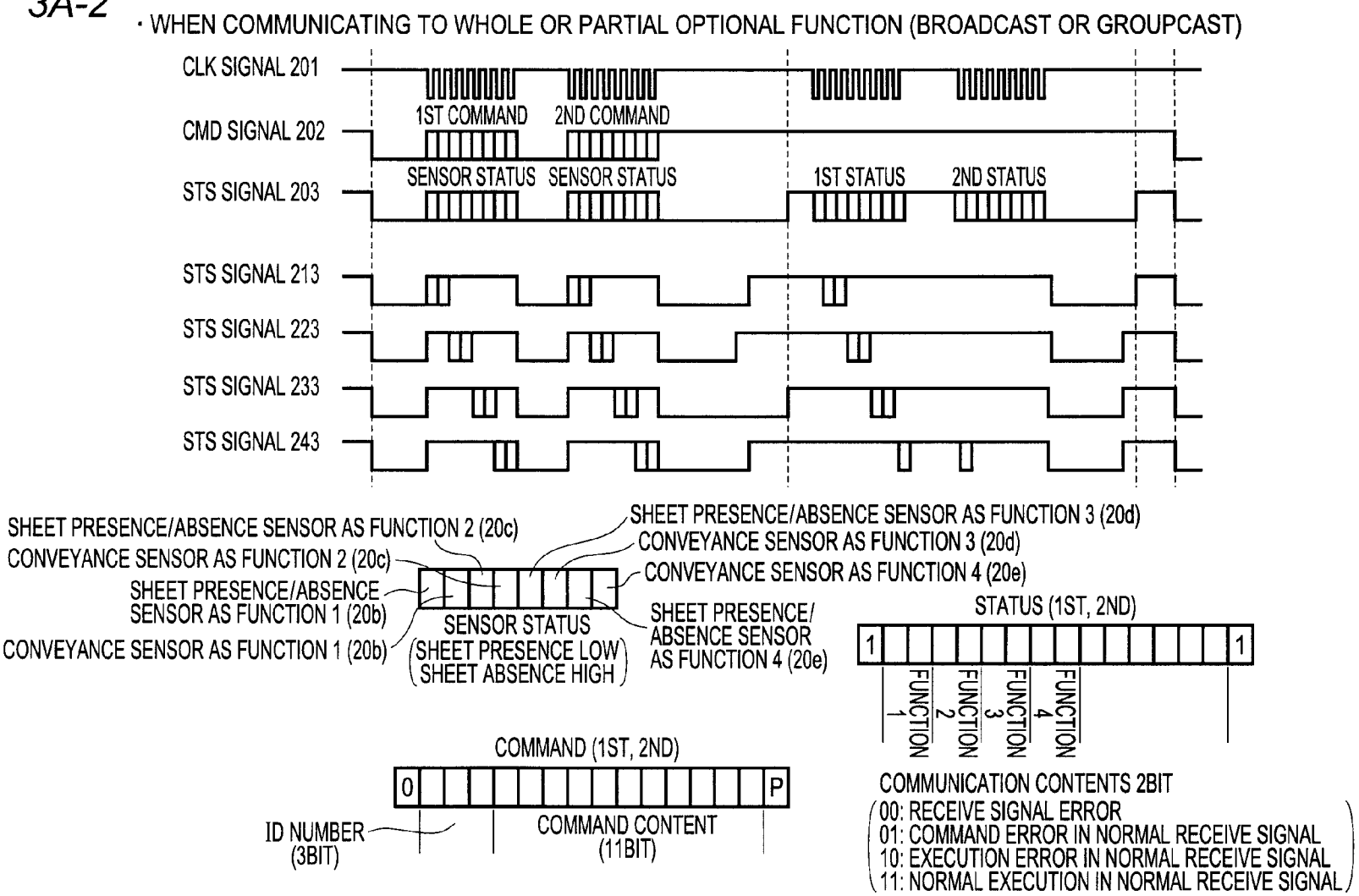

The upper charts of FIGS. 3A-1 and 3A-2 are timing charts for a case of communicating individually to a specific optional function. Before starting communication, the optional sheet feeding apparatuses 101 to 104 permit interruptions by the CMD interruption signals 214, 224, 234, and 244, respectively. In this embodiment, an interruption is set to be allowed at Low level. The main body control portion 200 of the image forming apparatus main body 100 starts the communication by changing the CMD send signal 202 to Low. Interruptions occur by the CMD interruption signals 214, 224, 234, and 244, and hence the optional sheet feeding apparatuses 101 to 104 judge that the communication has started, respectively, and prepare for transmission of sensor statuses and reception of commands in order to return information on their conveyance sensors and sheet presence/absence sensors. Then, the optional sheet feeding apparatuses 101 to 104 change the STS signals 213, 223, 233, and 243 to Low level.

The main body control portion 200 sends command data by the CMD signal in synchronization with the CLK signal, while receiving the sensor information from the optional apparatuses as status data by the STS signals. Simultaneously, the optional sheet feeding apparatuses receive the command data by the CMD signal in synchronization with the CLK signal, while transmitting the status data by the STS signals. In this embodiment, as 8-bit communication, command data and status data are each set to be one data item in two times of communication. The command data of 16 bits includes the ID number, command content, and a parity bit P as illustrated in the figures. When simultaneous transmission/reception of 8 bits have been completed twice, the optional sheet feeding apparatus checks the parity, and then judges whether or not the ID number added to the command data matches the ID of the sheet feeding function existing in the optional sheet feeding apparatus itself (hereinafter, referred to as "currently owned sheet feeding function"). In the example of this timing chart, the command including ID number=3 targets the optional sheet feeding function 3 (feed portion 20*d*). The remaining untargeted optional apparatuses 101, 102, and 104 judge that the ID does not match the ID of the currently owned sheet feeding function, prepare their status data at FFh (with all bits set at High), prepare for the next status transmission, and change the STS signals 213, 223, and 243 to High, respectively.

The target optional apparatus 103 judges that the added ID matches the ID of the currently owned sheet feeding function 3, and judges that the received command data is addressed to the sheet feeding function 3. Then, the optional apparatus 103 analyzes the command content to understand the meaning of the command, prepares status data to return in response to the command, prepares for transmission of the status, and changes the STS signal 233 to High. As illustrated in the figure, the status data includes an error bit E representing the presence/absence of an error, a 14-bit status content, and a parity bit P.

The optional apparatus 103 performs command analysis and status creation, and hence delays in changing the STS signal to High, compared to the untargeted optional apparatuses. The STS signal is wired-OR-connected for low-true. When the STS signals 213, 223, 233, and 243 of all the optional sheet feeding apparatuses change to High, the STS receive signal 203 also changes to High. As a result, after confirming that the STS receive signal 203 has changed to High, the main body control portion 200 receives the status data by the STS signal in synchronization with the CLK signal. The optional sheet feeding apparatuses 101 to 104 transmit the status data by the STS signals 213, 223, 233, and 243, respectively, in synchronization with the CLK signal. As the wired-OR-connected STS receive signal 203, the main body control portion 200 receives the same data as the status data of the optional sheet feeding apparatus 103, and analyzes the status data.

After ending the status transmission, the optional apparatuses 101 to 104 change the STS signals 213, 223, 233, and 243, respectively, to Low, and upon completion of preparation for the next communication, change the STS signals to High. The optional apparatus 103 subjected to the command sometimes executes a received command. In this case, the optional apparatus 103 delays in preparing for the next communication and changing the STS signal to High in comparison with the untargeted apparatuses. After confirming that the STS receive signal 203 has changed to High for all the optional apparatuses, the main body control portion 200 shifts to the next communication.

The lower charts of FIGS. 3A-1 and 3A-2 are communication timing charts of broadcast communication or groupcast communication. "ID number=0" added to a command is a broadcast ID specially targeting all the optional functions. Upon reception of a command with ID=0, all the optional apparatuses judge that the command is addressed to the currently owned optional function, and analyze and execute the command. "ID numbers=6 and 7" are broadcast IDs specially targeting partial optional functions. Upon reception of a command with ID=6, the optional apparatus judges that the command is addressed to the optional function thereof determined to have one of IDs=1 and 2. Upon reception of a command with ID=7, the optional apparatus judges that the command is addressed to the optional function thereof determined to have one of IDs=1 to 3. If the command is addressed to the corresponding optional function, the optional apparatus analyzes and executes the command.

A return status to the main body control portion 200 is different from that in the upper chart. Each of the optional sheet feeding apparatuses returns a receive signal error indicating that the command could not be received normally, an incompatible command error indicating that the command was received, an execution error indicating that the command was received and was compatible while no execution condition is satisfied, or a normal state indicating that the command was received and can be executed. That is, 2-bit-basis notification information is returned to a predetermined position as the status data. For the untargeted optional sheet feeding function, "1" as High is returned to a predetermined 2-bit-basis position. The optional apparatus having the targeted optional function executes the command for the targeted optional function, and hence such an optional apparatus take a long time until the preparation for the next communication is completed and the STS signal is changed to High.

Figures 1, 3B:
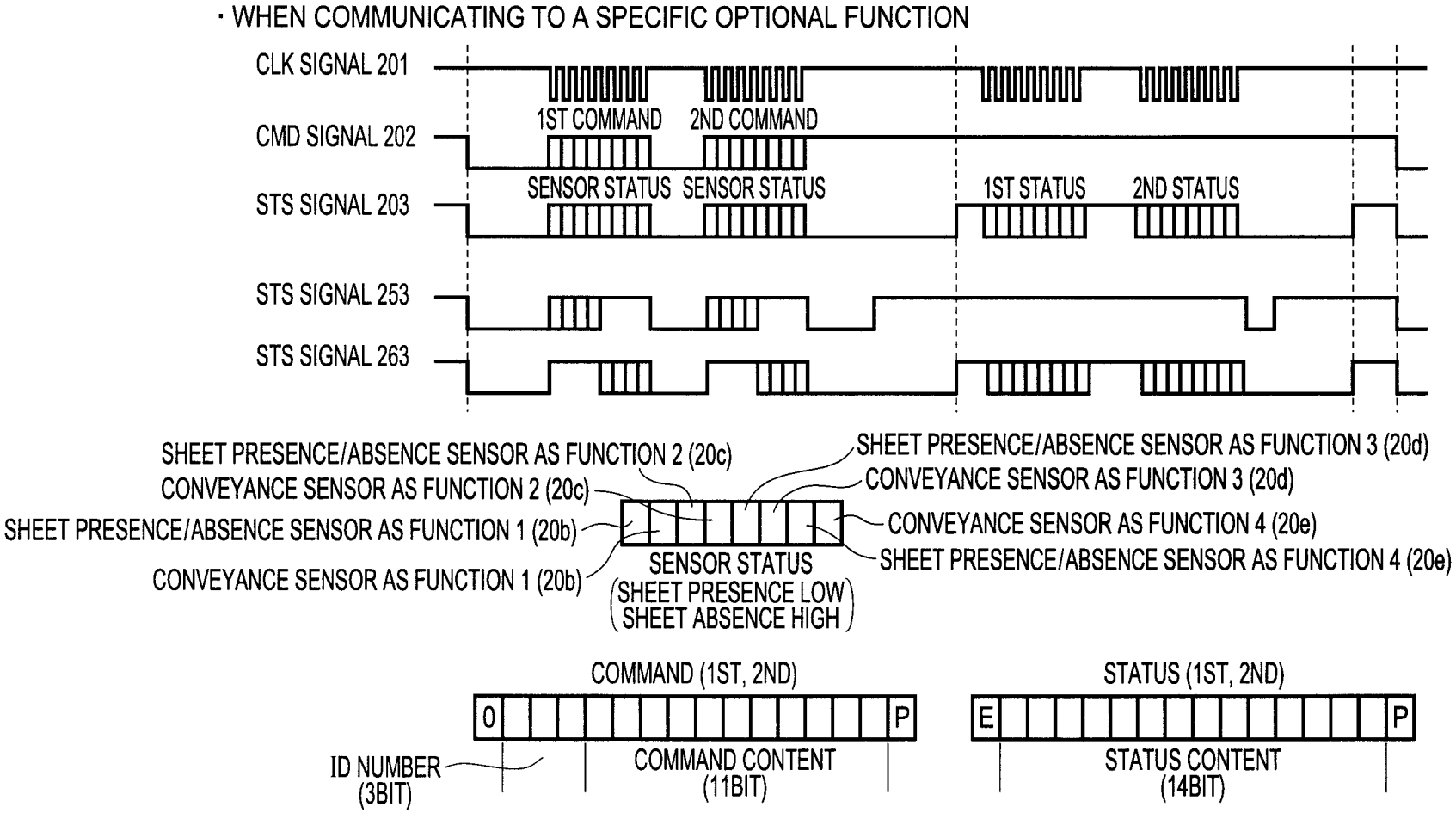
Figures 2, 3B:
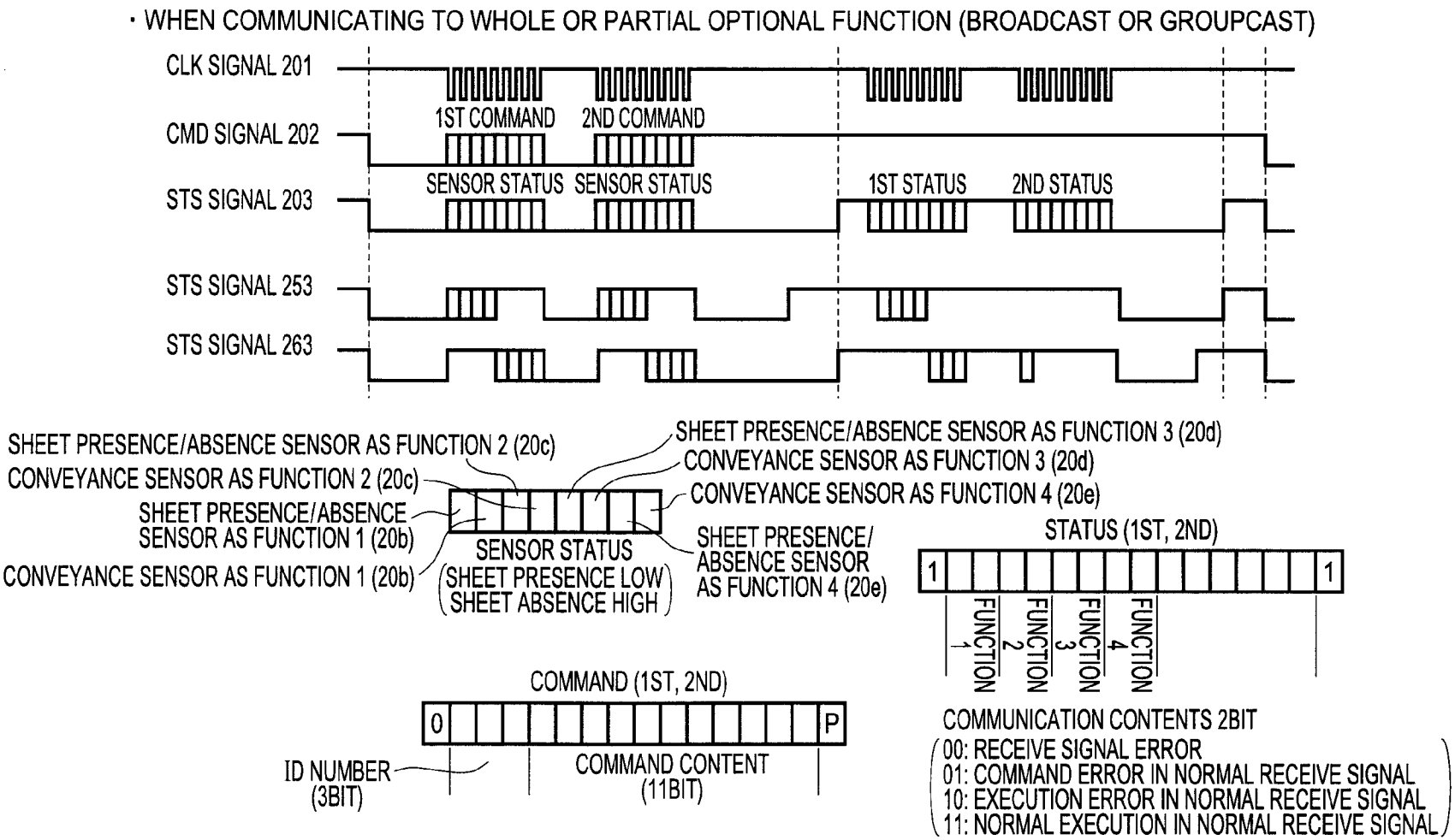

FIGS. 3B-1 and 3B-2 illustrate the case of the manner that two optional sheet feeding apparatuses of the two-layer type are stacked one upon another. The optional control portion 250 of the optional apparatus 105 has two optional functions (sheet feeding function 1=feed portion 20*b* of ID=1 and sheet feeding function 2=feed portion 20*c* of ID=2). Further, the optional control portion 260 of the optional apparatus 106 has two optional functions (sheet feeding function 3=feed portion 20*d* of ID=3 and sheet feeding function 4=feed portion 20*e* of ID=4). Therefore, the optional control portion 250 analyzes the command by separately using IDs=1 and 2 of the existing optional functions, while returning the sensor information, the status contents, and the notification contents regarding both the optional functions by the STS signal 253. In the same manner, the optional control portion 260 analyzes the command by separately using IDs=3 and 4 of the existing optional functions, while returning the sensor information, the status contents, and the notification contents regarding both the optional functions by the STS signal 263.

Figures 1, 3C:
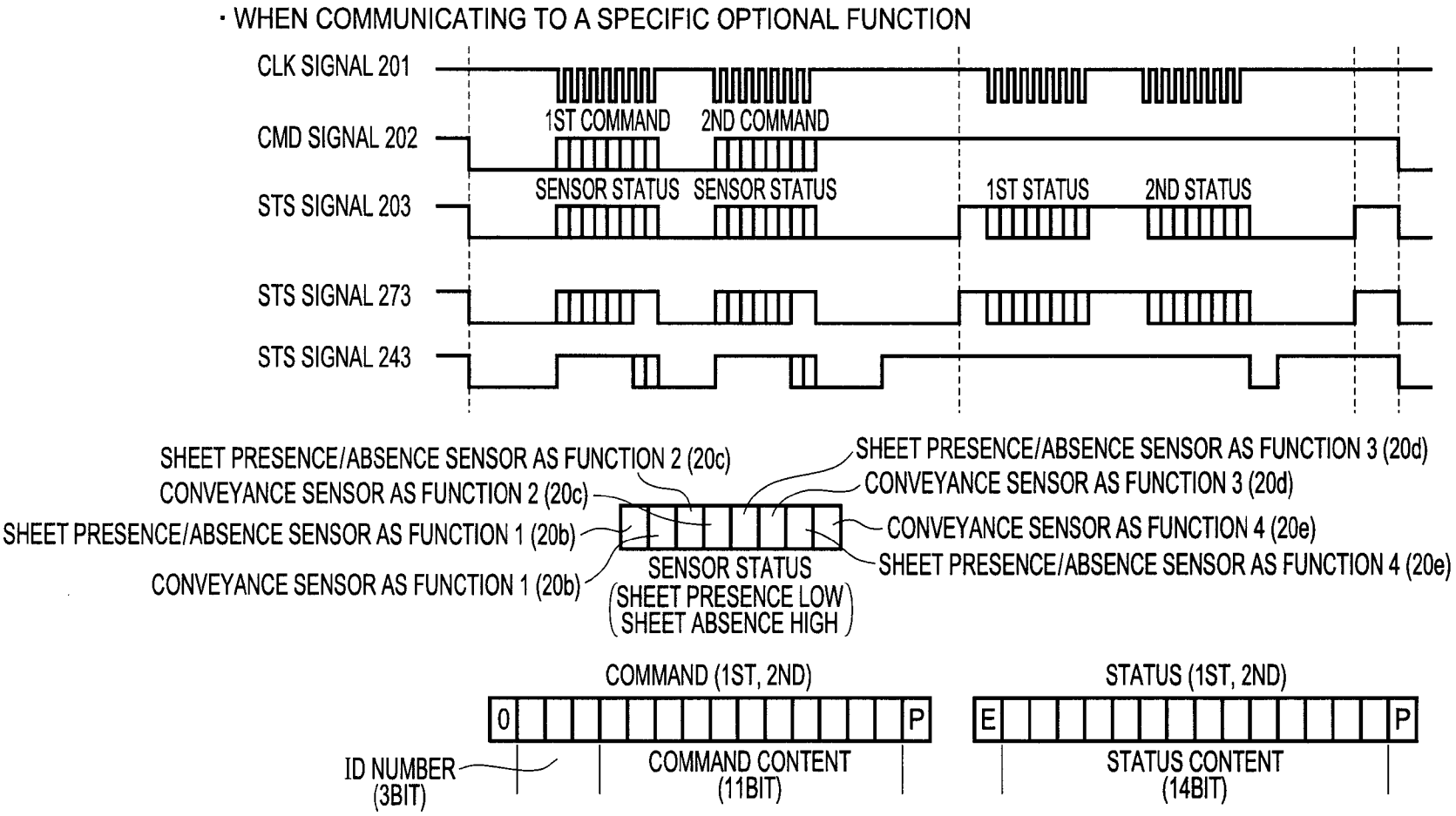
Figures 2, 3C:
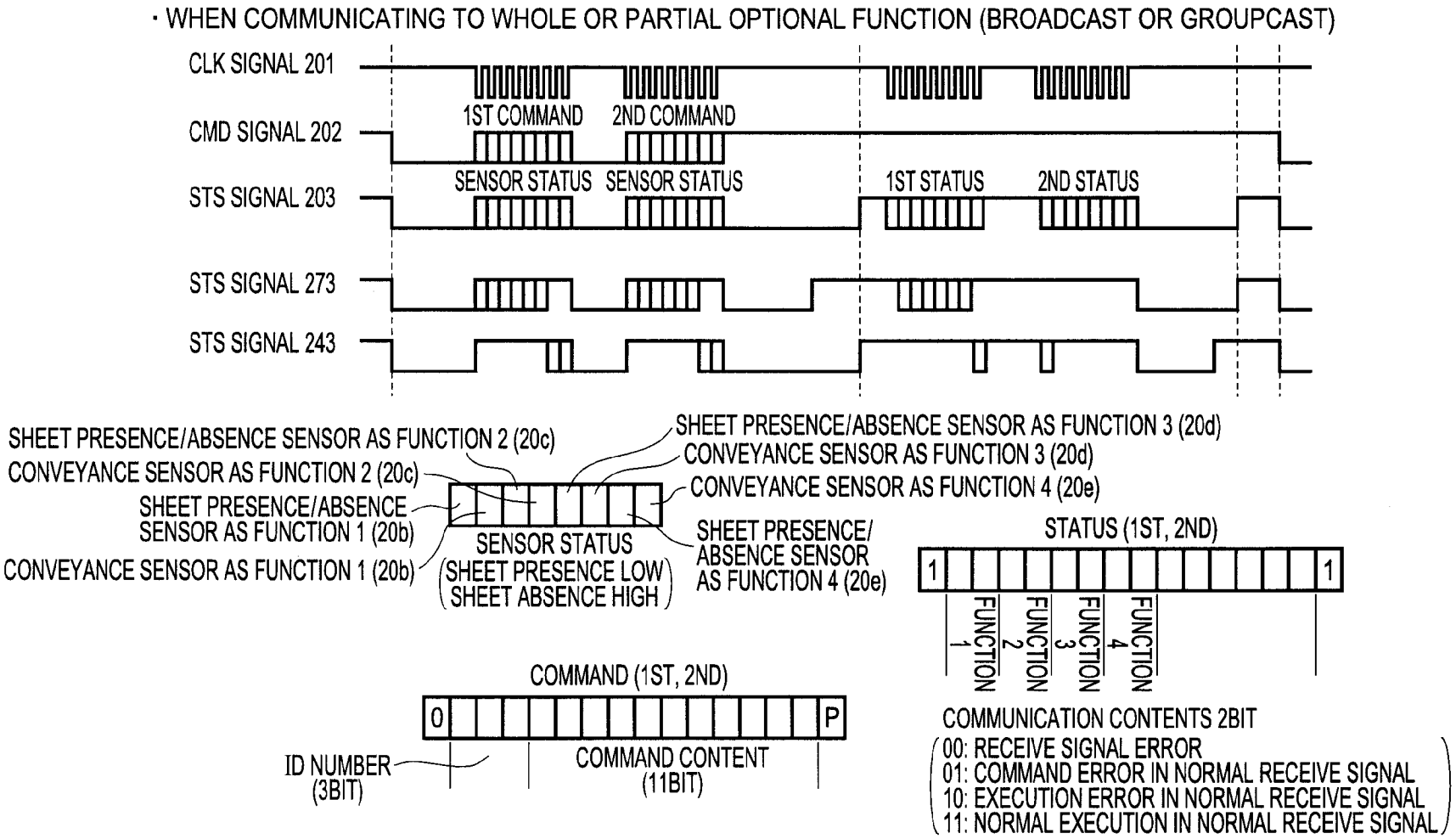

FIGS. 3C-1 and 3C-2 illustrate the case of the manner that the optional sheet feeding apparatus 107 of the three-layer type and the optional sheet feeding apparatus 104 of the one-layer type are stacked one upon another. The optional control portion 270 of the optional apparatus 107 has three optional functions (sheet feeding function 1=feed portion 20*b* of ID=1, sheet feeding function 2=feed portion 20*c* of ID=2, and sheet feeding function 3=feed portion 20*d* of ID=3). Further, the optional control portion 240 of the optional apparatus 104 has one optional function (sheet feeding function 4=feed portion 20*e* of ID=4). Therefore, the optional control portion 270 analyzes the command by separately using IDs=1, 2 and 3 of the existing optional functions, while returning the sensor information, the status contents, and the notification contents regarding the three optional functions by the STS signal 273.

Figures 1, 3D:
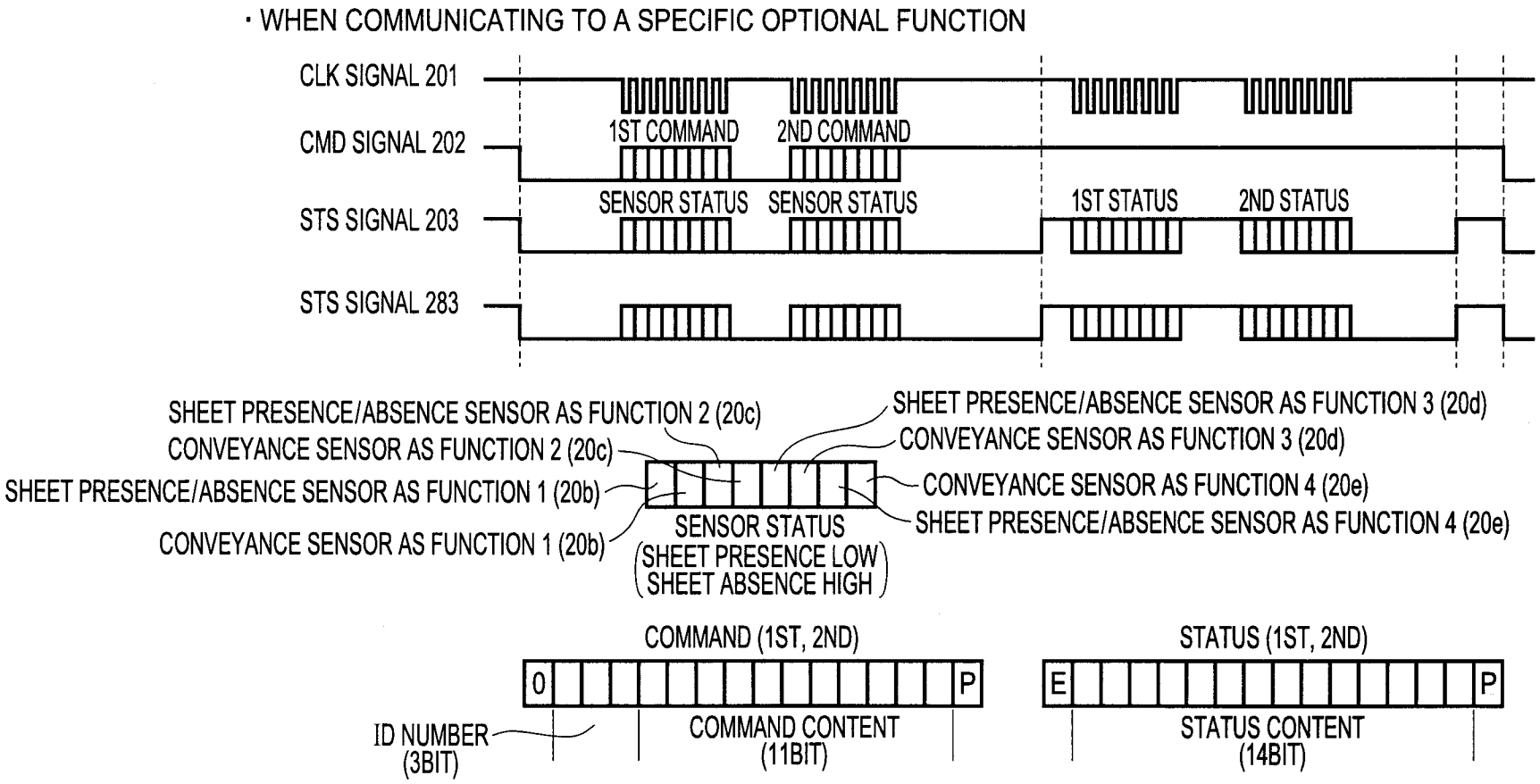
Figures 2, 3D:
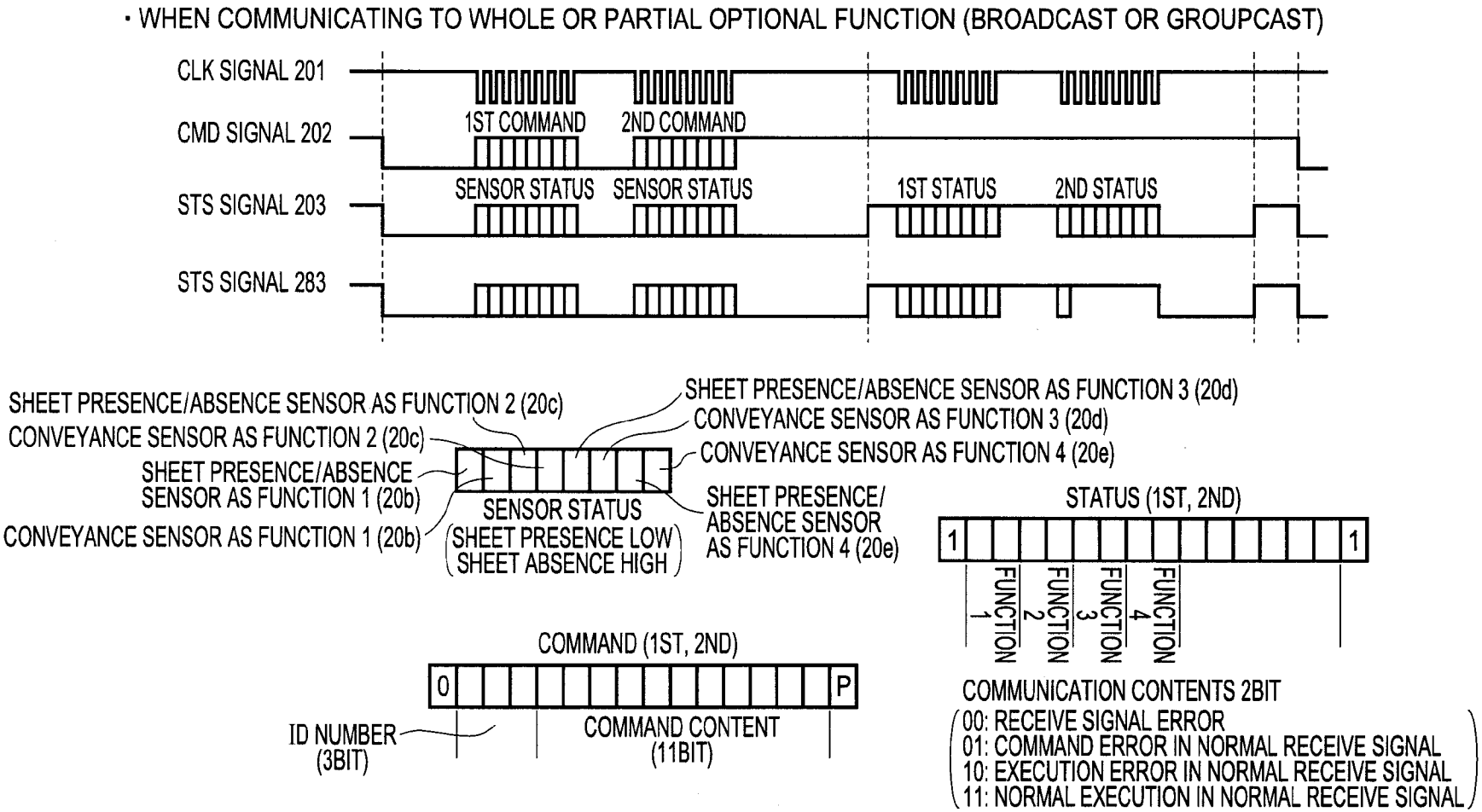

FIGS. 3D-1 and 3D-2 illustrate the optional sheet feeding apparatus 108 of the four-layer type. The optional control portion 280 has four optional functions (sheet feeding function 1=feed portion 20*b* of ID=1, sheet feeding function 2=feed portion 20*c* of ID=2, sheet feeding function 3=feed portion 20*d* of ID=3, and sheet feeding function 4=feed portion 20*e* of ID=4). Therefore, the optional control portion 280 analyzes the command by separately using IDs=1, 2, 3, and 4 of the existing optional functions, while returning the sensor information, the status contents, and the notification contents regarding the four optional functions by the STS signal 283.

As can be understood by comparing FIGS. 3A-1 to 3D-2 with one another, each optional sheet feeding apparatus performs communication with regard to multiple (including one) currently owned optional sheet feeding functions by distinguishing the ID numbers assigned to the respective optional sheet feeding functions. Therefore, the STS receive signal 203 of the main body control portion 200 is the same signal for any combination. By handling the optional sheet feeding functions separately, the main body control portion 200 can perform communication without concern about the configuration of the optional functions within the optional apparatus. This allows sheet feeding control on an optional sheet feeding function basis as well. One communication is enough to acquire the sensor states of the respective optional functions and to know the conveyance position of a sheet and the presence/absence of the sheet with accuracy, thereby enabling sheet feeding control with high speed.

Figure 4:
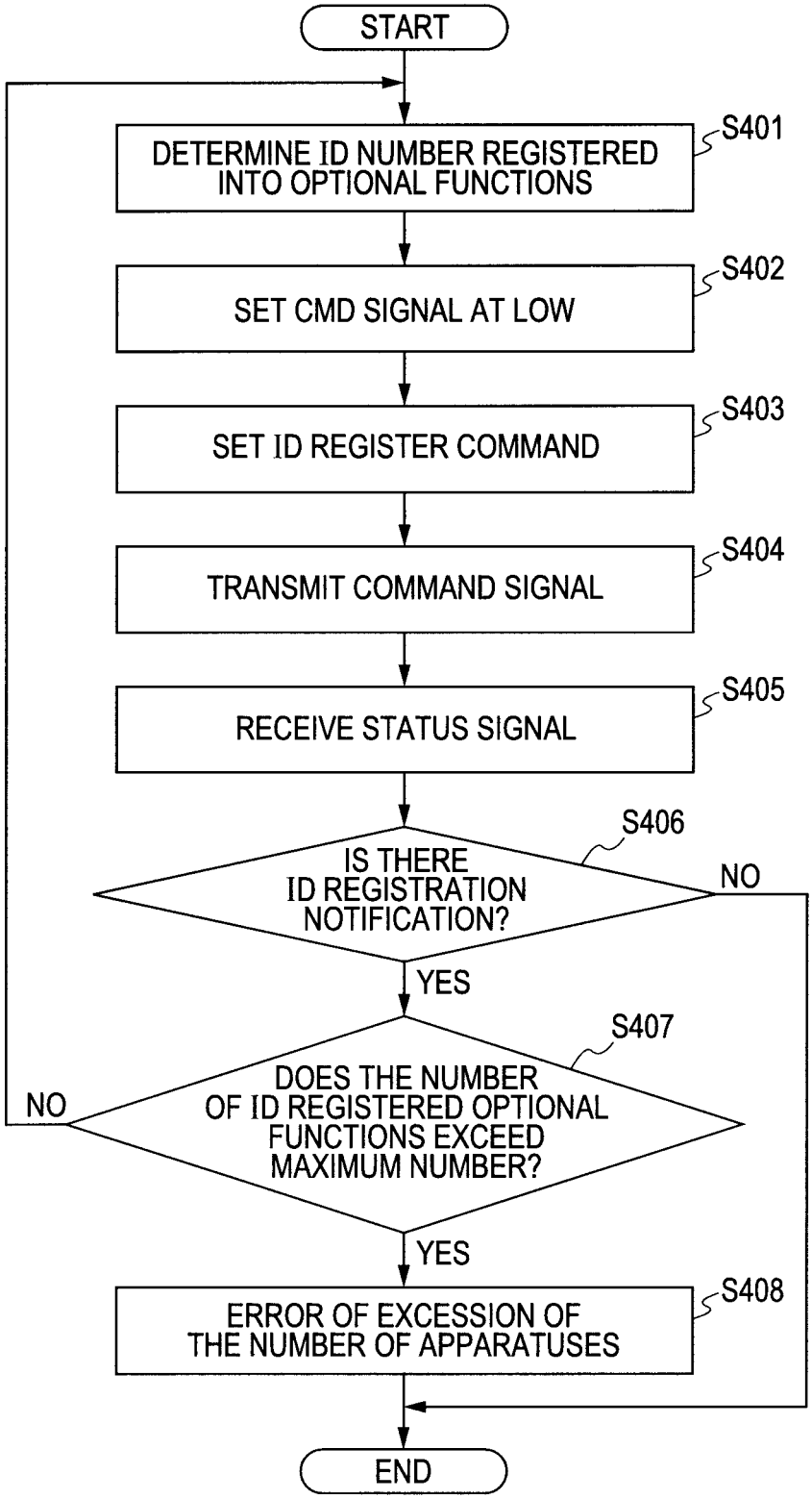
FIG. 4 is a flowchart of ID registration control of a main body control portion of the image forming apparatus main body according to the first embodiment of the present invention.

FIG. 4 is a flowchart of ID registration control of a main body control portion (unit) of the image forming apparatus main body according to the first embodiment of the present invention.

The main body control portion 200 determines an ID number (incremented by 1, such as 1, 2, 3, . . . ) to be registered into an optional function (S401). Specifically, the main body control portion 200 performs ID number determination by setting ID number=1 at the beginning. To notify the start of communication, the main body control portion 200 sets the CMD signal at Low (S402).

The main body control portion 200 sets command data by an ID register command including the ID number (ID number=1 at first) to be registered (S403). The main body control portion 200 transmits the command data by the CMD signal in synchronization with the CLK signal (S404).

The main body control portion 200 waits until the STS signal changes to High, and then receives a status in synchronization with the CLK signal (S405). The main body control portion 200 analyzes the received status to judge whether or not the status is an ID registration notification status meaning that the ID has successfully been registered (S406). Then, if the main body control portion 200 has received the ID registration notification status, another optional function may be connected. Thus, the procedure returns to Step S401 to determine the next ID number=2.

The main body control portion 200 repeats this operation to register ID number=1 into the optional function 20*b*, ID number=2 into the optional function 20*c*, ID number=3 into the optional function 20*d*, and ID number=4 into the optional function 20*e*. No ID registration notification status is returned in response to the ID register command including ID number=5. Thus, the main body control portion 200 judges that the IDs have been registered into all the optional functions (registration completion) (S406), and ends the procedure.

Note that if an ID registration notification status is returned in response to the ID register command including ID number=5 (if a user attaches another optional apparatus in the lowermost layer in one of FIGS. 1A to 1D), the main body control portion 200 judges that the number n of the optional functions exceeds the maximum number of four (over maximum number) (S407). Then, as an excess error of the number of optional sheet feeding functions attached, the main body control portion 200 displays a message to prompt the user to reduce the number of optional functions (S408), and ends the procedure.

In the case of the excess error, such a measure may be taken as to inhibit the printing because the power capacity is short or because the image forming apparatus with too many optional apparatuses being stacked has the risk of toppling over due to an increase in total height thereof. Regardless of which of the one- to four-layer types the optional apparatus is of, the optional control portion of the optional apparatus performs ID assignment on an optional function basis according to the number of functions (which is described with reference to FIGS. 6A and 6B). Accordingly, the main body control portion 200 can register IDs on an optional function basis as in Table 1, which enables communication and control to be performed on an optional function basis.

Figure 5:
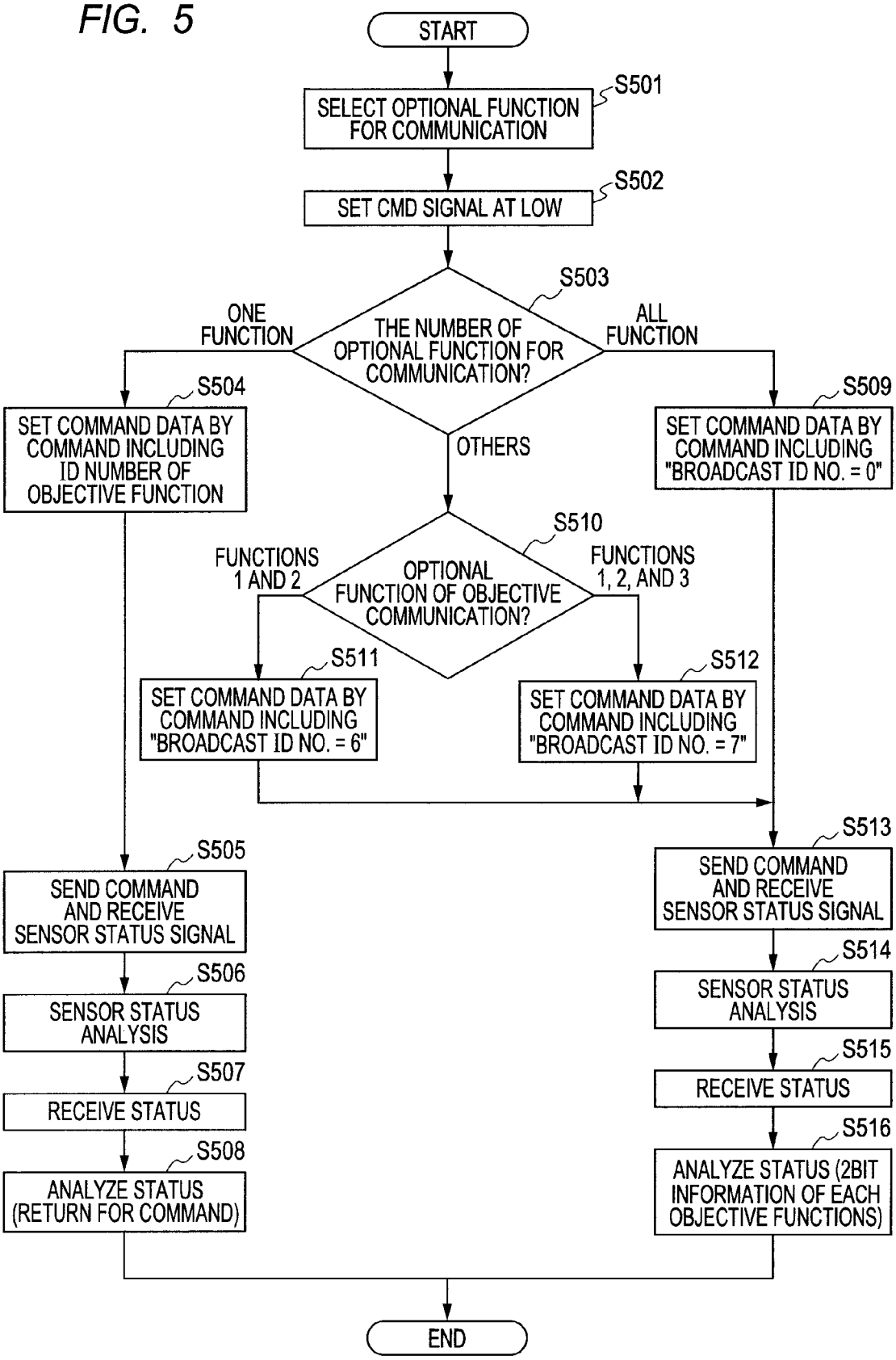
FIG. 5 is a flowchart of command communication control of the main body control portion of the image forming apparatus main body according to the first embodiment and the second embodiment of the present invention.

FIG. 5 is a flowchart of command communication control of the main body control portion 200 of the image forming apparatus main body according to the first embodiment of the present invention. After ending the ID registration illustrated in FIG. 4, the main body control portion 200 selects an optional function for communication (S501). Specifically, in a case of feeding a recording sheet from each optional function (feed portion), the main body control portion 200 selects the "optional sheet feeding function 1" for the feeding from the optional sheet feeding function 1 (feed portion 20*b*), and selects the "optional sheet feeding functions 1 and 2" for the feeding from the optional sheet feeding function 2 (feed portion 20*c*). Further, the main body control portion 200 selects the "optional sheet feeding functions 1, 2, and 3" for the feeding from the optional sheet feeding function 3 (feed portion 20*d*), and selects the "optional sheet feeding functions 1, 2, 3, and 4, that is, all the functions" for the feeding from the optional sheet feeding function 4 (feed portion 20*e*).

To notify the start of communication, the main body control portion 200 sets the CMD signal at Low (S502). If the number of objective functions for the communication is one (S503), the main body control portion 200 sets command data by a command including the ID number of the objective function (S504). For example, to communicate with only the "optional sheet feeding function 1", the main body control portion 200 adds ID number=1 to commands (such as feed start command, feed stop command, acceleration command, and deceleration command).

The main body control portion 200 transmits the command data by the CMD signal in synchronization with the CLK signal, and receives a sensor status by the STS signal (S505). The main body control portion 200 analyzes the received sensor status to recognize the states of the conveyance sensor and the sheet presence/absence sensor of the one function (S506). The main body control portion 200 waits until the STS signal changes to High, and then receives a status in synchronization with the CLK signal (S507). The main body control portion 200 analyzes the received status to judge whether or not the status is a status meaning that the command has successfully been executed (S508), and ends the procedure. If the execution of the command has failed, the optional sheet feeding apparatus 101 performs an error processing such as communication retry, description of which is omitted here.

If all the functions are the objective functions for the communication (S503), the main body control portion 200 sets command data by a command including ID number=0 meaning a broadcast (S509). The main body control portion 200 adds ID number=0 to commands (such as feed start command, feed stop command, acceleration command, and deceleration command). If the objective functions for the communication are the "optional sheet feeding functions 1 and 2" (S510), the main body control portion 200 sets command data by a command including ID number=6 meaning a groupcast (S511). The main body control portion 200 adds ID number=6 to commands (such as feed start command, feed stop command, acceleration command, and deceleration command). If the objective functions for the communication are the "optional sheet feeding functions 1, 2, and 3" (S510), the main body control portion 200 sets command data by a command including ID number=7 meaning a groupcast (S512).

The main body control portion 200 adds ID number=7 to commands (such as feed start command, feed stop command, acceleration command, and deceleration command). The main body control portion 200 transmits the command data by the CMD signal in synchronization with the CLK signal, and receives a sensor status by the STS signal (S513). The main body control portion 200 analyzes the received sensor status to recognize the states of the conveyance sensor and the sheet presence/absence sensor of each function (S514). The main body control portion 200 waits until the STS signal changes to High, and then receives a status in synchronization with the CLK signal (S515). The main body control portion 200 analyzes the received status to confirm 2-bit information notifying whether or not each function has successfully executed the command (S516), and ends the procedure.

Figures 6, 6A:
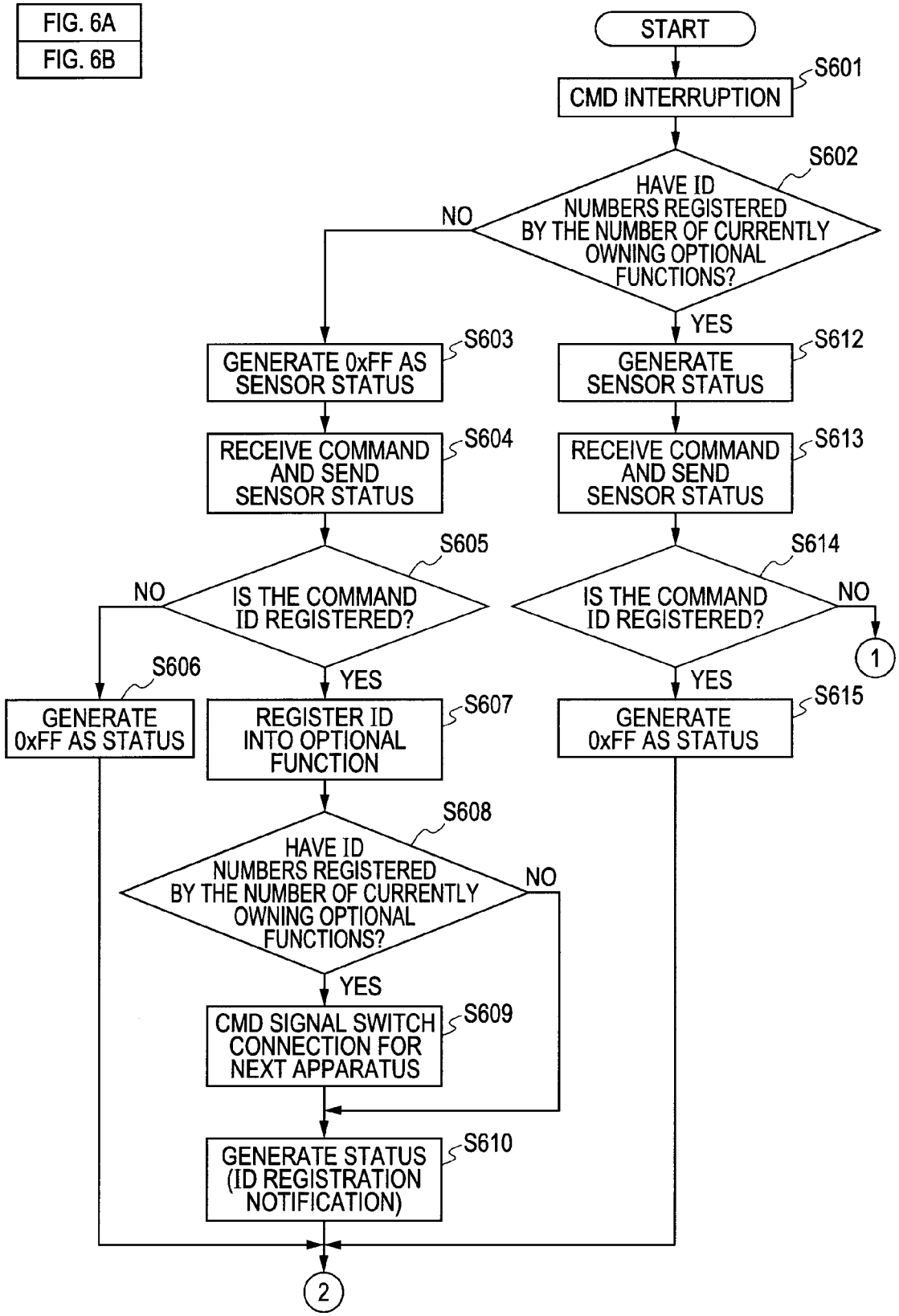
FIG. 6 is comprised of FIGS. 6A and 6B showing flowcharts of the ID registration control and the command communication control of an optional control portion of the optional apparatus according to the first embodiment of the present invention.
Figure 6B:
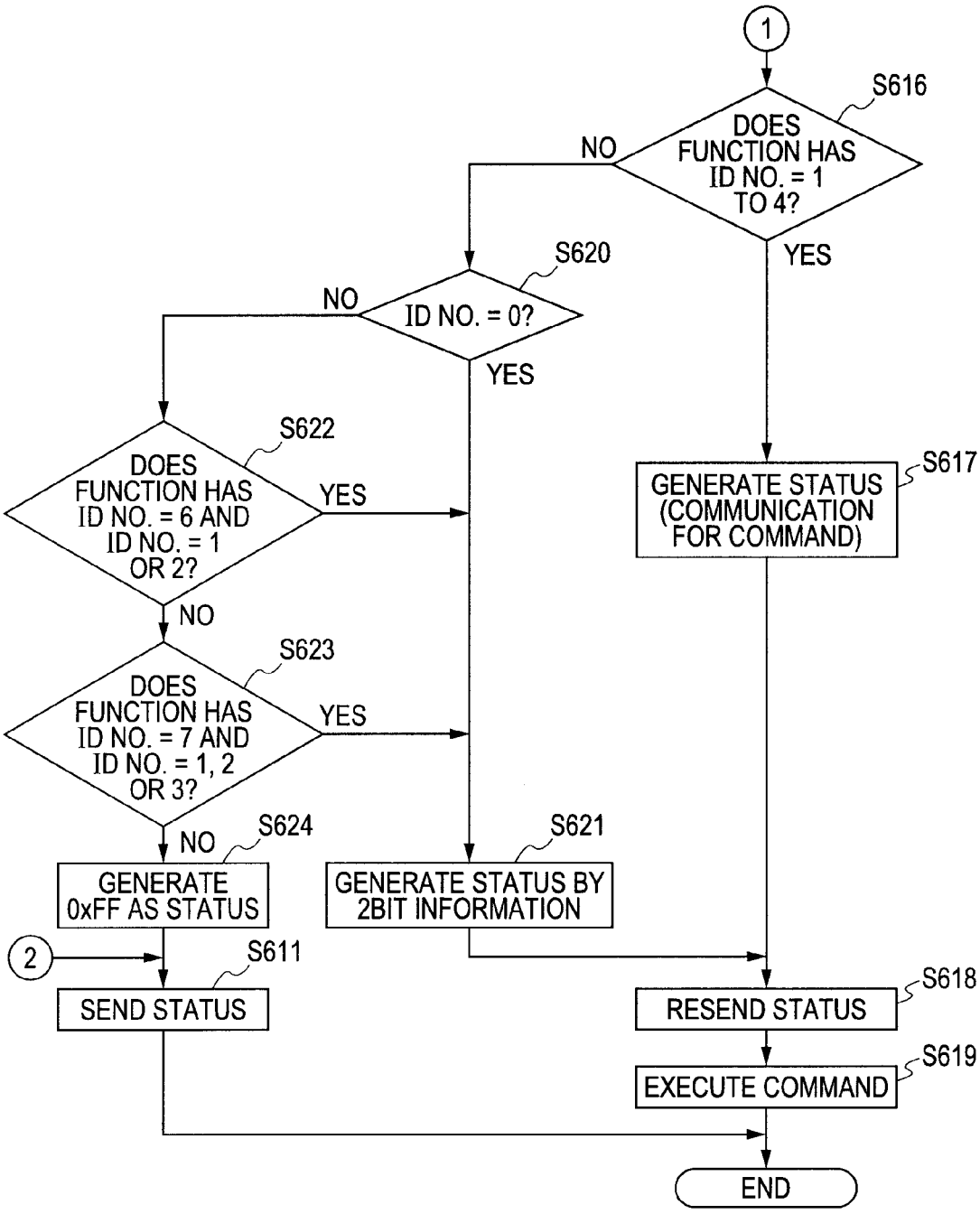

FIGS. 6A and 6B are flowcharts of the ID registration control and the command communication control of the optional control portion of the optional sheet feeding apparatus. At a time of power on (which includes, in a case where the power of the optional apparatus is off in a sleep state, a time of recovery from the sleep state to turn on the power again), the optional control portions 210 to 280 of all the optional sheet feeding apparatuses 101 to 108, respectively, have the ID numbers of the optional functions of themselves unregistered. In this case, the optional control portions are set to inhibit their switches from being connected by the CMD signal. That is, the switches 215, 225, 235, 245, 255, 265, 275, and 285 are each in a disconnected state. Note that the same is true of FIGS. 8A, 8B, 13A and 13B described later.

The optional sheet feeding apparatuses 101 to 104 are of the one-layer type having one sheet feeding function (feed portion). The optional control portions 210, 220, 230, and 240 have the same control program, and the control thereof changes according to the ID number registered into the currently owned sheet feeding function. Further, the optional sheet feeding apparatuses 105 and 106 are of the two-layer type having two sheet feeding functions (feed portions). The optional control portions 250 and 260 have the same control program, and the control thereof changes according to the ID numbers registered separately into the two currently owned sheet feeding functions.

The optional sheet feeding apparatus 107 is of the three-layer type having three sheet feeding functions (feed portions). The optional control portions 207 has a control program, and the control thereof changes according to the ID number registered separately into the three currently owned sheet feeding functions. Further, the optional sheet feeding apparatus 108 is of the four-layer type having four sheet feeding functions (feed portions). The optional control portion 208 has a control program, and the control thereof changes according to the ID numbers registered separately into the four currently owned sheet feeding functions. Here, the optional control portions are set to have different control programs among the one- to four-layer types, but may have the same control program irrespective of the type. In that case, the type may be identified by implementing a hardware signal to the optional control portion separately in order to judge the type.

When the main body control portion 200 changes the CMD signal to Low to notify the start of communication, each optional control portion detects that an interruption has occurred by the CMD interruption signal (S601). For preparation for communication, the optional control portion judges whether or not ID numbers have been registered by the number of currently owned sheet feeding functions (S602). If no ID number has been registered, the optional control portion generates 0xFF as a sensor status (S603). The optional control portion receives command data by the CMD signal in synchronization with the CLK signal, and transmits the sensor status (0xFF in this case) by the STS signal (S604).

The optional control portion analyzes the received command data to judge whether or not the command data is an ID register command (S605). If the received command data is the ID register command, the optional control portion registers the ID into one of the currently owned sheet feeding functions (S607). The optional control portion judges whether or not ID numbers have been registered by the number of currently owned sheet feeding functions based on this ID registration. Then, if ID numbers have been registered by the number of sheet feeding functions (S608), the optional control portion connects its CMD signal switch for another cascade-connected optional sheet feeding apparatus (S609). The connection of the CMD signal switch allows a signal to be sent to the next cascade-connected optional sheet feeding apparatus in the next communication. Note that if another interruption Occurs in Step S601 and if the judgment of Step S602 results in NO, the processing of Step S607 is repeatedly performed for one optional sheet feeding apparatus by the number of times corresponding to the number of sheet feeding functions owned by the one optional sheet feeding apparatus.

Subsequently, the optional control portion generates an ID registration notification status meaning that the ID has successfully been registered and changes the STS signal to High (S610). The optional control portion transmits the status in synchronization with the CLK signal, changes the STS signal to High (S611), and ends the procedure. If ID numbers have not been registered by the number of sheet feeding functions (S608), there exists the currently owned sheet feeding function into which an ID has not been registered, and hence its switch is kept disconnected. In this case, after ending the procedure via Steps S610 and S611, the optional control portion receives the subsequent ID register command transmitted from the main body control portion, and repeatedly performs the ID registration for the remaining sheet feeding functions by the number of times corresponding to the number of sheet feeding functions via Steps S601, S602, S603, S604, S605, and S607.

If the received command data is not the ID register command (S605), the optional control portion generates 0xFF as a status to ignore the command, and changes the STS signal to High (S606). Then, the optional control portion transmits the status in synchronization with the CLK signal, changes the STS signal to High (S611), and ends the procedure.

If ID numbers have been registered by the number of currently owned sheet feeding functions (S602), the optional control portion generates a sensor status in which information on the conveyance sensor and the sheet presence/absence sensor is set in a predetermined position determined by the ID number of each of the currently owned sheet feeding functions (S612). Then, the optional control portion receives the command data by the CMD signal in synchronization with the CLK signal, and transmits the sensor status by the STS signal (S613). The optional control portion analyzes the received command data to judge whether or not the command data is an ID register command (registration instruction) (S614). If the received command data is the ID register command, the optional control portion generates 0xFF as a status to ignore the command because IDs have already been registered by the number of currently owned functions, and changes the STS signal to High (S615). Then, the optional control portion transmits the status in synchronization with the CLK signal, changes the STS signal to High (S611), and ends the procedure.

If the received command data is not the ID register (registration instruction) command (S614), the optional control portion judges whether or not the ID number added to the command is in a range of 1 to 4 and matches the ID registration number of the currently owned sheet feeding function (S616). If the ID matches the ID registration number, the command targets only the currently owned sheet feeding function, and hence the optional control portion generates a notification status in response to the command and changes the STS signal to High (S617). The optional control portion transmits the status in synchronization with the CLK signal (S618), executes the command, changes the STS signal to High (S619), and ends the procedure.

If the ID number is 0 (S620), if the currently owned sheet feeding function has the ID number=6 and ID number=1 or 2 (S622), or if the currently owned sheet feeding function has the ID number=7 and ID number=1, 2, or 3 (S623), the procedure advances to Step S621. That is, the command targets the objective sheet feeding function among the currently owned sheet feeding functions. Therefore, the optional control portion generates a status in which 2-bit notification information is set in a predetermined position determined by the objective ID number, and changes the STS signal to High (S621). Then, the optional control portion transmits the status in synchronization with the CLK signal (S618), executes the command, changes the STS signal to High (S619), and ends the procedure. If the objective sheet feeding function corresponds to neither a broadcast nor a groupcast, the optional control portion generates 0xFF as a status to ignore the command, and changes the STS signal to High (S624). Then, the optional control portion transmits the status in synchronization with the CLK signal, changes the STS signal to High (S611), and ends the procedure.

In the above-mentioned manner, the optional control portion of the optional sheet feeding apparatus registers IDs by the number of currently owned sheet feeding functions on a sheet feeding function basis, and after the ID registration has been repeatedly performed by the number of times corresponding to the number of sheet feeding functions, connects the communication switch for the next optional sheet feeding apparatus, followed by sequential ID registration on a sheet feeding function basis. Then, the optional control portion receives the command by the ID number (targeting individual sheet feeding functions, targeting all the sheet feeding functions by broadcast, or targeting partial sheet feeding functions by groupcast) corresponding to the sheet feeding function from the main body control portion, and carries out the command of the objective sheet feeding function. Further, based on the ID number of each of the currently owned sheet feeding functions, the optional control portion sets the sensor information and the notification information on a sheet feeding function basis in a predetermined bit position to thereby enable the information to be efficiently transmitted to the main body control portion.

As described above, an ID number is registered into each sheet feeding function owned by the optional apparatus, and after the ID numbers have been registered by the number of sheet feeding functions owned by the optional apparatus, the communication switch for the next optional apparatus is connected, thereby enabling the ID numbers to be registered into each of the sheet feeding functions of all the optional apparatuses. Further, by providing such ID number registration means on a sheet feeding function basis, the ID number registration and the communication control can be performed under the same control irrespective of the combination of the types (one- to four-layer types) of the optional sheet feeding apparatuses as in FIGS. 1A to 1D. As a result, in a case where only the optional sheet feeding apparatus of the one-layer type is available at the time of release, if the optional sheet feeding apparatuses of the two- to four-layer types illustrated in FIGS. 1B, 1C, and 1D, respectively, are added later, the program of the main body control portion need not be changed because the ID number registration and the communication control are the same.

Further, regardless of the various types of optional apparatus, ID numbers are registered on a sheet feeding function basis. Therefore, based on the ID number on a sheet feeding function basis, the sensor information and the notification information on a sheet feeding function basis are set in a predetermined bit position to thereby enable the information to be efficiently transmitted to the main body control portion. Accordingly, an accurate position of a sheet being conveyed can be grasped with high speed, and erroneous sensing of the last sheet can be eliminated owing to enhanced speed in sensing the presence/absence of a sheet, which can realize an improved throughput. In addition, ID numbers are added on a sheet feeding function basis, and unicast communication targeting one sheet feeding function, broadcast communication, and groupcast communication are provided. Accordingly, the recording sheet to be conveyed over different sheet feeding functions can be subjected to conveyance start, conveyance stop, and conveyance acceleration/deceleration synchronously among the sheet feeding functions. Further, pulling or thrusting of the recording sheet between the sheet feeding functions is eliminated, which enables stable conveyance of the recording sheet.

Further, when the sheet feeding is synchronized on the upper layer side of the optional sheet feeding functions, the sheet feeding on the lower layer side which is unnecessary for the conveyance may not be performed. Thus, it is possible to suppress power consumption. In addition, an excess error is judged by counting not the number of optional apparatuses but the number of attached sheet feeding functions. Accordingly, the excess error can be detected with accuracy in comparison with the maximum number in terms of power capacity shortage or height limitation.

(Second Embodiment)

Description is made of a second embodiment of the present invention. Note that the configuration and the like of the image forming apparatus applied to this embodiment are the same as those of FIGS. 1A to 1D, 2A to 2D, and 3A-1 to 3D-2, and description thereof is omitted here.

Figure 7:
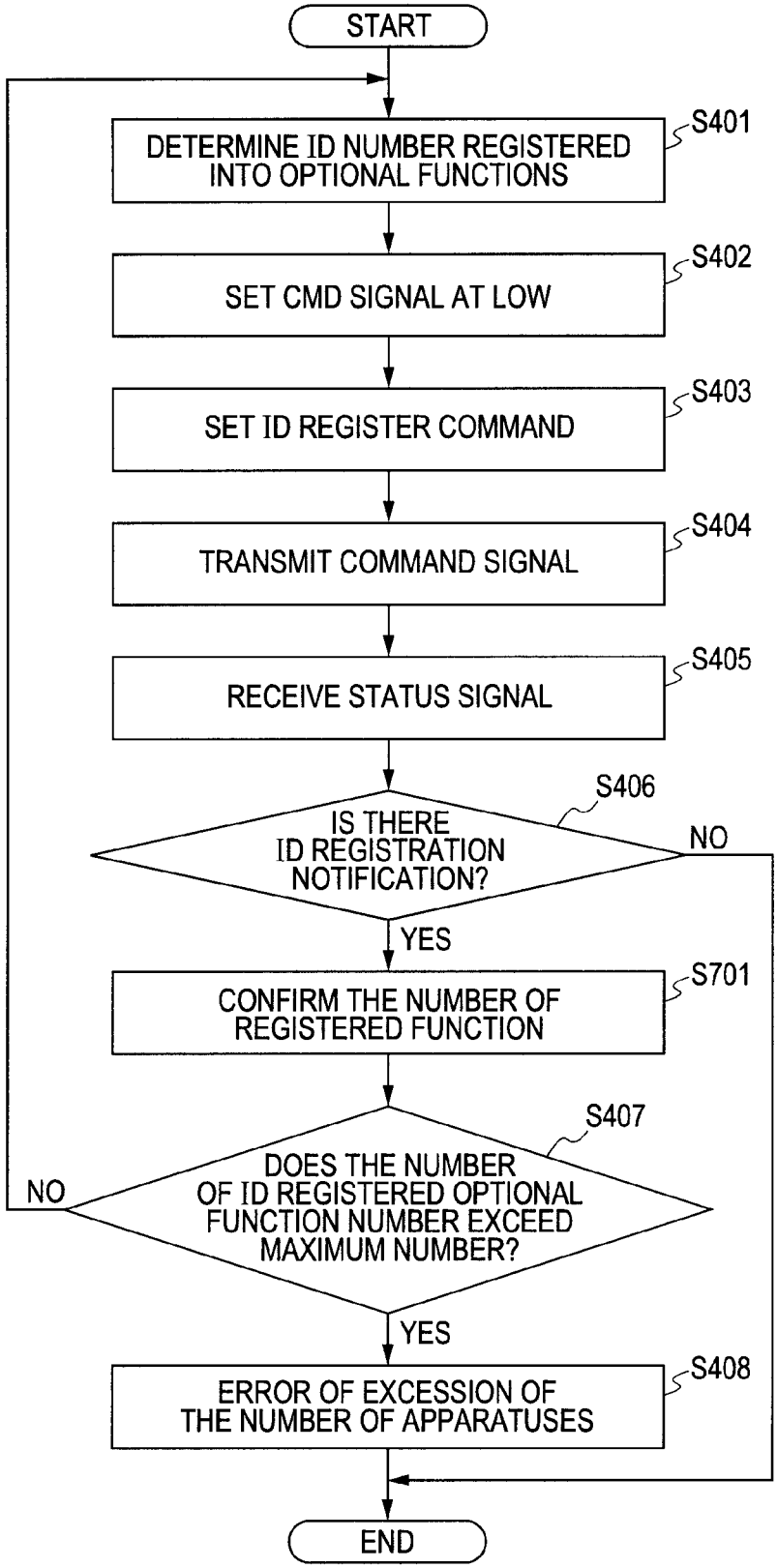
FIG. 7 is a flowchart of the ID registration control of the main body control portion of the image forming apparatus main body according to the second embodiment and a third embodiment of the present invention.

FIG. 7 is a flowchart of the ID registration control of the main body control portion 200 of the image forming apparatus main body according to this embodiment. FIG. 7 is different from FIG. 4 of the first embodiment in that Step S701 is added. First, Steps S401 to 5406 of FIG. 7 are the same as those of FIG. 4, and description thereof is omitted here. If an ID registration notification status is returned, the main body control portion 200 confirms the number of registered functions included in the returned notification status (S701). Then, the main body control portion 200 adds the confirms number to the number of optional functions registered so far, and if the number of registered functions does not exceed the maximum number (S407), another optional function may be connected. Thus, the procedure returns to Step S401 to determine the ID number as the value obtained by adding the value of the number of registered functions.

Hereinafter, specific description is made of the determination of the ID number performed in the flowchart of FIG. 7. For example, in the case of FIG. 1A, the ID registration notification meaning that the "the ID has been registered into one function" is received from the optional control portion 210 of the optional sheet feeding apparatus 101 of the one-layer type. Therefore, the main body control portion 200 judges that ID=1 has been registered into one sheet feeding function, and determines the next ID number=2. In the case of FIG. 1B, the ID registration notification meaning that the "the IDs have been registered into two functions" is received from the optional control portion 250 of the optional sheet feeding apparatus 105 of the two-layer type. Therefore, the main body control portion 200 judges that IDs=1 and 2 have been registered into two sheet feeding functions, and determines the next ID number=3.

Similarly, in the case of FIG. 1C, the ID registration notification meaning that the "the IDs have been registered into three functions" is received from the optional control portion 270 of the optional sheet feeding apparatus 107 of the three-layer type. Therefore, the main body control portion 200 judges that IDs=1, 2, and 3 have been registered into three sheet feeding functions, and determines the next ID number=4. In the configuration of FIG. 1D, the ID registration notification meaning that the "the IDs have been registered into four functions" is received from the optional control portion 280 of the optional sheet feeding apparatus 108 of the four-layer type. Therefore, the main body control portion 200 judges that IDs=1, 2, 3, and 4 have been registered into four sheet feeding functions, and determines the next ID number=5. The main body control portion 200 repeats this operation to register ID number=1 into the sheet feeding function 20*b*, ID number=2 into the sheet feeding function 20*c*, ID number=3 into the sheet feeding function 20*d*, and ID number=4 into the sheet feeding function 20*e*. No ID registration notification status is returned in response to the ID register command including ID number=5. Thus, the main body control portion 200 judges that the IDs have been registered into all the optional functions (S406), and ends the procedure.

Note that if an ID registration notification status is returned in response to the ID register command including ID number=5 (if the user has attached another optional apparatus in the lowermost layer in any one of FIGS. 1A to 1D), the main body control portion 200 judges that the number of the optional functions exceeds the maximum number of four (S407). Then, as an excess error of the number of optional sheet feeding functions attached, the main body control portion 200 displays a message to prompt the user to reduce the number of optional functions (S408), and ends the procedure.

Regardless of which of the one- to four-layer types the optional apparatus is of, the optional control portion of the optional apparatus performs collective ID assignment of all the currently owned optional functions on an optional function basis according to the number of functions at one time (which is described with reference to FIGS. 8A and 8B). Accordingly, while reducing the time for the ID registration with a smaller number of repetition times of the ID registration than in the first embodiment, the main body control portion 200 can register IDs on an optional function basis as in Table 1, which enables communication and control to be performed on an optional function basis.

FIG. 5 is the flowchart of the command communication control of the main body control portion of the image forming apparatus main body according to this embodiment, which is the same as that of the first embodiment, and the description thereof is not repeated here.

Figures 8, 8A:
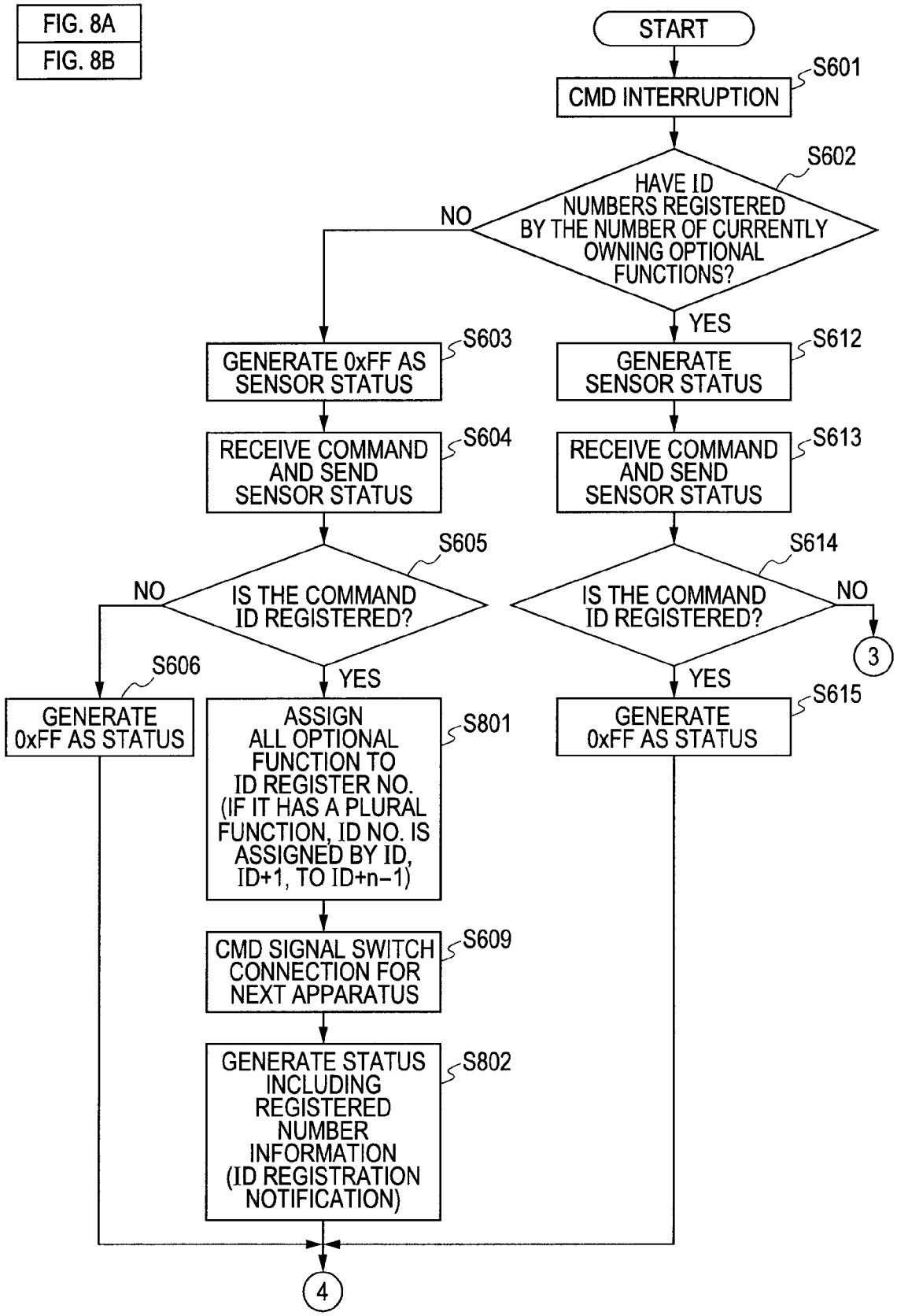
FIG. 8 is comprised of FIGS. 8A and 8B showing flowcharts of the ID registration control and the command communication control of the optional control portion of the optional apparatus according to the second embodiment of the present invention.
Figure 8B:
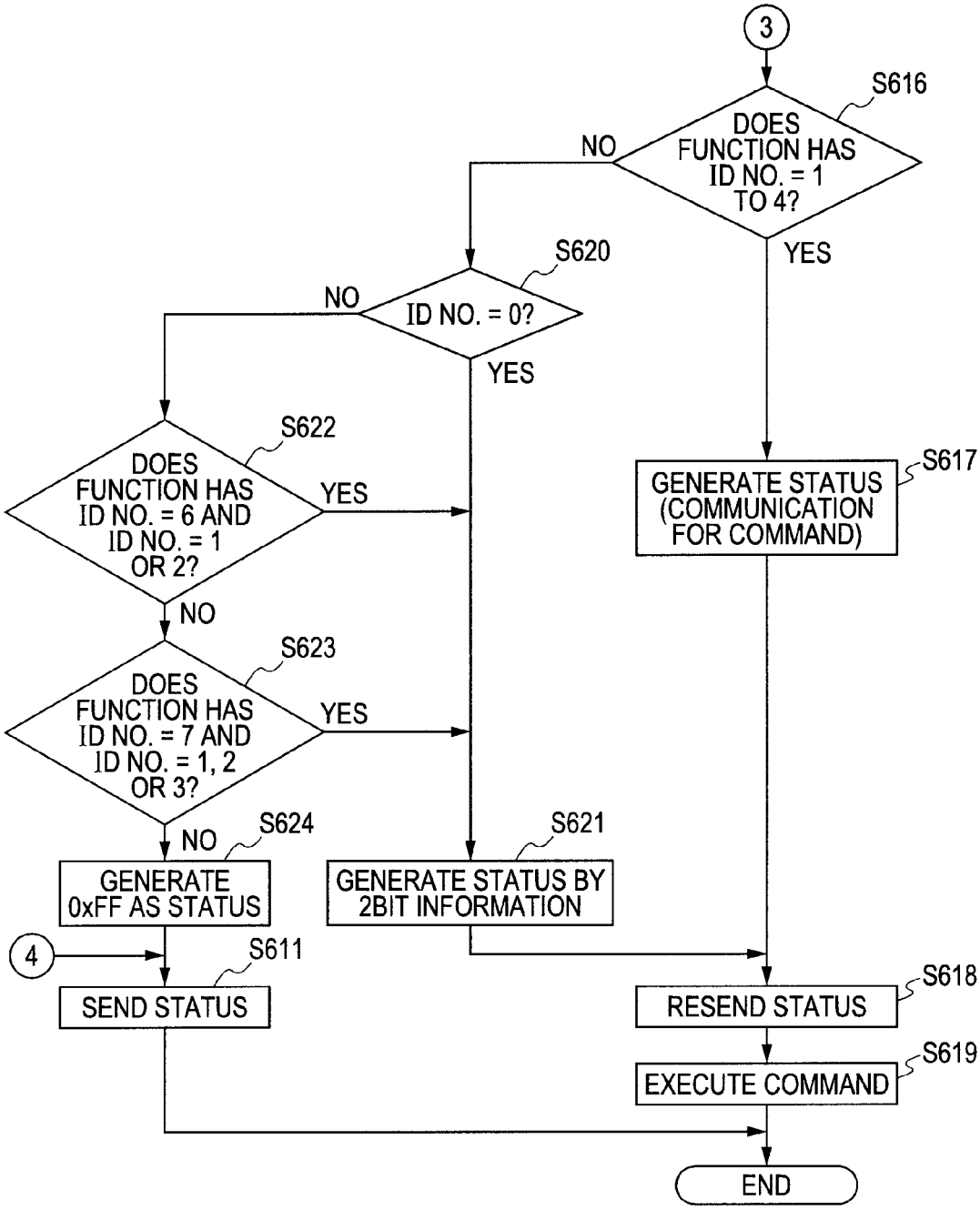

FIGS. 8A and 8B are flowcharts of the ID registration and the command communication control of the optional control portion of the optional sheet feeding apparatus. FIGS. 8A and 8B are different from FIGS. 6A and 6B of the first embodiment in that Steps S607 and 5608 are replaced with Step S801 and Step S610 is replaced with Step S802. Description of the same portions as those of the first embodiment is simplified or omitted here.

First, Steps S601 to 5605 are the same as those of FIGS. 6A and 6B, and detailed description thereof is omitted here. Then, if the received command data is the ID register command in Step S605, the IDs are registered into the respective functions by the number of currently owned sheet feeding functions at one time as ID number=specified ID number, ID number=(specified ID number+1), . . . , ID number=(specified ID number+(the number n of functions−1)) (S801). By this ID registration, the ID numbers have been registered by the number of currently owned sheet feeding functions. Therefore, the optional control portion connects its CMD signal switch for another cascade-connected optional sheet feeding apparatus (S609).

The connection of the CMD signal switch allows a signal to be sent to the next cascade-connected optional sheet feeding apparatus in the next communication. In the ID registration notification meaning that the IDs have successfully been registered, the optional control portion generates a status to which information on the number of registered sheet feeding functions is added, and changes the STS signal to High (S802). The optional control portion then transmits the status in synchronization with the CLK signal, changes the STS signal to High (S611), and ends the procedure.

Specifically, in the configuration of FIG. 1A, the optional control portion 210 of the optional sheet feeding apparatus 101 of the one-layer type, which has one sheet feeding function, registers ID=1 into this sheet feeding function, and transmits the ID registration notification meaning that the "the ID has been registered into one function". In the configuration of FIG. 1B, the optional control portion 250 of the optional sheet feeding apparatus 105 of the two-layer type, which has two sheet feeding functions, registers ID=1 and ID=2 respectively into the two sheet feeding functions, and transmits the ID registration notification meaning that the "the IDs have been registered into two functions". In the configuration of FIG. 1C, the optional control portion 270 of the optional sheet feeding apparatus 107 of the three-layer type, which has three sheet feeding functions, registers ID=1, ID=2, and ID=3 respectively into the three sheet feeding functions, and transmits the ID registration notification meaning that the "the IDs have been registered into three functions". In the configuration of FIG. 1D, the optional control portion 280 of the optional sheet feeding apparatus 108 of the four-layer type, which has four sheet feeding functions, registers ID=1, ID=2, ID=3, and ID=4 respectively into the four sheet feeding functions, and transmits the ID registration notification meaning that the "the IDs have been registered into four functions". In the case of the first embodiment, the ID is registered into one sheet feeding function in one time of communication, which necessitates the ID register command repeated by the times corresponding to the number of sheet feeding functions. Meanwhile, in this embodiment, the IDs are registered by the number of sheet feeding functions by one ID register command, which can reduce the time necessary for the ID registration.

If the received command data is not the ID register command (S605), the optional control portion generates 0xFF as a status to ignore the command, and changes the STS signal to High (S606). Then, the optional control portion transmits the status in synchronization with the CLK signal, changes the STS signal to High (S611), and ends the procedure. If the ID numbers have been registered by the number of currently owned sheet feeding functions (S602), Steps S612 to S624 are the same as those of the first embodiment, and hence description thereof is omitted here.

In the above-mentioned manner, the optional control portion of the optional sheet feeding apparatus registers IDs by the number of currently owned sheet feeding functions on a sheet feeding function basis at one time, connects the communication switch for the next optional sheet feeding apparatus, and sequentially registers IDs on a sheet feeding function basis. Then, the optional control portion receives the command by the ID number (targeting individual sheet feeding functions, targeting all the sheet feeding functions by broadcast, or targeting partial sheet feeding functions by groupcast) corresponding to the sheet feeding function from the main body control portion, and carries out the command of the objective sheet feeding function.

Further, based on the ID number of each of the currently owned sheet feeding functions, the optional control portion sets the sensor information and the notification information on a sheet feeding function basis in a predetermined bit position to thereby enable the information to be efficiently transmitted to the main body control portion.

As described above, in comparison with the first embodiment, in this embodiment, the time for the ID registration can be reduced by registering the ID numbers by the number of sheet feeding functions owned by the optional apparatus on a sheet feeding function basis at one time and performing the ID registration notification including the number of sheet feeding functions registered for the main body control portion.

(Third Embodiment)

Description is made of a third embodiment of the present invention by referring to the drawings. The first embodiment and the second embodiment illustrate the examples of attaching multiple (at least one) optional sheet feeding apparatuses having the same multiple (at least one) functions (sheet feeding functions). This embodiment illustrates an example of attaching an optional discharge apparatus having multiple different functions.

Figure 9A:
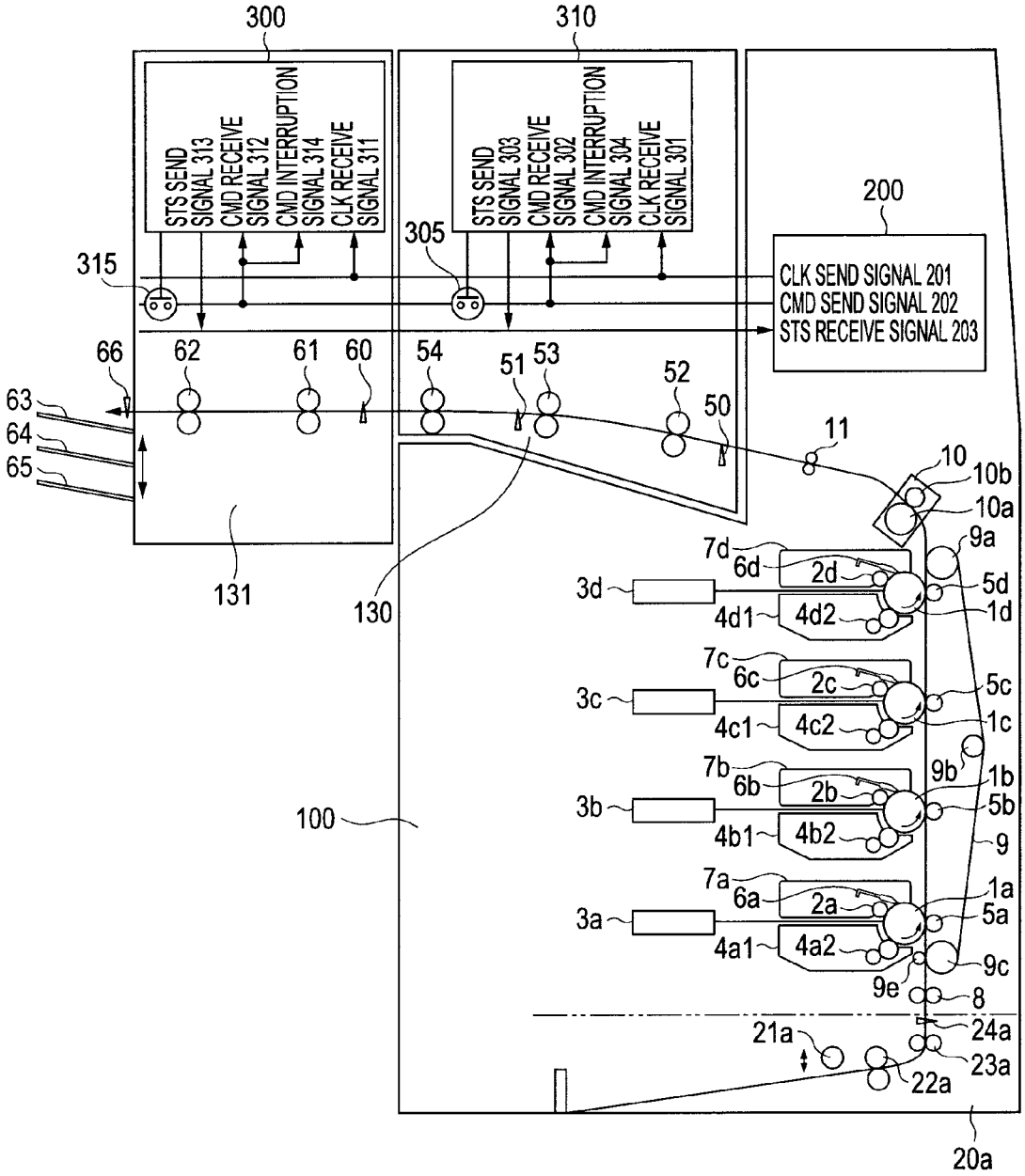
FIG. 9A is a sectional view and a communication interface diagram that illustrate an image forming apparatus (image forming apparatus main body and optional apparatuses) according to the third embodiment of the present invention.
Figure 9B:
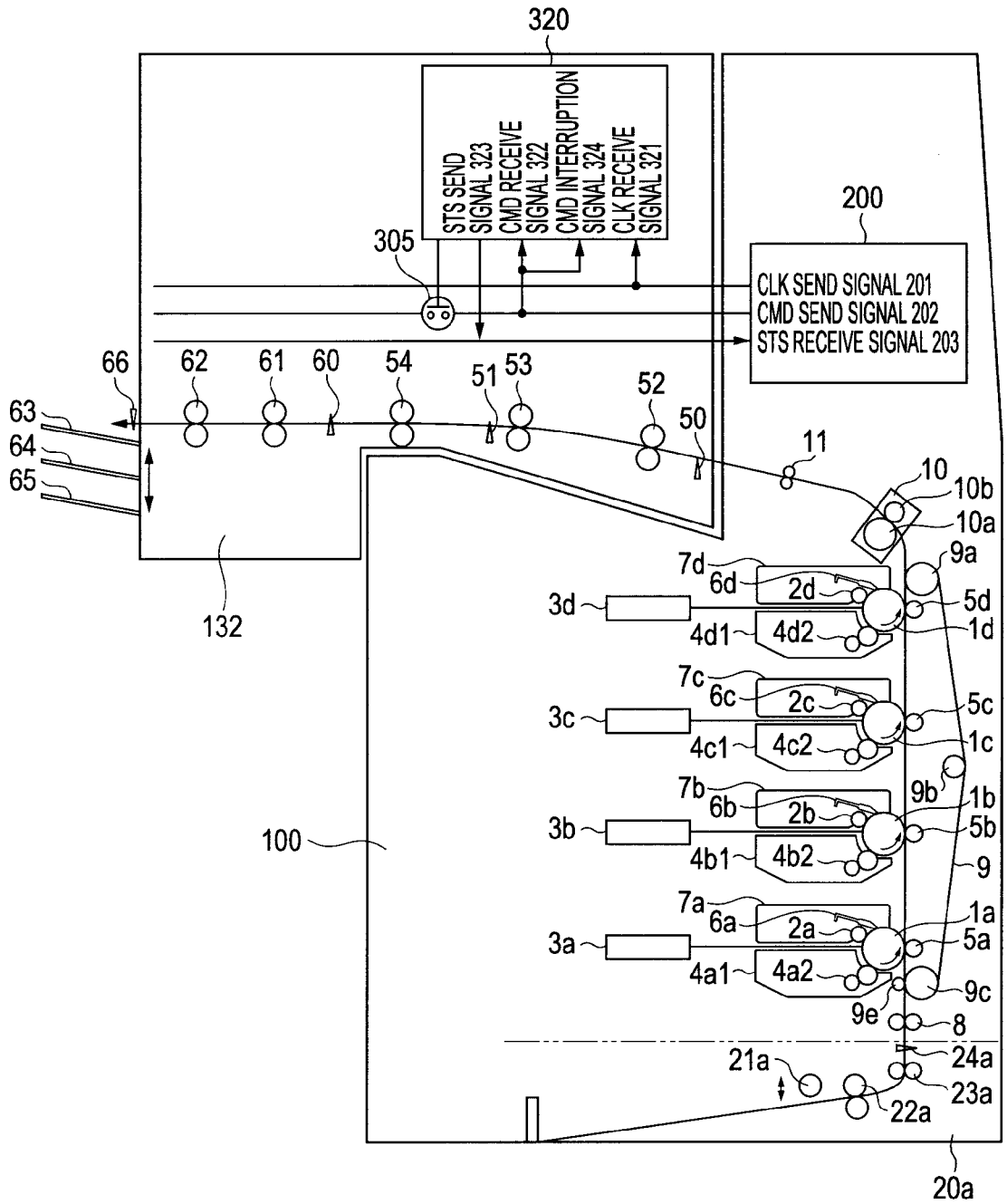
FIG. 9B is a sectional view and a communication interface diagram that illustrate another image forming apparatus (image forming apparatus main body and optional apparatuses) according to the third embodiment of the present invention.

FIGS. 9A and 9B are each a sectional view and a communication interface diagram that illustrate the third embodiment of the present invention. FIG. 9A is an example of an image forming apparatus configured by attaching an optional intermediate conveyance apparatus 130 having an intermediate conveyance function and an optional bin discharge apparatus 131 having a bin discharge function to the image forming apparatus main body 100 in a downstream thereof. FIG. 9B is an example of an image forming apparatus configured by attaching an optional discharge apparatus 132 having two functions of an intermediate conveyance function and a bin discharge function to the image forming apparatus main body 100 in a downstream thereof. The image forming apparatus main body 100 is the same as those described in the first embodiment and the second embodiment, and hence description thereof is omitted here.

The optional intermediate conveyance apparatus 130 receives a recording sheet from the image forming apparatus main body 100, conveys the recording sheet by conveyance rollers 52 to 54, and transfers the recording sheet to the optional bin discharge apparatus 131. The optional intermediate conveyance apparatus 130 grasps a positional relationship of the recording sheet by sensing the leading and trailing ends of the recording sheet by an intermediate inlet sensor 50 and an intermediate conveyance sensor 51. After the recording sheet has passed through the rear end of the image forming apparatus main body, the optional intermediate conveyance apparatus 130 accelerates the recording sheet and transfers the recording sheet to the optional bin discharge apparatus 131. While the recording sheet extends over the optional intermediate conveyance apparatus 130 and the optional bin discharge apparatus 131, the optional intermediate conveyance apparatus 130 accelerates and conveys the print sheet in synchronization with the optional bin discharge apparatus 131. When the trailing end of the sheet has passed through the conveyance rollers 54, the optional intermediate conveyance apparatus 130 regains an original speed, and receives the subsequent sheet from the image forming apparatus main body 100.

The optional bin discharge apparatus 131 receives the recording sheet from the optional intermediate conveyance apparatus 130, conveys the recording sheet by conveyance rollers 61 and 62, and discharges the recording sheet to any one of an upper discharge bin 63, a middle discharge bin 64, and a lower discharge bin 65. The respective discharge bins can integrally moves in a vertical direction, and are freely selected to discharge a recording sheet. When recording sheets are discharged while the discharge bins are being switched in continuous printing, a recording sheet is accelerated and conveyed in synchronization with the optional intermediate conveyance apparatus to widen the interval between the recording sheet and the subsequent sheet. Meanwhile, the discharge bins are switched by being moved in the vertical direction to thereby discharge the recording sheets. A discharge conveyance sensor 66 enables detection of whether or not a recording sheet has been conveyed into the discharge bin and whether or not the discharge bins are full of recording sheets.

The optional discharge apparatus 132 is an integral optional discharge apparatus having the intermediate conveyance function (function of the optional intermediate conveyance apparatus) and the bin discharge function (function of the optional bin discharge apparatus) together.

Figure 10A:
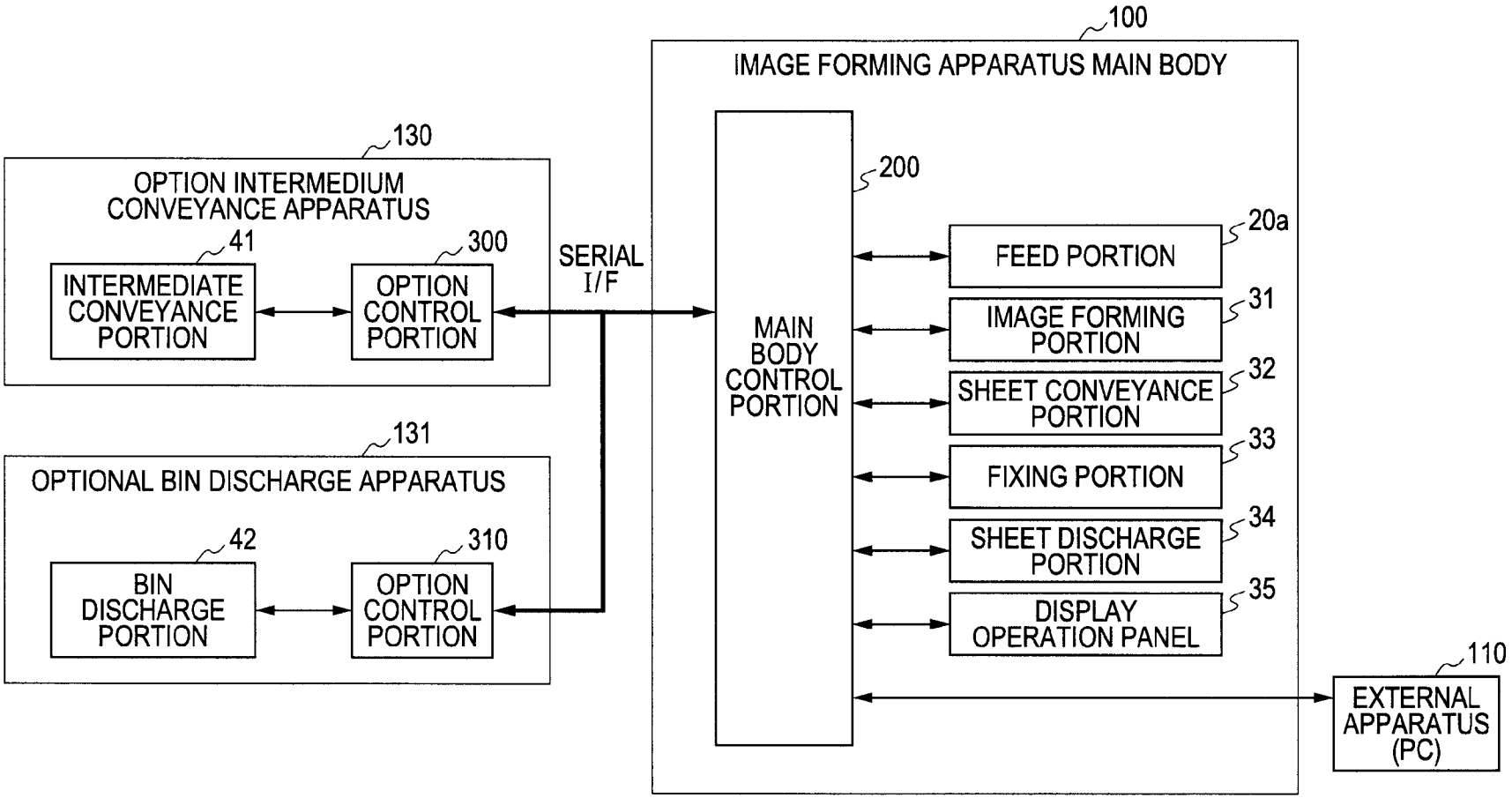
FIGS. 10A and 10B are block diagrams illustrating functional configurations according to the third embodiment of the present invention.
Figure 10B:
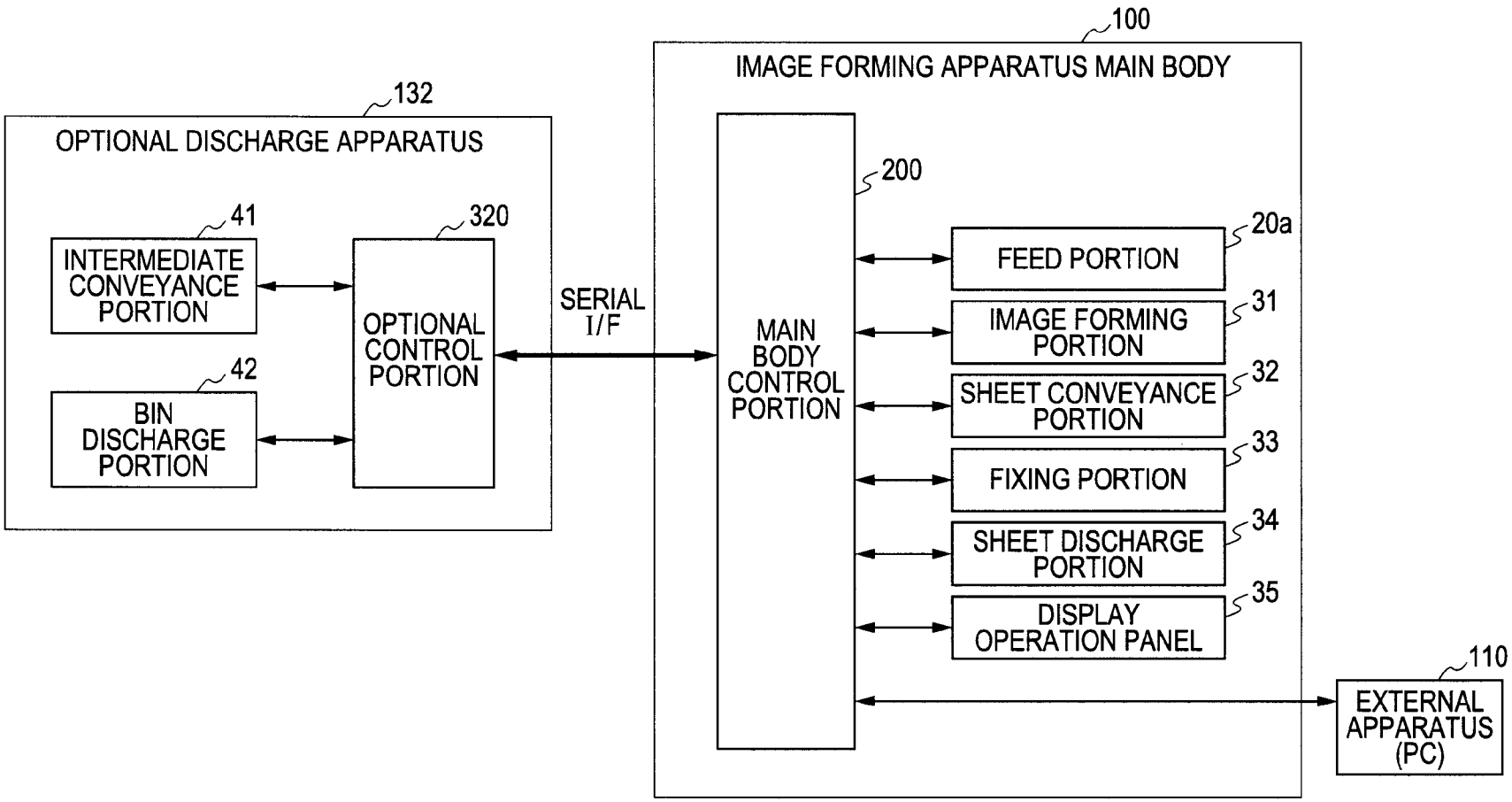

The communication interfaces are described after block diagrams of FIGS. 10A and 10B are described.

FIGS. 10A and 10B are the block diagrams illustrating functional configurations of the image forming apparatus illustrating the third embodiment of the present invention. FIGS. 10A and 10B correspond to FIGS. 9A and 9B, respectively. The image forming apparatus main body 100 is the same as the image forming apparatus main body 100 according to the first embodiment and the second embodiment illustrated in FIGS. 1A to 1D, and hence description thereof is omitted here. In FIG. 10A, the optional intermediate conveyance apparatus 130 includes an optional control portion (unit) 300 that is formed of, specifically, a microcomputer. While communicating with the main body control portion 200 via a serial interface, the optional control portion 320 performs conveyance control of a recording sheet on an intermediate conveyance portion 41, which includes the sensors 50 and 51 and the conveyance rollers 52 to 54, to transfer the recording sheet from the image forming apparatus main body to the optional bin discharge apparatus.

The optional bin discharge apparatus 131 includes an optional control portion 310 that is formed of, specifically, a microcomputer. While communicating with the main body control portion 200 via a serial interface, the optional control portion 310 performs discharge/conveyance control of the recording sheet on a bin discharge portion 42, which includes a sensor 60, the conveyance rollers 61 and 62, the bins 63 to 65, and the sensor 66, to discharge the recording sheet to the bin.

In FIG. 10B, the optional discharge apparatus 132 includes an optional control portion 320 that is formed of, specifically, a microcomputer. While communicating with the main body control portion 200 via a serial interface, the optional control portion 300 performs the conveyance control of a recording sheet on the intermediate conveyance portion 41, which includes the sensors 50 and 51 and the conveyance rollers 52 to 54, to transfer the recording sheet from the image forming apparatus main body to the bin discharge portion 42. At the same time, the optional control portion 320 performs the discharge/conveyance control of the recording sheet on the bin discharge portion 42, which includes the sensors 60 and 66, the conveyance rollers 61 and 62, and the bins 63 to 65, to discharge the recording sheet to the bin.

Returning to FIGS. 9A and 9B, description is made of the communication interfaces according to the third embodiment of the present invention. In FIG. 9A, the optional intermediate conveyance apparatus 130 and the optional bin discharge apparatus 131 include the optional control portions 300 and 310 and switches 305 and 315, respectively. The main body control portion 200 of the image forming apparatus main body 100 is cascade (series)-connected to the optional control portion 300 of the optional intermediate conveyance apparatus 130 and the optional control portion 310 of the optional bin discharge apparatus 131. Interface signals are as follows. As CLK signals for establishing synchronization of communication, the CLK send signal 201 output by the main body control portion 200 is connected to CLK receive signals 301 and 311 received by the optional control portions 300 and 310, respectively. Further, as CMD signals transmitted from the image forming apparatus main body to the optional sheet feeding apparatuses, the CMD send signal 202 output by the main body control portion 200 is connected to CMD receive signals 302 and 312 received by the optional control portions 300 and 310, respectively. Further, as STS signals transmitted (as response) from the optional sheet feeding apparatuses to the image forming apparatus main body, the STS receive signal 203 received by the main body control portion 200 is connected to STS send signals 303 and 313 output by the optional control portions 300 and 310, respectively.

The CMD receive signals 302 and 312 are split in the optional apparatuses, and input to interruption ports of the optional control portions 300 and 310 as CMD interruption signals 304 and 314, respectively. Such a setting is performed as to generate an interruption when the command interruption signal changes to a Low level. The switches 305 and 315 can switch connection states (connected and disconnected states) of the CMD signals of the cascade-connected optional control portions 300 and 310, respectively.

In FIG. 9B, the optional discharge apparatus 132 includes the optional control portion 320 and a switch 325. The main body control portion 200 of the image forming apparatus main body 100 is connected to the optional control portion 320 of the optional discharge apparatus. Interface signals are as follows. As CLK signals, the CLK send signal 201 output by the main body control portion 200 is connected to a CLK receive signal 321 received by the optional control portion 320. Further, as CMD signals, the CMD send signal 202 output by the main body control portion 200 is connected to a CMD receive signal 322 received by the optional control portion 320. As STS signals, the STS receive signal 203 received by the main body control portion 200 is connected to an STS send signal 323 output by the optional control portion 320.

The CMD receive signal 322 is split in the optional discharge apparatus, and input to an interruption port of the optional control portion 320 as a CMD interruption signals 324. Such a setting is performed as to generate an interruption when the command interruption signal changes to a Low level. Further, the switch 325 can switch connection states (connected and disconnected states) of a CMD signal of another cascade-connected optional control portion (In this embodiment, no option apparatus is connected to the optional discharge apparatus in a downstream thereof).

While turning on/off the switches, the CMD signals of the cascade-connected optional apparatuses are sequentially connected, and individual ID numbers specific for functions are added to the functions (intermediate conveyance function=intermediate conveyance portion 41 and bin discharge function=bin discharge portion 42) of the respective optional apparatuses. The ID number registration method is described later in detail with reference to the flowchart. In the present invention, ID numbers are registered not on an optional apparatus basis but on a function basis. Therefore, no matter which of configurations of FIGS. 9A and 9B the connected optional apparatus has, ID numbers are assigned on a function basis as illustrated in Table 2.

TABLE 2

| | ID = 0 (Broadcast) | ID = 1 | ID = 2 | ID = 3 | ID = 4 | ID = 5 | ID = 6 | ID = 7 |
|---|---|---|---|---|---|---|---|---|
| Optional intermediate conveyance function (41)(Id number 1) | Target | Target | | | | | | |
| Optional bin discharge function (42)(Id number 2) | Target | | Target | | | | | |

The main body control portion of the image forming apparatus main body can perform conveyance control while communicating with the optional control portion based on the ID numbers assigned on a function basis irrespective of the configuration of the optional apparatus (configuration of the optional apparatus in which the intermediate conveyance apparatus and the bin discharge apparatus are separate from each other or configuration of the optional discharge apparatus in which the two functions are combined).

ID number=1 is specific function communication targeting only the intermediate conveyance function, and ID number=2 is specific function communication targeting only the bin discharge function. ID number=0 is a broadcast targeting all the functions. The broadcast is used for subjecting the intermediate conveyance function and the bin discharge function to synchronous conveyance control therebetween. Note that ID number=3 to 7 is used for the following case. That is, assuming that another optional apparatus is attached in a further downstream in FIGS. 9A and 9B, an exchange is performed for ID registration of a third function, and the ID is registered for the third function, based on which an excess error is judged. This example presupposes that each of the optional apparatuses operates with the power supply from the image forming apparatus main body, and that the image forming apparatus main body has a power capacity that guarantees the operations of up to two discharge functions while the power capacity becomes short in the operations of three or more discharge functions.

FIGS. 11A-1 to 11D-2 are communication timing charts for the image forming apparatus illustrating the third embodiment of the present invention. FIGS. 11A-1 to 11B-2 correspond to FIGS. 9A and 10A, and 9B and 10B, respectively.

Figures 1, 11A:
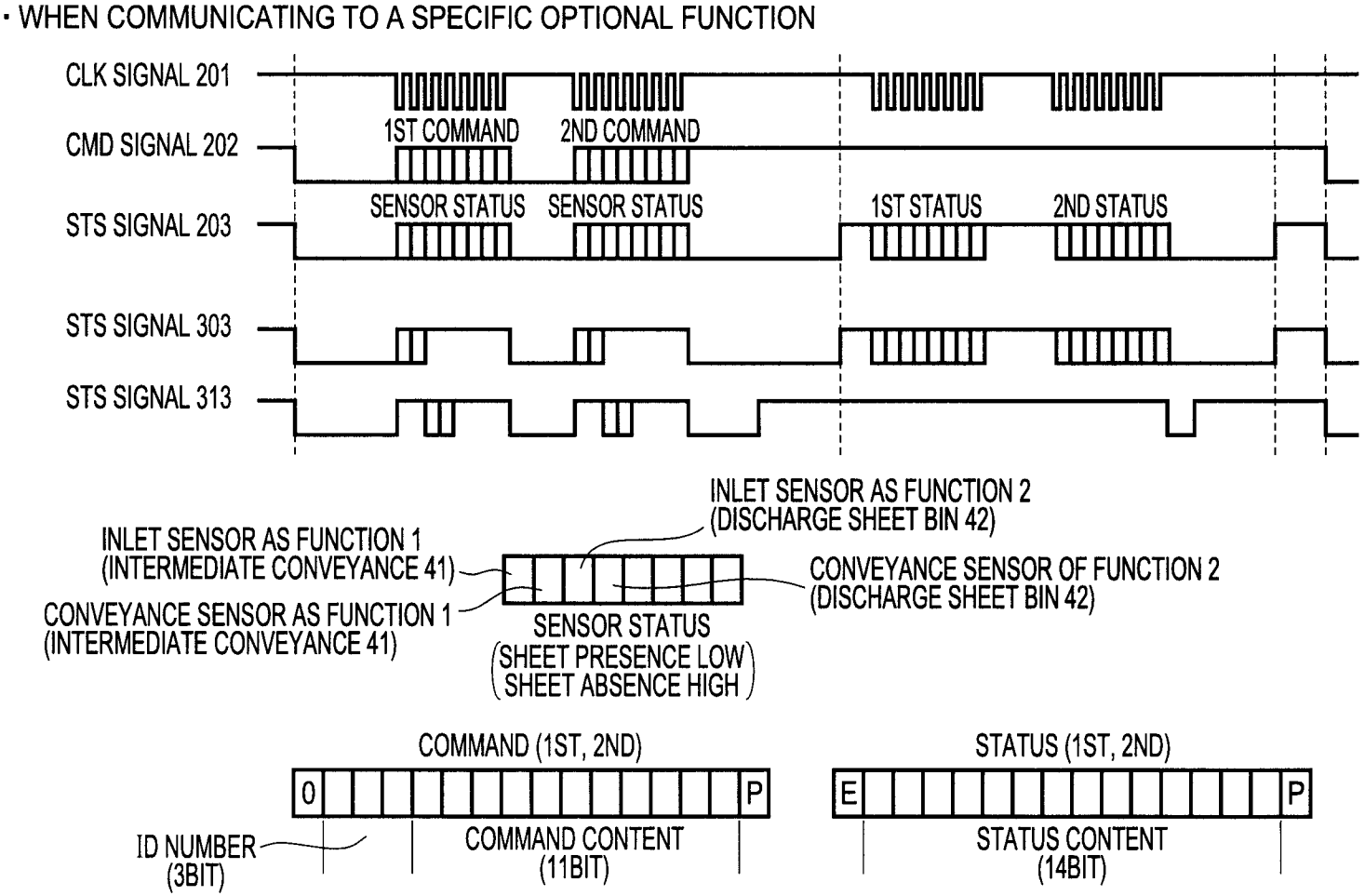
Figures 2, 11A:
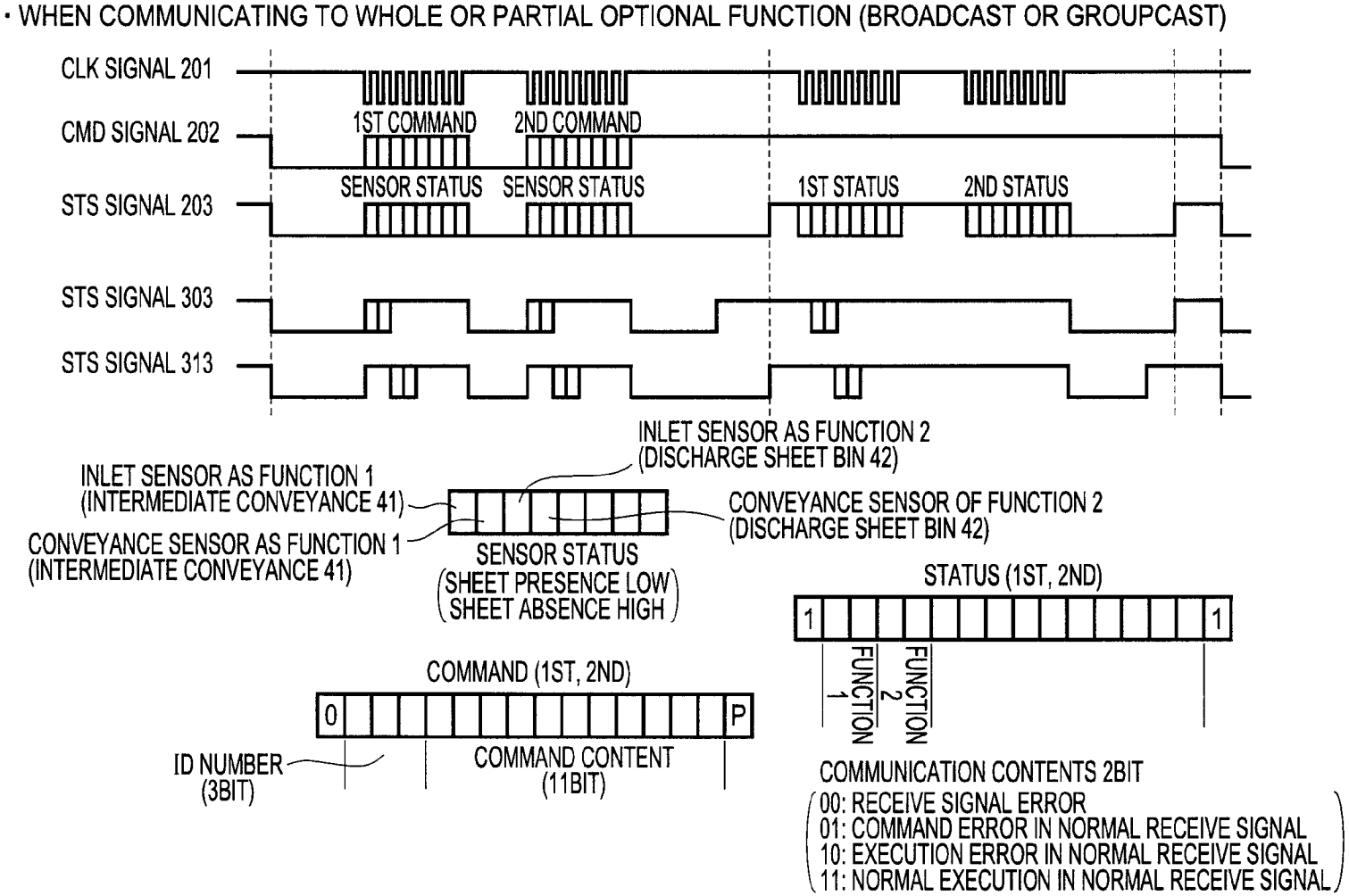

The upper charts of FIGS. 11A-1 and 11A-2 are timing charts for a case of communicating individually to a specific optional function. Before starting communication, the optional intermediate conveyance apparatus 130 and the optional bin discharge apparatus 131 permit interruptions by the CMD interruption signals 304 and 314, respectively. In this embodiment, an interruption is set to be allowed at Low level. The main body control portion 200 of the image forming apparatus main body 100 starts the communication by changing the CMD send signal 202 to Low. Interruptions occur by the CMD interruption signals 304 and 314, and hence the optional sheet feeding apparatuses 130 and 131 judge that the communication has started, respectively, and prepare for transmission of sensor statuses and reception of commands in order to return information on their inlet sensors and conveyance sensors of the functions (intermediate conveyance portion and bin discharge portion) in the apparatuses. Then, the optional apparatuses 130 and 131 change the STS signals 303 and 313 to Low level.

The main body control portion 200 sends command data by the CMD signal in synchronization with the CLK signal, while receiving the sensor information from the optional apparatuses as status data by the STS signals. Simultaneously, the optional apparatuses receive the command data by the CMD signal in synchronization with the CLK signal, while transmitting the status data by the STS signals.

In this embodiment, as 8-bit communication, command data and status data are each set to be one data item in two times of communication. The command data of 16 bits includes the ID number, command content, and a parity bit P as illustrated in the figures. When simultaneous transmission/reception of 8 bits have been completed twice, the optional apparatus checks the parity, and then judges whether or not the ID number added to the command data matches the ID of the currently owned function existing in the optional apparatus itself.

In the example of this timing chart, the command including ID number=1 targets the function 1 (intermediate conveyance portion 20*d*). The untargeted optional bin discharge apparatus 131 judges that the ID does not match the ID of the currently owned function, prepare their status data at FFh (with all bits set at High), prepare for the next status transmission, and change the STS signals 313 to High. The target optional intermediate conveyance apparatus 130 judges that the added ID matches the ID of the currently owned intermediate conveyance function. Then, the optional apparatus 103 judges that the received command data is addressed to the intermediate conveyance function, analyzes the command content to understand the meaning of the command, prepares status data to return in response to the command, prepares for transmission of the status, and changes the STS signal 303 to High. As illustrated in the figure, the status data includes an error bit E representing the presence/absence of an error, a 14-bit status content, and a parity bit P.

The optional intermediate conveyance apparatus 130 performs command analysis and status creation, and hence delays in changing the STS signal to High, compared to the untargeted optional bin discharge apparatus 131. The STS signal is wired-OR-connected for low-true. When the STS signals 303 and 313 of all the optional apparatuses change to High, the STS receive signal 203 also changes to High. After confirming that the STS receive signal 203 has changed to High, the main body control portion 200 receives the status data by the STS signal in synchronization with the CLK signal. The optional apparatuses 130 to 131 transmit the status data by the STS signals 303 and 313, respectively, in synchronization with the CLK signal. As the wired-OR-connected STS receive signal 203, the main body control portion 200 receives the same data as the status data of the optional intermediate conveyance apparatus 130, and analyzes the status data.

After ending the status transmission, the optional apparatuses 130 and 131 change the STS signals 303 and 313, respectively, to Low, and upon completion of preparation for the next communication, change the STS signals to High. The optional intermediate conveyance apparatus 130 subjected to the command sometimes executes a received command. In this case, the optional apparatus 103 delays in preparing for the next communication and changing the STS signal to High in comparison with the untargeted apparatus. After confirming that the STS receive signal 203 has changed to High for all the optional apparatuses, the main body control portion 200 shifts to the next communication.

The lower charts of FIGS. 11A-1 and 11A-2 are communication timing charts of broadcast communication. "ID number=0" added to a command means a broadcast ID specially targeting all the optional functions. Upon reception of a command with ID=0, all the optional apparatuses judge that the command is addressed to the currently owned optional function, and analyze and execute the command.

A return status to the main body control portion 200 is different from that in the upper chart. Each of the optional functions returns 2-bit-basis notification information including one selected from the receive signal error, which indicates that the command could not be received normally, and the incompatible command error, which indicates that the command was received, to a predetermined position as the status data. In the same manner, each of the optional functions returns 2-bit-basis notification information including one selected from the execution error, which indicates that the command was received and was compatible while no execution condition is satisfied, and the normal state, which indicates that the command was received and can be executed with satisfied execution conditions, to a predetermined position as the status data.

For the untargeted optional function, "1" as High is returned to a predetermined 2-bit-basis position. The optional apparatus having the targeted optional function executes the command for the targeted optional function, and hence such an optional apparatus take a long time until the preparation for the next communication is completed and the STS signal is changed to High.

Figures 1, 11B:
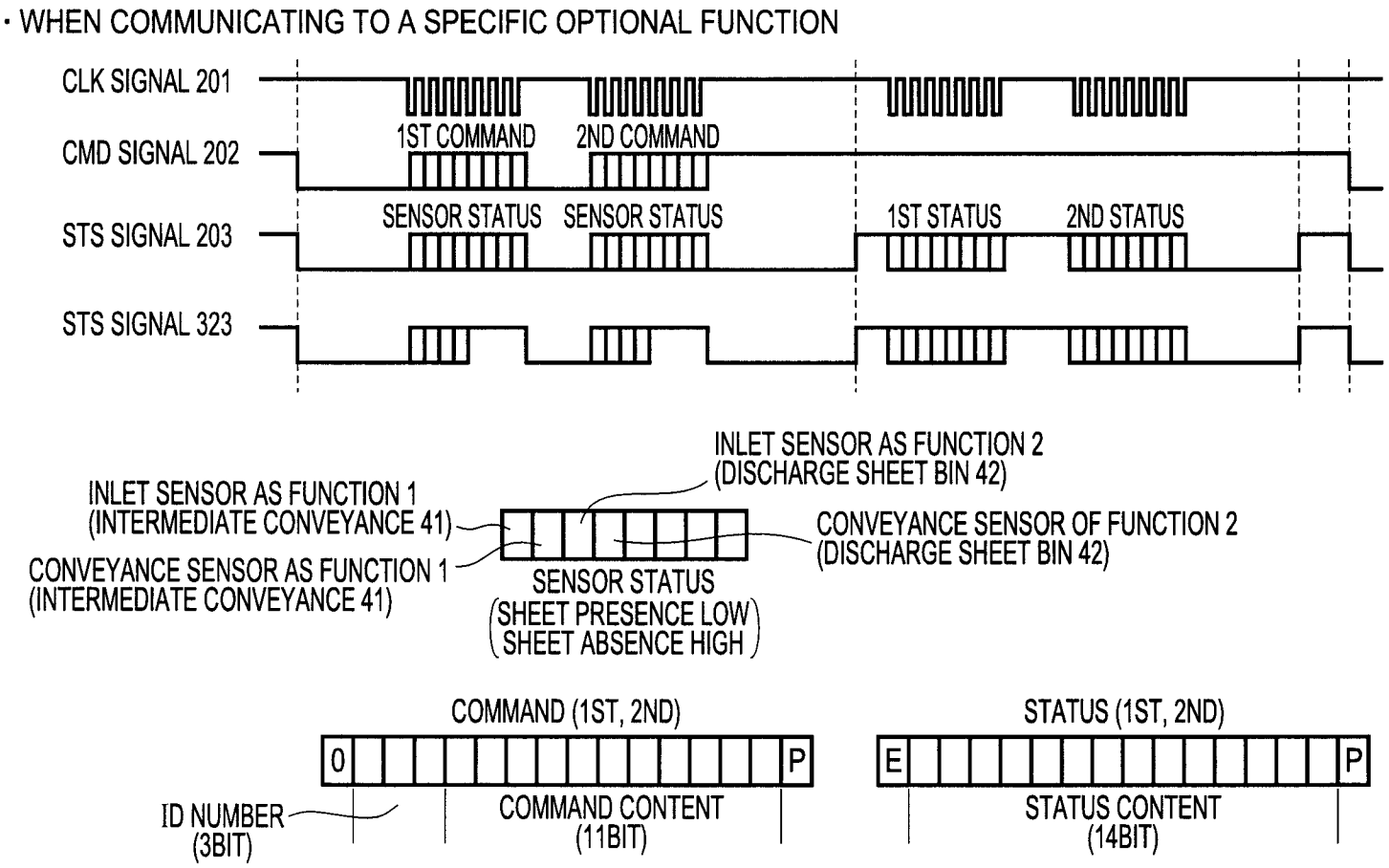
Figures 2, 11B:
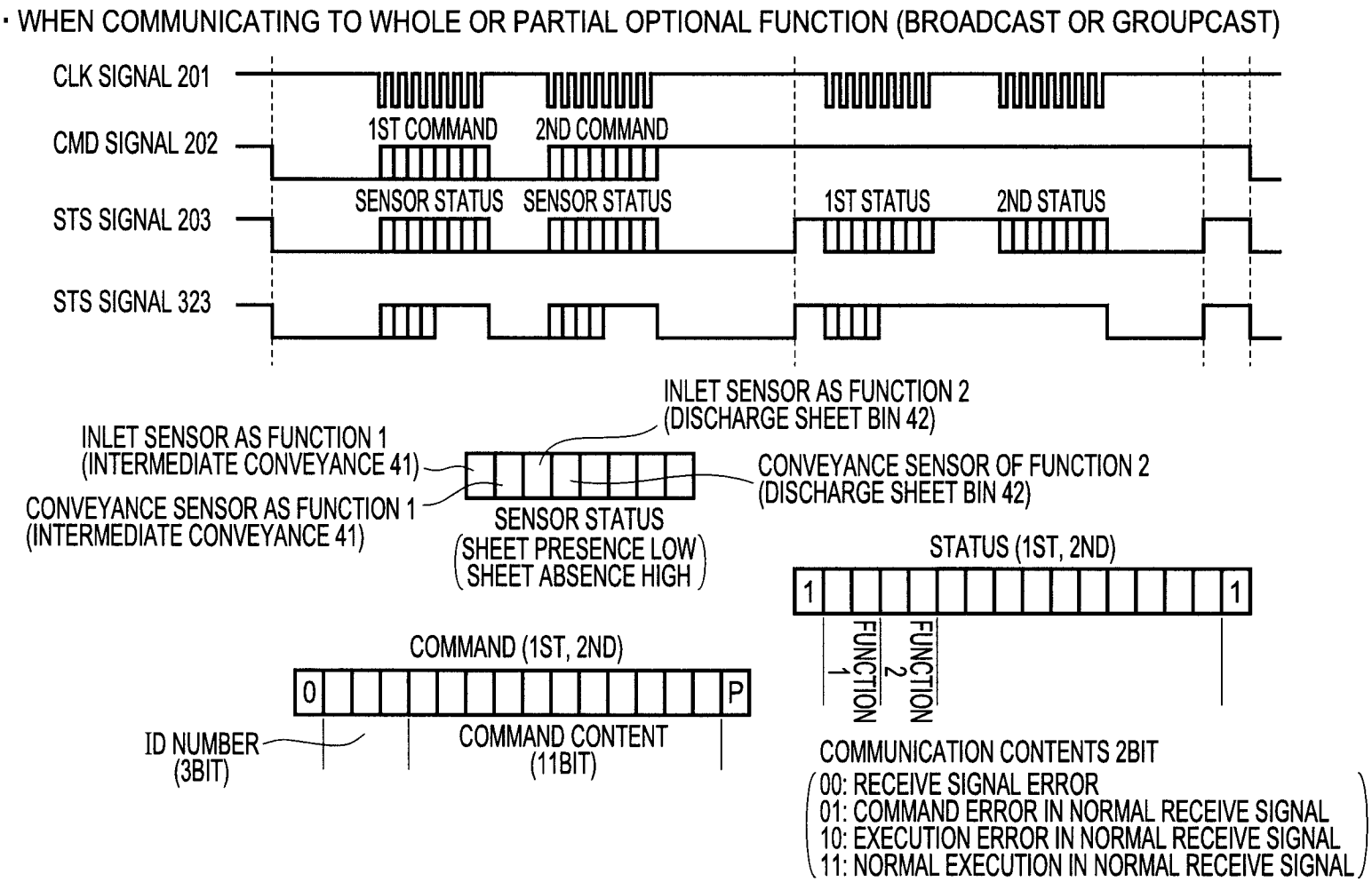

FIGS. 11B-1 and 11B-2 illustrate the integral optional discharge apparatus 132 having both of the intermediate conveyance function and the bin discharge function. The optional control portion 320 has two optional functions (function 1=intermediate conveyance portion 41 of ID=1 and function 2=bin discharge portion 42 of ID=2). Therefore, the optional control portion 320 analyzes the command by separately using IDs=1 and 2 of the existing optional functions, while returning the sensor information, the status contents, and the notification contents regarding the two optional functions by the STS signal 323.

As can be understood by comparing FIGS. 11A-1 to 11B-2 with one another, each optional apparatus performs communication with regard to multiple (including one) currently owned optional functions by distinguishing the ID numbers assigned to the respective optional functions. Therefore, the STS receive signal 203 of the main body control portion 200 is the same signal for any combination. By handling the optional functions separately, the main body control portion 200 can perform communication without concern about the configuration of the optional functions within the optional apparatus. This allows conveyance control on an optional function basis as well. One communication is enough to acquire the sensor states of the respective optional functions and to know the conveyance position of a sheet with accuracy, thereby enabling conveyance control with high speed.

The flowchart of ID registration control of the main body control portion of the image forming apparatus main body according to the third embodiment of the present invention is the same as that of FIG. 7 according to the second embodiment except for a difference in the optional apparatus. Hereinafter, description is made mainly of the difference.

First, the determination of the ID number in Step S401 is carried out in a slightly different manner, which is described here. Specifically, in the configuration of FIG. 9A, the ID registration notification meaning that the "the ID has been registered into one function" is received from the optional control portion 300 of the optional intermediate conveyance apparatus 130. Therefore, the main body control portion 200 judges that ID=1 has been registered into one function, and determines the next ID number=2.

In the configuration of FIG. 9B, the ID registration notification meaning that the "the IDs have been registered into two functions" is received from the optional control portion of the optional discharge apparatus 132 of an integral type having the two functions. Therefore, the main body control portion 200 judges that IDs=1 and 2 have been registered into two functions, and determines the next ID number=3. The main body control portion 200 repeats this operation to register ID number=1 into the intermediate conveyance function 41, and ID number=2 into the bin discharge function 42. No ID registration notification status is returned in response to the ID register command including ID number=3. Thus, the main body control portion 200 judges that the IDs have been registered into all the optional functions (S406), and ends the procedure. Note that if an ID registration notification status is returned in response to the ID register command including ID number=3 (if a user attaches another optional apparatus in a further downstream in any one of FIGS. 9A and 9B), the main body control portion 200 judges that the number of the optional functions exceeds the maximum number of two (S407). Then, as an excess error of the number of optional functions attached, the main body control portion 200 displays a message to prompt the user to reduce the number of optional functions (S408), and ends the procedure.

Regardless of which of one-function-dedicated type (optional intermediate conveyance apparatus or optional bin discharge apparatus) and an integral optional discharge apparatus the optional apparatus is of, the optional control portion performs ID assignment on an optional function basis according to the number of functions by the number of functions at a time (which is described with reference to FIG. 13). Accordingly, the main body control portion 200 can register IDs on an optional function basis as in Table 2, which enables communication and control to be performed on an optional function basis.

Figure 12:
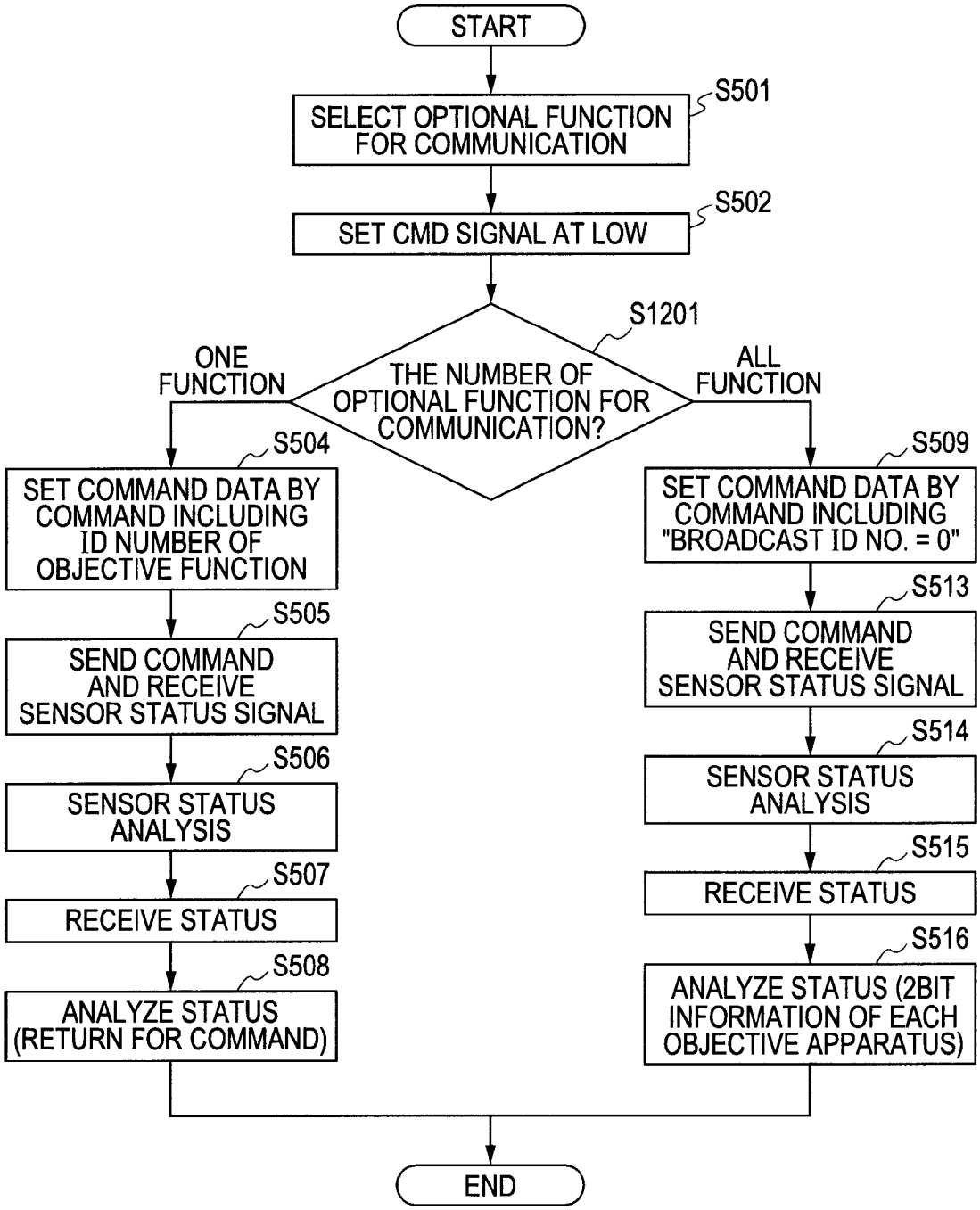
FIG. 12 is a flowchart of the command communication control of the main body control portion of the image forming apparatus main body according to the third embodiment of the present invention.

FIG. 12 is a flowchart of command communication control of the main body control portion 200 of the image forming apparatus main body according to the third embodiment of the present invention. Based on FIG. 5 of the first embodiment and the second embodiment, the flowchart of FIG. 12 is obtained by changing Step S503 to Step S1201 and deleting Steps S510 to S512. After ending the ID registration illustrated in FIG. 7, the main body control portion 200 selects an optional function for communication (S501). Specifically, the main body control portion 200 selects the "optional function 1" for the conveyance of the recording sheet only in the intermediate conveyance function (intermediate conveyance portion 41), and selects the "optional function 2" for the conveyance of the recording sheet only in the bin discharge function (bin discharge portion 42). Further, the main body control portion 200 selects the "optional functions 1 and 2" for the conveyance of the recording sheet extending over the intermediate conveyance function and the bin discharge function.

To notify the start of communication, the main body control portion 200 sets the CMD signal at Low (S502). If the number objective functions for the communication is one (S1201), the main body control portion 200 sets command data by a command including the ID number of the objective function (S504). For example, to communicate with only the "optional function 1", the main body control portion 200 adds ID number=1 to commands (such as conveyance start command, conveyance stop command, acceleration command, and deceleration command).

The main body control portion 200 transmits the command data by the CMD signal in synchronization with the CLK signal, and receives a sensor status by the STS signal (S505). The main body control portion 200 analyzes the received sensor status to recognize the states of the conveyance sensor and the sheet presence/absence sensor of the one function (S506). The main body control portion 200 waits until the STS signal changes to High, and then receives a status in synchronization with the CLK signal (S507). The main body control portion 200 analyzes the received status to judge whether or not the status is a status meaning that the command has successfully been executed (S508), and ends the procedure. If the execution of the command has failed, the optional apparatus performs an error processing such as communication retry, description of which is omitted here.

If all the functions are the objective functions for the communication (S1201), the main body control portion 200 sets command data by a command including ID number=0 meaning a broadcast (S509). The main body control portion 200 adds ID number=0 to commands (such as conveyance start command, conveyance stop command, acceleration command, and deceleration command).

The main body control portion 200 transmits the command data by the CMD signal in synchronization with the CLK signal, and receives a sensor status by the STS signal (S513). The main body control portion 200 analyzes the received sensor status to recognize the states of the conveyance sensor and the sheet presence/absence sensor of each function (S514). The main body control portion 200 waits until the STS signal changes to High, and then receives a status in synchronization with the CLK signal (S515). The main body control portion 200 analyzes the received status to confirm 2-bit information notifying whether or not each function has successfully executed the command (S516), and ends the procedure.

Note that in this embodiment, with regard to different optional functions, the optional functions are fixedly recognized as in ID=1 being the intermediate conveyance function and ID=2 being the bin discharge function in such an order as to be attachable to the image forming apparatus when the ID registration of FIG. 7 is completed. As another embodiment, after the ID registration of FIG. 7 is completed, a function query command may be transmitted in terms of ID=1 to receive a status meaning the intermediate conveyance function from the optional apparatus. Then, a function query command may be transmitted in terms of ID=2 to receive a status meaning the bin discharge function from the optional apparatus. The respective optional functions may be thus recognized.

Figures 13, 13A:
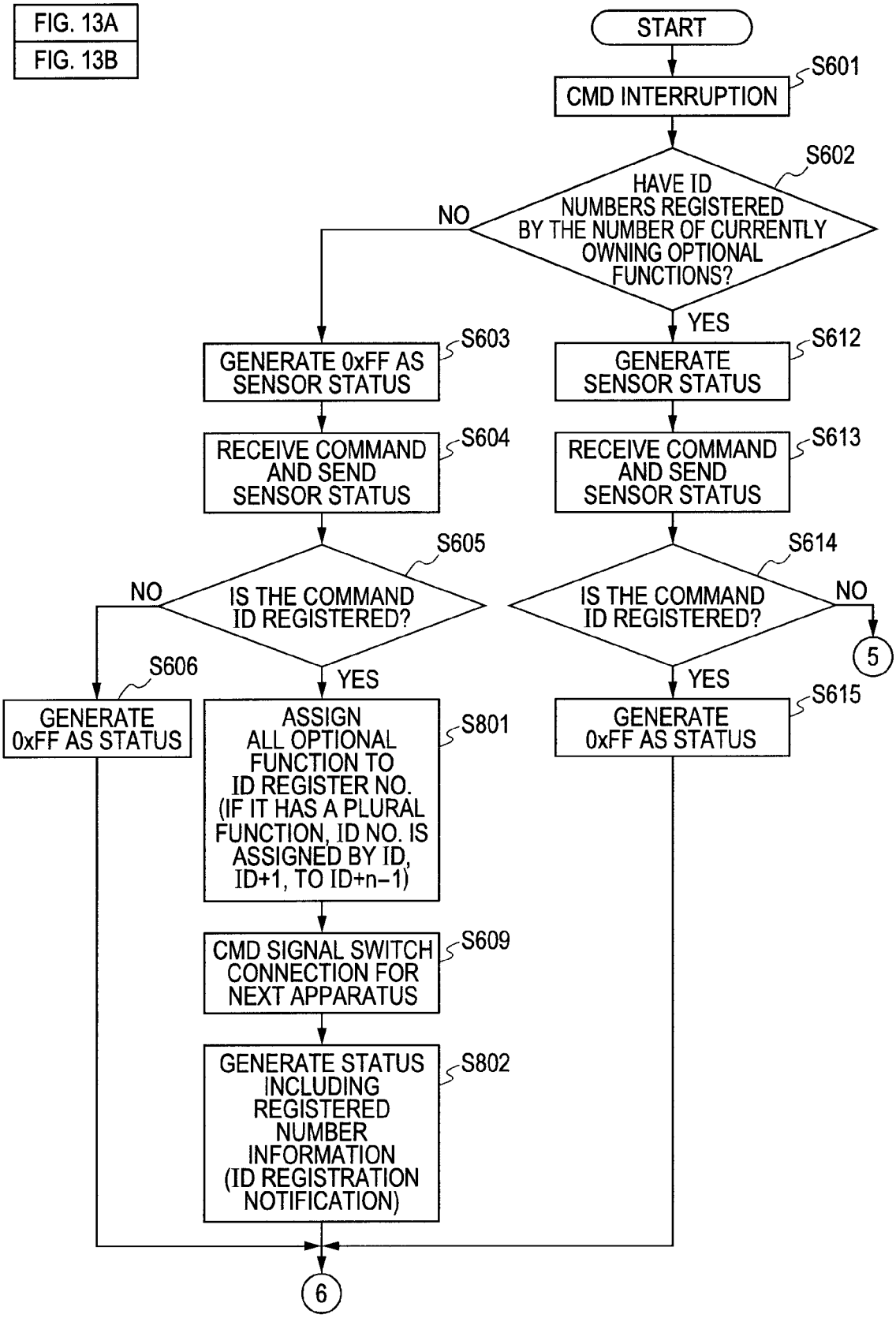
FIG. 13 is comprised of FIGS. 13A and 13B showing flowcharts of the ID registration control and the command communication control of the optional control portion of the optional apparatus according to the third embodiment of the present invention.
Figure 13B:
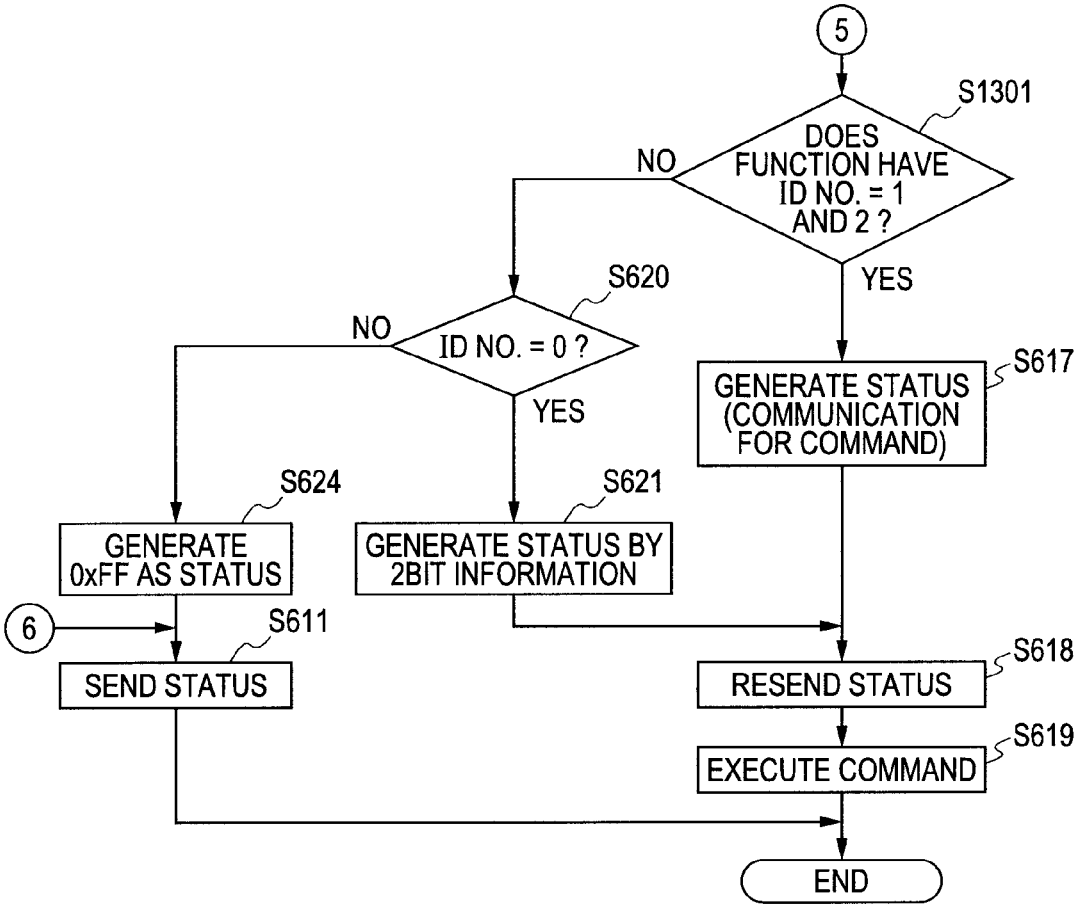

FIGS. 13A and 13B are flowcharts of the ID registration and the command communication control of the optional control portion of the optional apparatus according to this embodiment. FIG. 13 is different from FIG. 8 of the second embodiment in that Step S616 is replaced with Step 1301 and Steps S622 and 5623 are deleted.

Description of the same portions as those of the second embodiment are simplified or omitted here. After Step S601, for preparation for communication, the optional control portion judges whether or not ID numbers have been registered by the number of currently owned functions (S602). If no ID number has been registered, the optional control portion executes Steps S603 and S604 in the same manner as described above.

The optional control portion judges whether or not the command data is an ID register command (S605). If the received command data is the ID register command, the IDs are registered into the respective functions by the number of currently owned sheet feeding functions at one time as ID number=specified ID number, ID number=(specified ID number+1), . . . , ID number=(specified ID number+(the number n of functions−1)) (S801). By this ID registration, the ID numbers have been registered by the number of currently owned functions. Therefore, the optional control portion connects its CMD signal switch for another cascade-connected optional apparatus (S609).

The connection of the CMD signal switch allows a signal to be sent to the next cascade-connected optional apparatus in the next communication. In the ID registration notification meaning that the IDs have successfully been registered, the optional control portion generates a status including information on the number of registered functions is added, and changes the STS signal to High (S802). The optional control portion then transmits the status in synchronization with the CLK signal, changes the STS signal to High (S611), and ends the procedure.

Specifically, in the configuration of FIG. 9A, the optional control portion 300 of the optional intermediate conveyance apparatus 130, which has one function, registers ID=1 into this intermediate conveyance function, and transmits the ID registration notification meaning that the "the ID has been registered into one function". In the same manner, the optional control portion 310 of the optional bin discharge apparatus 131, which has one function, registers ID=2 into this bin discharge function, and returns the ID registration notification meaning that the "the ID has been registered into one function".

In the configuration of FIG. 9B, the optional control portion 320 of the optional discharge apparatus 132 of the integral type having the two functions, which has two functions, registers ID=1 into the intermediate conveyance function and ID=2 into the bin discharge function, and transmits the ID registration notification meaning that the "the IDs have been registered into two functions". If the received command data is not the ID register command (S605), the optional control portion generates 0xFF as a status to ignore the command, and changes the STS signal to High (S606). Then, the optional control portion transmits the status in synchronization with the CLK signal, changes the STS signal to High (S611), and ends the procedure.

If ID numbers have been registered by the number of currently owned functions (S602), the optional control portion performs the same processing as that of the second embodiment except for Step S1301, which is described below, and the description of the same portions is omitted here. In this embodiment, the specific function communication for individual functions targets only two functions. Therefore, in Step S1301, the range of the IDs is narrowed as in "Does function have ID number=1 and 2?". Further, the groupcasts of Steps S622 and 5623 are deleted because of the two functions which allows the groupcasts to be substituted by a broadcast. This embodiment takes the example of using different two functions, but naturally, in another embodiment, a groupcast may be performed on two functions out of three or more different functions.

In the above-mentioned manner, the optional control portion of the optional apparatus registers IDs by the number of currently owned functions on a function basis at a time, and connects the communication switch for the next optional apparatus, followed by sequential ID registration on a function basis. Then, the optional control portion receives the command by the ID number (targeting individual functions or targeting all the functions by broadcast) corresponding to the function from the main body control portion, and carries out the command of the objective function. Further, based on the ID number of each of the currently owned functions, the optional control portion sets the sensor information and the notification information on a function basis in a predetermined bit position to thereby enable the information to be efficiently transmitted to the main body control portion.

As described above, an ID number is registered into each function owned by the optional apparatus, and after the ID numbers have been registered by the number of functions owned by the optional apparatus, the communication switch for the next optional apparatus is connected, thereby enabling the ID numbers to be registered into each of the functions of all the optional apparatuses. Further, by providing such ID number registration means on a function basis, the ID number registration and the communication control can be performed under the same control irrespective of the combination of the types (dedicated function type and integral type having multiple different types) of the optional apparatuses as in FIGS. 9A and 9B. As a result, in a case where only the optional apparatus of the dedicated type is available at the time of release, if the optional apparatus of the integral type is added later, the program of the main body control portion need not be changed because the ID number registration and the communication control are the same, and hence various types of optional apparatuses may be supported. Further, regardless of the various types of optional apparatus, ID numbers are registered on a function basis. Therefore, based on the ID number on a function basis, the sensor information and the notification information on a function basis are set in a predetermined bit position to thereby enable the information to be efficiently transmitted to the main body control portion. Accordingly, an accurate position of a sheet being conveyed can be grasped with high speed, which can realize an improved throughput. In addition, ID numbers are added on a sheet feeding function basis, and unicast communication, broadcast communication, and groupcast communication are provided. Accordingly, the recording sheet to be conveyed over different functions can be subjected to conveyance start, conveyance stop, and conveyance acceleration/deceleration synchronously among the functions. Further, pulling or thrusting of the recording sheet between the functions is eliminated, which enables stable conveyance of the recording sheet.

(Other Embodiments)

The exemplary embodiments described above are mere examples, and allow various modifications and changes to be made by a person skilled in the art based on the gist of the present invention. It is to be understood that their equivalents are also included within the scope of the present invention. In addition, the present invention includes programs (programs corresponding to the flowcharts that have been described above) for implementing the functions according to the above-mentioned embodiments. The present invention also includes a recording medium for supplying those programs and a PC server for supplying those programs by downloading through the Internet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-140984, filed Jun. 12, 2009, which is hereby incorporated by reference herein in its entirety.

What is claimed is:

1. An image forming system, comprising:

a main body of an image forming apparatus;

an optional apparatus including at least one optional control unit configured to control a plurality of optional functions; and a communication unit configured to perform communication between the main body of the image forming apparatus and the optional apparatus, wherein the main body of the image forming apparatus comprises a registration designation unit configured to designate registration of an identification data to the one optional control unit of the optional apparatus by the communication unit, and wherein the one optional control unit of the optional apparatus performs an assignment operation to assign a plurality of identification datum, each of the identification datum being determined to specify each of the plurality of optional functions according to the designation performed by the registration designation unit, and wherein according to the assignment operation, the one optional control unit transmits information regarding completion of the assignment operation to the main body of the image forming apparatus.

2. An image forming system according to claim 1, wherein the one optional control unit of the optional apparatus comprises:

a judgment unit configured to judge whether or not a number of the plurality of identification datum has been determined by the number of optional functions; and an identification data registration unit configured to assign, when a command designating the registration of each of the plurality of identification datum is received from the main body of the image forming apparatus, in a case where the judgment units unit judges that the number of the plurality of identification datum has not been determined by the number of optional functions, the received identification data to one of the optional functions and return the information regarding the completion of the assignment operation to the main body of the image forming apparatus, and wherein the optional apparatus further comprises a switching unit configured to change communication with the next optional apparatus to a disconnected state if the judgment unit judges that the number of the plurality of identification datum has not been determined by the number of optional functions, and change the communication with the next optional apparatus to a connected state if the judgment unit judges that the number of the plurality of identification datum has been determined by the number of optional functions.

3. An image forming system according to claim 2, wherein the one optional control unit comprises an identification data ignoring unit configured to ignore, when the command designating the registration of the identification data is received from the main body of the image forming apparatus, if the judgment unit judges that the number of the plurality of identification datum has been determined by the number of optional functions, the received command designating the registration of the identification data.

4. An image forming system according to claim 1, wherein the one optional control unit of the optional apparatus comprises:

a judgment unit configured to judge whether or not the number of the plurality of identification datum has been determined by the number of optional functions; and an identification data registration unit configured to assign, when a command designating the registration of the identification data is received from the main body of the image forming apparatus, if the judgment unit judges that the number of the plurality of identification datum has not been determined by the number of optional functions, the number of the plurality of identification datum has to the respective optional functions by the number of optional functions according to the received command designating the registration of the identification data, and return the information regarding the completion of the assignment operation to the main body of the image forming apparatus by adding information on the number of optional functions thereto.

5. An image forming system according to claim 4, wherein the one optional control unit comprises identification data ignoring unit configured to ignore, when the command designating the registration of the identification data is received from the main body of the image forming apparatus, if the judgment unit judges that the number of the plurality of identification datum has been determined by the number of optional functions, the received command designating the registration of the identification data.

6. An image forming system according to claim 1, further comprising:

a unicast communication unit configured to perform, in a case where the main body of the image forming apparatus performs communication with one optional function within one specific optional apparatus, the communication by adding an individual identification data of the one optional function of the one specific optional apparatus;

a broadcast communication unit configured to perform, in a case where the main body of the image forming apparatus performs communication with all the optional functions of the optional apparatus, the communication by adding a broadcast identification data meaning all the optional functions;

a groupcast identification data registration unit configured to register a special groupcast identification data into partial optional functions of multiple optional apparatuses to be subjected to synchronous control for conveyance start, conveyance stop, and conveyance acceleration/deceleration of a recording sheet by the main body of the image forming apparatus; and a groupcast communication unit configured to perform, in a case of performing communication with partial optional functions to be subjected to synchronous conveyance, the communication by adding the groupcast identification data registered by the groupcast identification data registration unit.

7. An image forming system according to claim 1, wherein the optional apparatus comprises an information returning unit configured to return information on a status to the main body of the image forming apparatus by adding information on each of the optional functions to the information on the status to be returned to the main body of the image forming apparatus in a bit position predetermined by an identification data assigned to each of the optional functions.

8. An image forming system according to claim 1, wherein the optional apparatus comprises an information notification unit configured to notify, when a command is received from the main body of the image forming apparatus, information on a status to the main body of the image forming apparatus in simultaneous transmission/reception by adding information on each of the optional functions to the information on the status to be notified to the main body of the image forming apparatus in a bit position predetermined by an identification data assigned to each of the optional functions.

9. An image forming system according to claim 1, further comprising an excess error detection unit configured to detect an excess error of the number of optional functions in a case where the identification data of the optional function exceeding a maximum number is determined.

10. An image forming system, comprising:

a main body of an image forming apparatus;

a sheet feeding apparatus including at least one control unit configured to control a plurality of feed portions; and a communication unit configured to perform communication between the main body of the image forming apparatus and the sheet feeding apparatus, wherein the main body of the image forming apparatus comprises a registration designation unit configured to designate registration of an identification data to the one control unit of the sheet feeding apparatus by the communication unit, wherein the one control unit of the sheet feeding apparatus performs an assignment operation to assign a plurality of identification datum, each of the identification datum being determined to specify each of the plurality of feed portions according to the designation performed by the registration designation unit, and wherein according to the assignment operation, the one control unit transmits information regarding completion of the assignment operation to the main body of the image forming apparatus.

11. An image forming system, comprising:

a main body of an image forming apparatus;

a discharge apparatus including at least one control unit configured to control a plurality of discharge portions; and a communication unit configured to perform communication between the main body of the image forming apparatus and the discharge apparatus, wherein the main body of the image forming apparatus comprises a registration designation unit configured to designate registration of an identification data to the one control unit of the discharge apparatus by the communication unit, and wherein the one control unit of the discharge apparatus performs an assignment operation to assign a plurality of identification datum, each of the identification datum being determined to specify each of the plurality of discharge portions according to the designation performed by the registration designation unit, and wherein according to the assignment operation, the one unit transmits information regarding completion of the assignment operation to the main body of the image forming apparatus.

12. An optional apparatus including at least one optional control unit configured to control a plurality of optional functions in the optional apparatus, wherein the one optional control unit performs an assignment operation to assign a plurality of identification datum, each of the identification datum being determined to specify each of the plurality of optional functions according to a designation for registering the plurality of identification datum, wherein according to the assignment operation, the one optional control unit transmits information regarding completion of the assignment operation to the main body of the image forming apparatus.

13. An sheet feeding apparatus including at least one control unit configured to control a plurality of feed portions in the sheet feeding apparatus, wherein the one control unit performs an assignment operation to assign a plurality of identification datum, each of the identification datum being determined to specify each of the plurality of feed portions according to a designation for registering the plurality of identification datum, wherein according to the assignment operation, the one control unit transmits information regarding completion of the assignment operation to the main body of the image forming apparatus.

14. A discharge apparatus including at least one control unit configured to control a plurality of discharge portions in the discharge apparatus, wherein the one control unit performs an assignment operation to assign a plurality of identification datum, each of the identification datum being determined to specify each of the plurality of discharge portions according to a designation for registering the plurality of identification datum, wherein according to the assignment operation, the one control unit transmits information regarding completion of the assignment operation to the main body of the image forming apparatus.

* * * * *